US005469789A

United States Patent [19]

Haijima et al.

[11] Patent Number: 5,469,789

[45] Date of Patent: Nov. 28, 1995

[54] PRINTING SHEET MAKING AND PRINTING APPARATUS

[75] Inventors: Hideki Haijima; Shinji Okuda, both of Kanagawa, Japan

[73] Assignee: Sony Corporation, Tokyo, Japan

[21] Appl. No.: 402,186

[22] Filed: Mar. 10, 1995

Related U.S. Application Data

[62] Division of Ser. No. 291,043, Aug. 22, 1994.

[30] Foreign Application Priority Data

Aug. 24, 1993 [JP] Japan ..... 5-229589
Oct. 15, 1993 [JP] Japan ..... 5-280732

[51] Int. Cl.[6] ..... B41F 27/06

[52] U.S. Cl. ..... 101/477; 101/395

[58] Field of Search ..... 101/401.1, 477, 101/483, 485, 486, 415.1, 375, 395; 493/194, 195, 166, 926

[56] References Cited

U.S. PATENT DOCUMENTS

| | | | |
|---|---|---|---|
| 4,453,708 | 6/1984 | Dewnhardt | 101/419 |
| 4,925,438 | 5/1990 | Wagner | 493/194 |
| 5,023,121 | 6/1991 | Pockat et al. | 428/36.9 |
| 5,084,728 | 1/1992 | Horikiri et al. | 355/72 |
| 5,126,531 | 6/1992 | Majima et al. . | |
| 5,247,883 | 9/1993 | Kuwahara et al. . | |
| 5,293,820 | 3/1994 | Maejima et al. | 101/477 |
| 5,299,498 | 4/1994 | Spiegel et al. | 101/415.1 |
| 5,390,603 | 2/1995 | Hauck et al. | 101/477 |

*Primary Examiner*—Eugene H. Eickholt
*Attorney, Agent, or Firm*—William S. Frommer; Alvin Sinderbrand

[57] ABSTRACT

In a printing sheet making and printing system applicable to for example an electronic gravure printing system a printing sheet is sheathed in a printing sheet jacket to prevent the adhesion of dust and the occurrence of scratching on its surface and the feeding and ejection of the printing sheet to and from the cylinders of a printing sheet making machine and a printing machine is completely automated so that an operator can run the system without ever directly touching the printing sheet. A printing sheet, a printing sheet jacket, and devices for pulling the jacket and the printing sheet into a printing sheet making machine or a printing machine and removing the printing sheet from the jacket and winding and clamping it onto a cylinder for engraving of the printing sheet or printing with it and returning it to the jacket and ejecting the jacket and the printing sheet inside it from the machine after the engraving or printing all in a completely automated fashion are disclosed. The interchangeability of the printing sheets with respect to the cylinders is extremely good and consequently when image data such as a photograph is engraved color by color on a plurality of printing sheets and multicolor overprinting is carried out color non-alignment, color blurring, image distortion and scumming and the like do not readily occur and high image quality, fine printing can be performed. The invention facilitates development toward a completely automated electronic gravure printing system which can be run unmanned.

9 Claims, 68 Drawing Sheets

PRINTING SHEET MAKING AND PRINTING APPARATUS

This application is a division of application Ser. No. 08/291,043, filed Aug. 22, 1994.

BACKGROUND OF THE INVENTION

This invention relates to a printing sheet making and printing apparatus most suitable for application to for example an electronic gravure printing system.

DESCRIPTION OF THE PRIOR ART

Conventionally, for example as shown in U.S. Pat. No. 5,126,531, in an electronic gravure printing system, which is an example of an intaglio printing system, a printing sheet of approximately 200 microns in thickness made of a thermoplastic resin such as polyethylene resin has been used.

In an engraving step carried out by a printing sheet making machine, this printing sheet is wound onto the periphery of a cylinder and while the cylinder is rotated at high speed image data in the form of relief is engraved in the surface of the printing sheet by the laser beam of a semiconductor laser cutting into the printing sheet as the laser is reciprocated in the direction of the axis of the cylinder.

Then, in a printing step carried out by a printing machine, the printing sheet engraved in the foregoing engraving step is again wound onto the periphery of a cylinder. While the cylinder is rotated at high speed, ink is coated by an ink roller onto the image data in the form of relief in the printing sheet; paper or the like, the matter to be printed, is pressed by a pressure roller against the surface of the printing sheet while being fed past it at high speed, and an image such as a photograph or the like is printed at high speed on the surface of the paper.

In this step, in the case of color printing, printing sheet making is performed separately for each of a number of colors such as cyan, magenta, yellow and black, and multicolor overprinting with cyan, magenta, yellow and black inks is carried out.

With such an electronic gravure printing system, because it is possible to highly precisely engrave image data in the form of relief in the surface of the printing sheet in the order of submicrons using a laser beam emitted by a semiconductor laser, images such as photographs can be printed with extremely high precision.

However, in conventional electronic gravure printing systems, the printing sheet has been wound onto the periphery of the cylinder and fixed there with screws by hand.

As a result, in conventional electronic gravure printing systems, there has been the problem that the work of winding the printing sheet onto the periphery of the cylinder is tiresome and the operatability of the printing sheet making and printing work is low.

Also, in systems wherein the printing sheet is wound onto the cylinder and fixed there with screws by hand, misalignment of the printing sheet with respect to the cylinder and creasing and the like tend to occur, and when printing sheet making of image data such as a photograph is done separately for each of several colors such as cyan, magenta, yellow and black and multicolor overprinting is carried out, there has been the problem that color blurring, image distortion, and scumming and the like occur, and that the interchangeability of the printing sheets with respect to the cylinder is low.

Also, if fine dust or the like adheres to the image data in the form of relief engraved in the surface of the printing sheet in the order of submicrons, or if even the slightest scratching occurs there, this results in color blurring and scumming and the like.

However, in conventional electronic gravure printing systems, the printing sheets are handled singly and fitting and removal of the printing sheets with respect to the printing sheet making machine cylinder and the printing machine cylinder has been carried out entirely by hand.

Consequently, while the printing sheets are being handled, dust has adhered to the image data in the form of relief in the surface of the printing sheet, scratching has tended to occur, and color blurring and scumming and the like has resulted.

This invention was devised in order to solve the above-mentioned problems, and one of its objects is to provide an apparatus for winding a printing sheet onto a cylinder of a printing sheet making and printing system which apparatus can wind a printing sheet onto and off the periphery of the cylinder automatically.

Another object of the invention is to provide an apparatus for winding a printing sheet onto a cylinder of a printing sheet making and printing system which apparatus can wind a printing sheet onto the periphery of the cylinder automatically and with high precision.

Another object of the invention is to provide a printing sheet making and printing system wherein before and after engraving and before and after printing, from start to finish, the adhesion of dust and the occurrence of scratching on the surface of a printing sheet can be prevented.

A further object of the invention is to provide a printing sheet feed and eject apparatus for a printing sheet making and printing system wherein the feeding and ejection of printing sheets to and from the cylinders of a printing sheet making machine and a printing machine can be completely automated notwithstanding that the printing sheets are sheathed in printing sheet jackets to prevent the adhesion of dust and the occurrence of scratching on the surfaces of the printing sheets.

A further object of the invention is to provide an apparatus for winding a printing sheet onto a cylinder of a printing sheet making and printing system which apparatus can wind a printing sheet onto the periphery of a cylinder automatically and smoothly carry out the operations of clamping the printing sheet onto the periphery of the cylinder and releasing this clamping.

A further object of the invention is to provide a printing sheet jacket which makes it possible for a printing sheet to be safely and easily handled.

BRIEF DESCRIPTION OF THE DRAWINGS

FIG. 5(A) shows the opening/closing flap in its unlocked state and FIG. 5(B)

Figure 4:
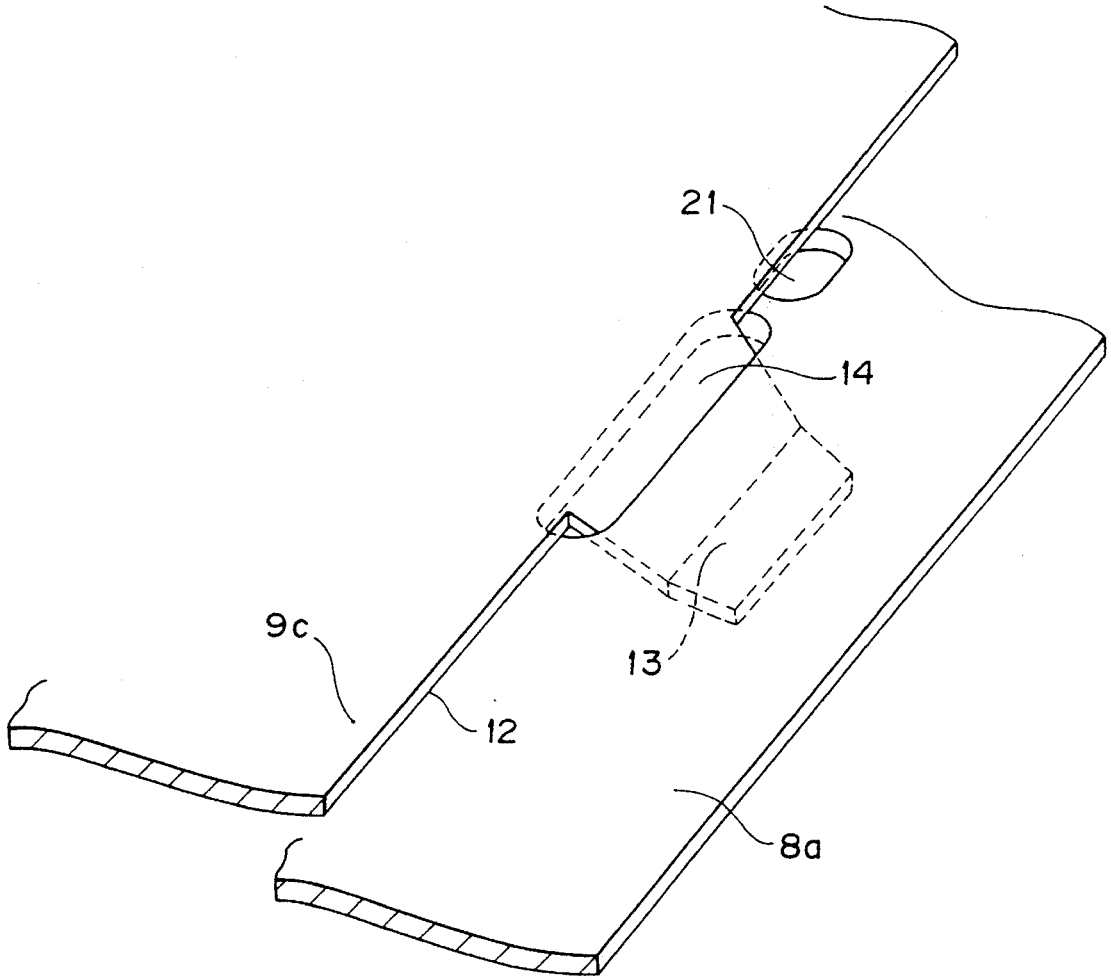
FIG. 4 is an enlarged perspective view of a main part of a printing sheet jacket showing the locked state of an opening/closing flap.
Figure 6A:
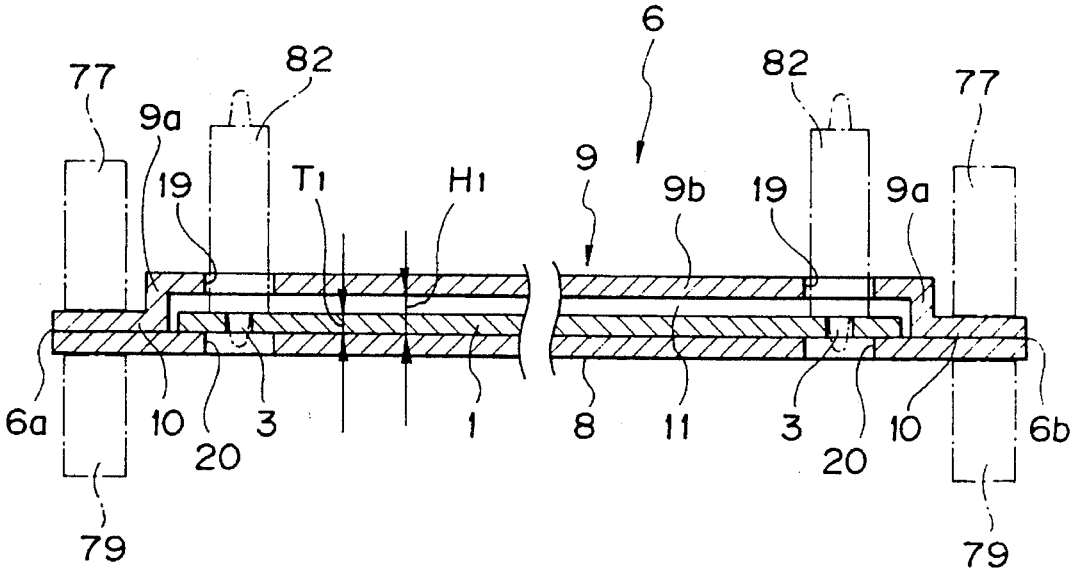
Figure 6B:
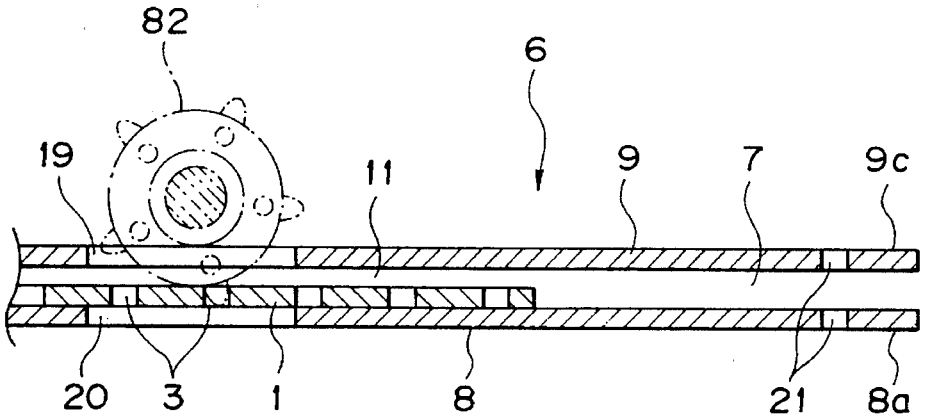
Figure 7A:
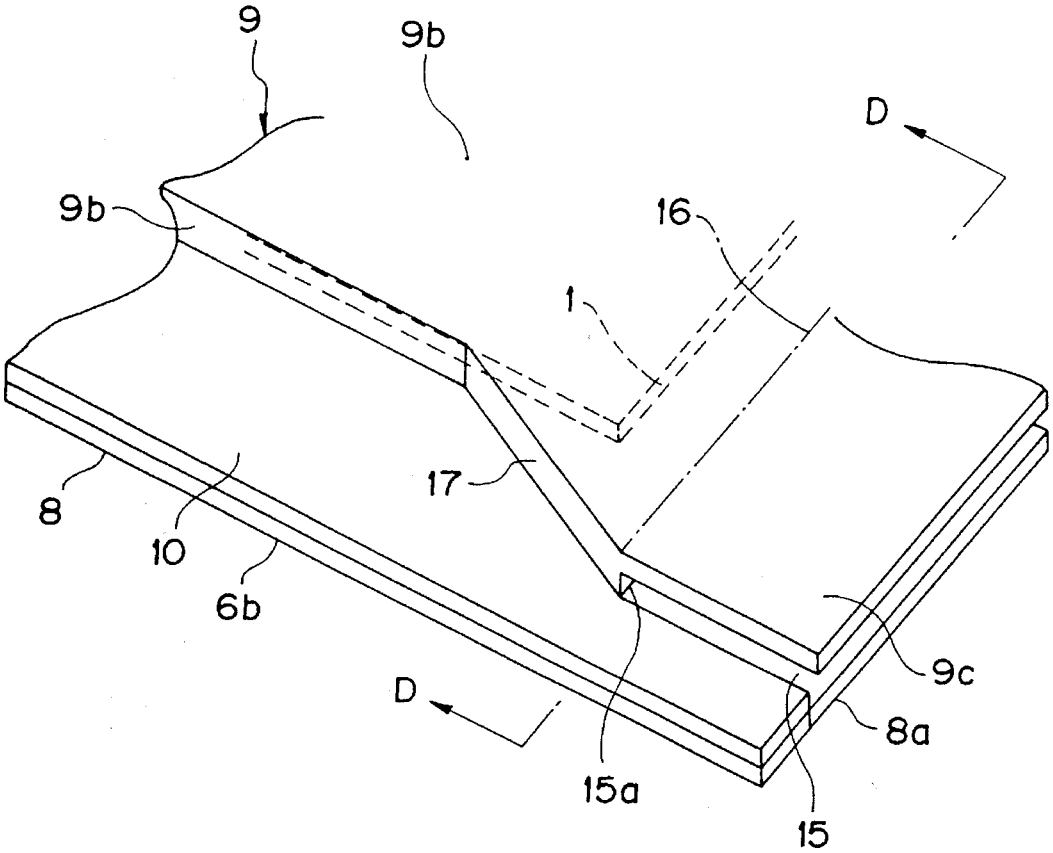
Figure 7B:
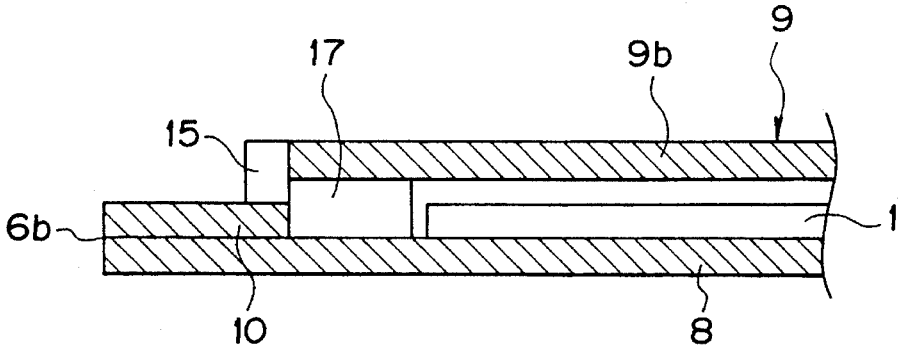
Figure 8A:
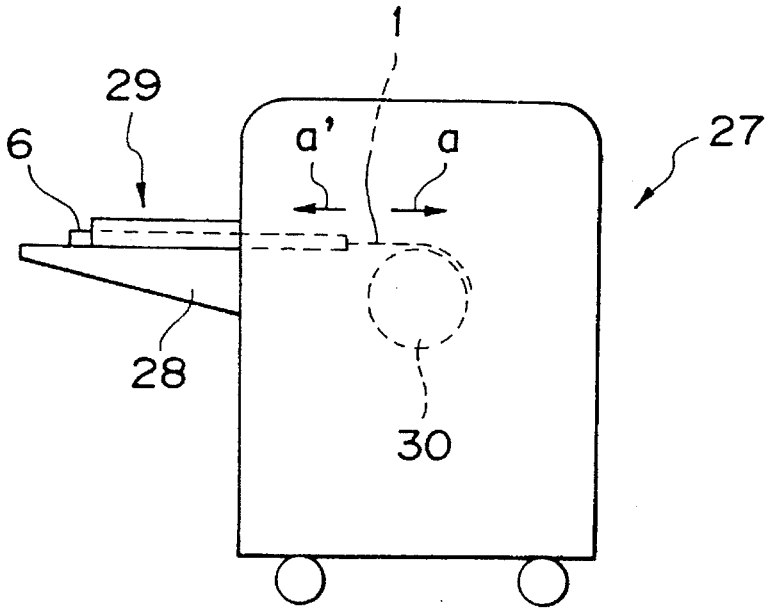
Figure 8B:
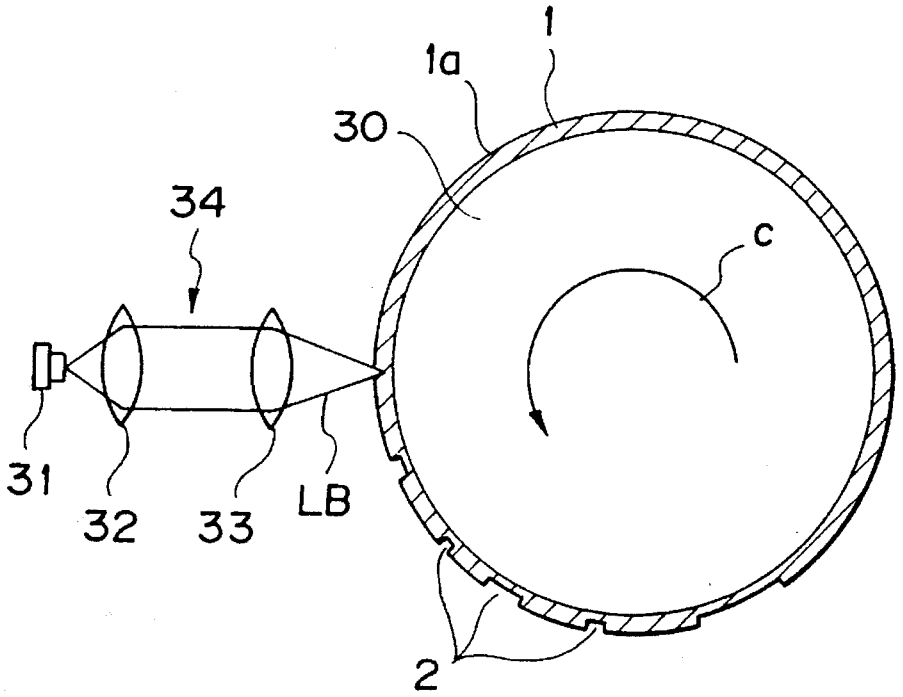
Figure 9A:
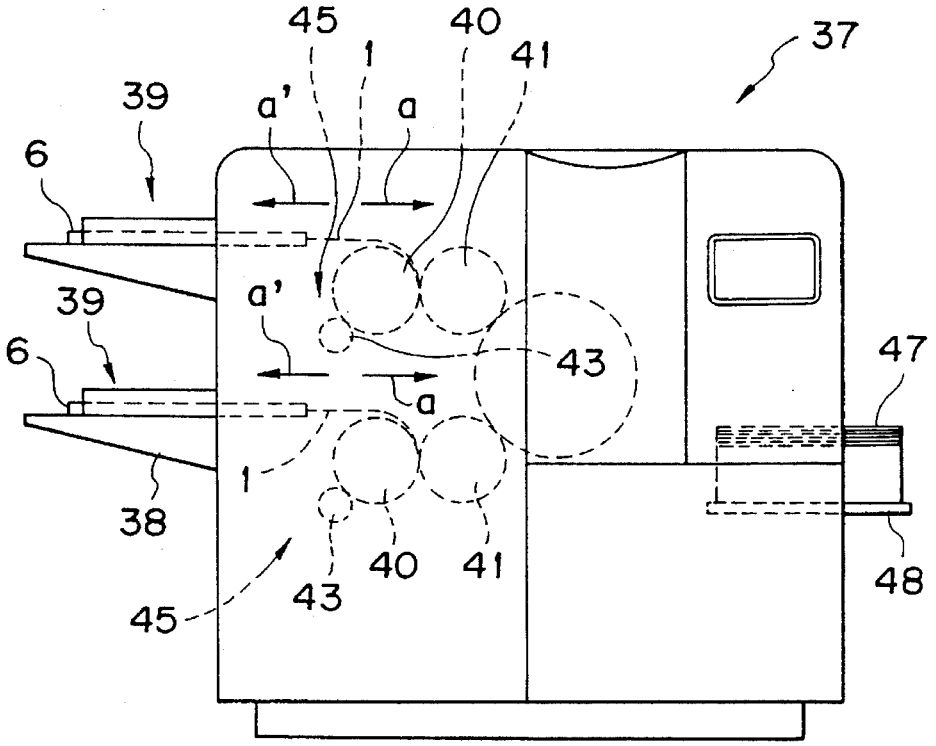
Figure 9B:
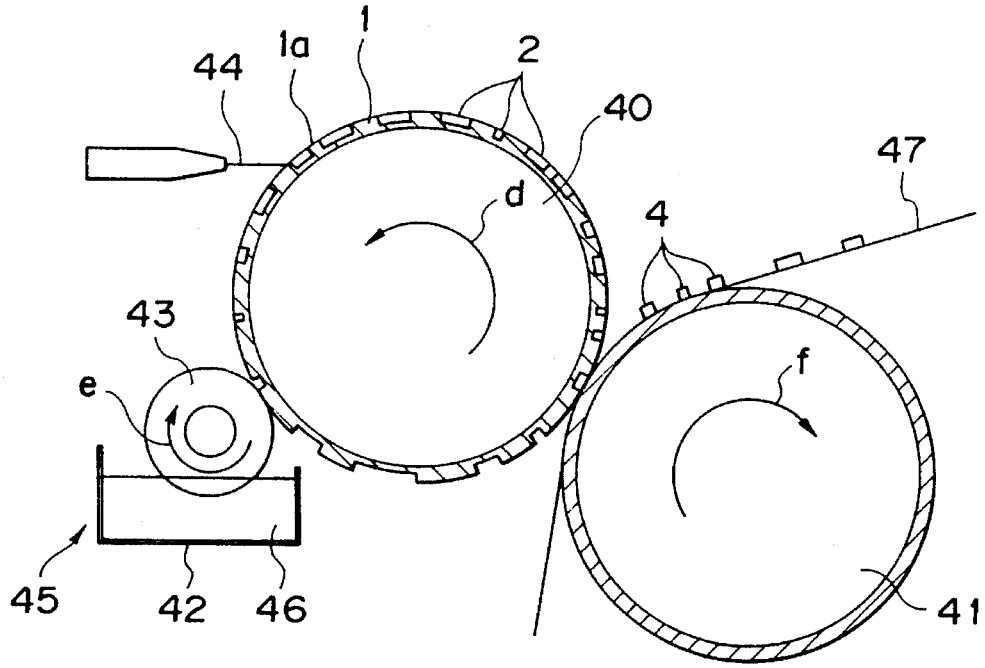
Figure 10:
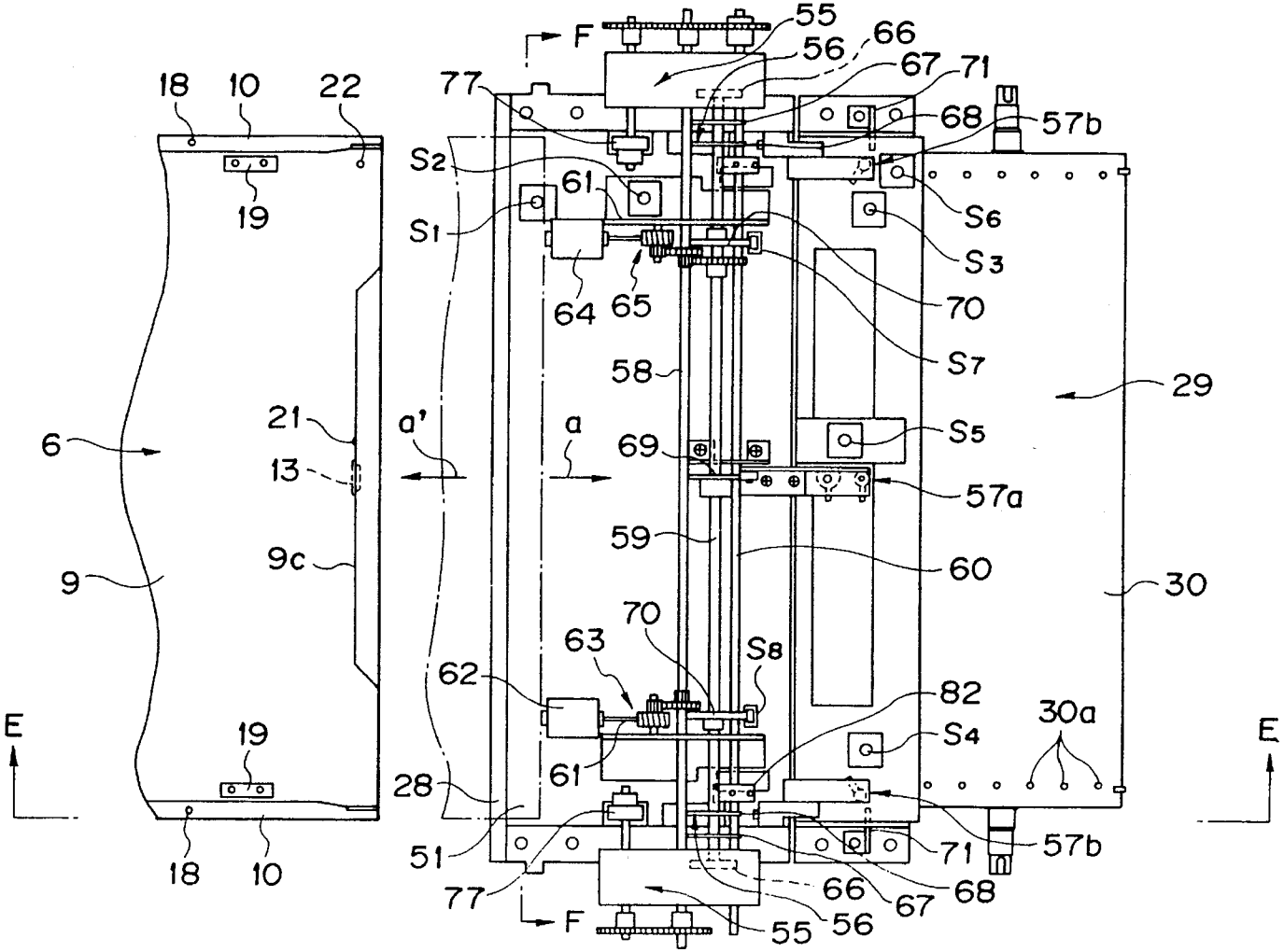
Figure 11:
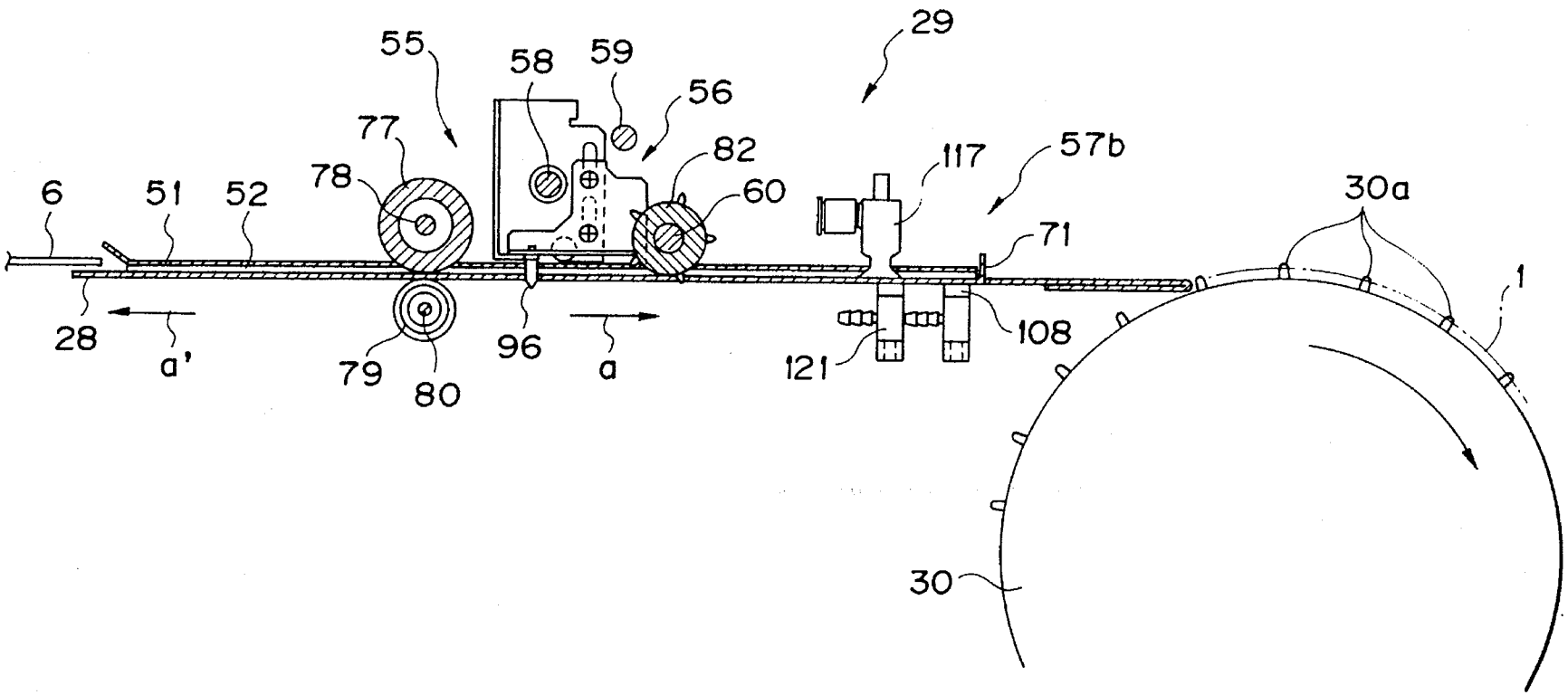
Figure 12:
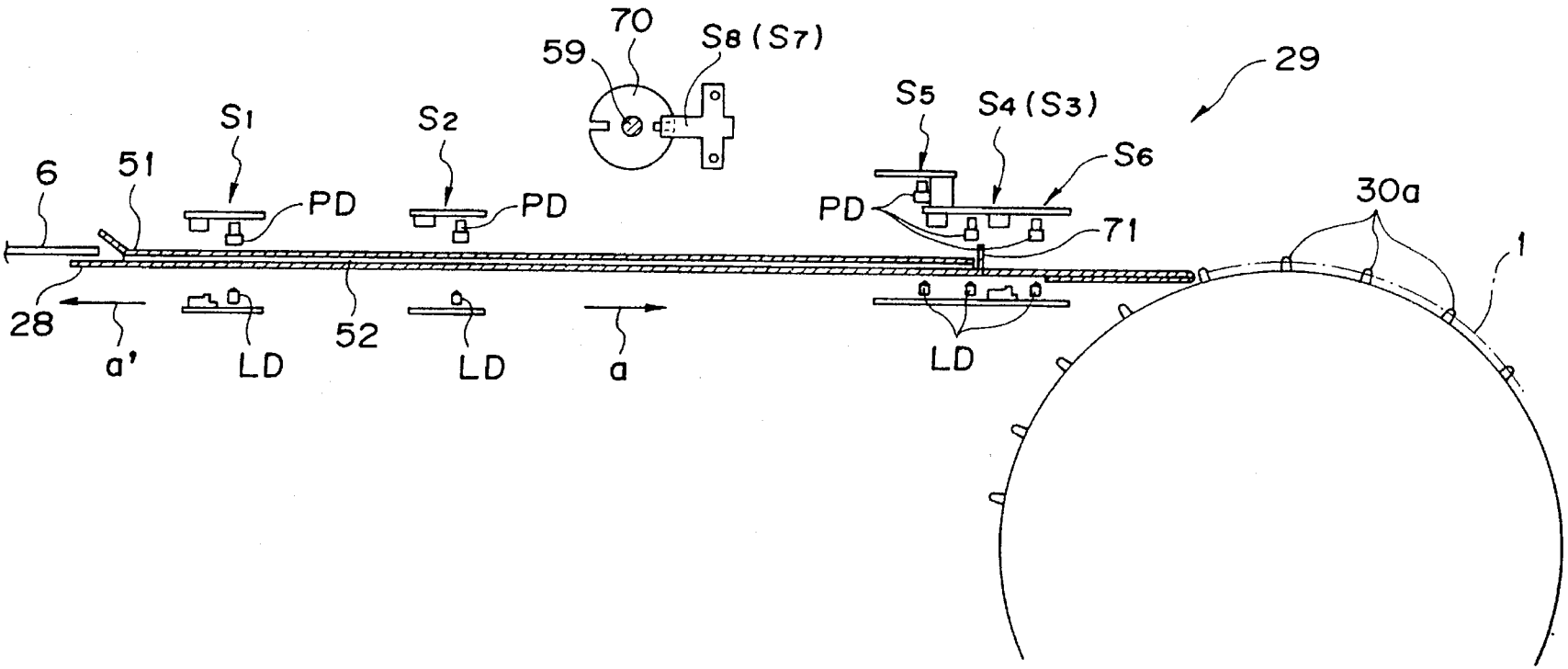
Figure 13:
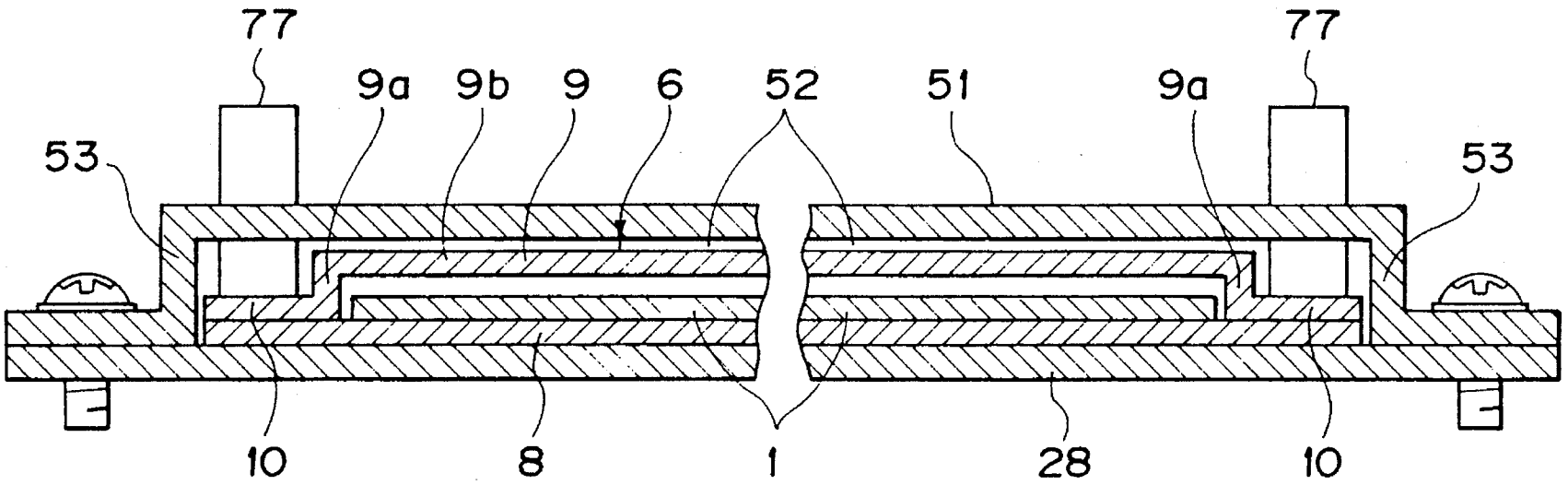
Figure 14:
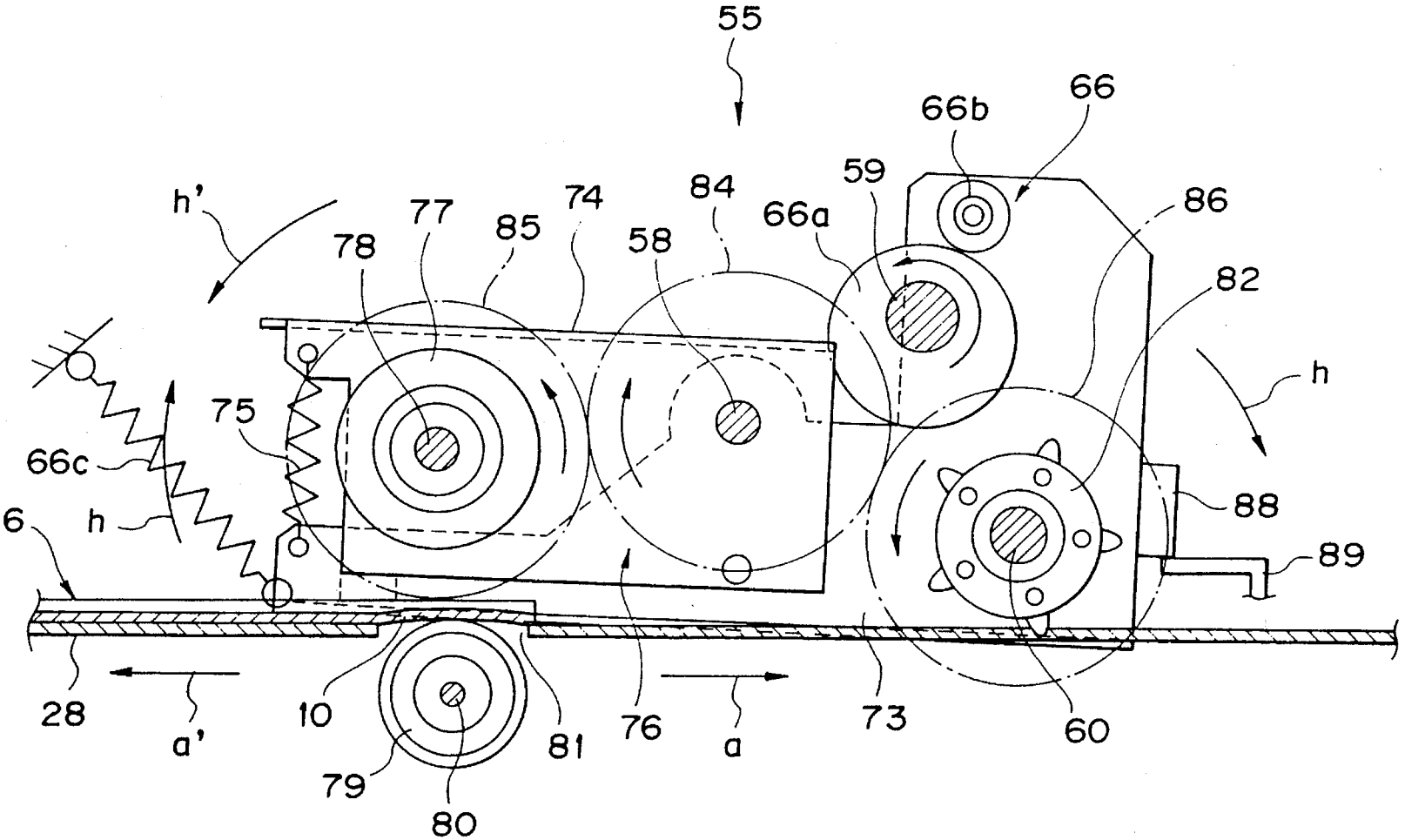
Figure 15:
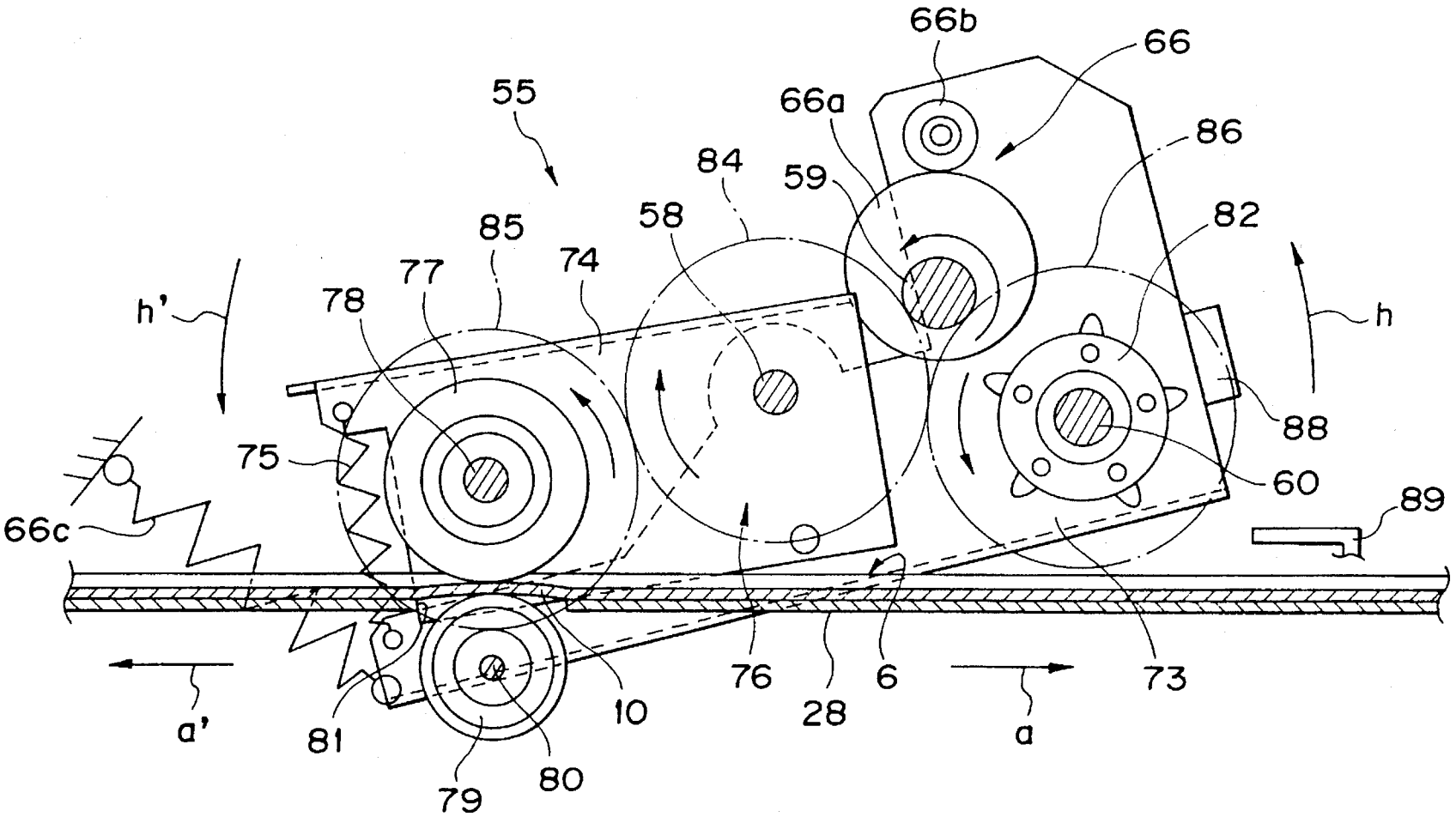
Figure 16:
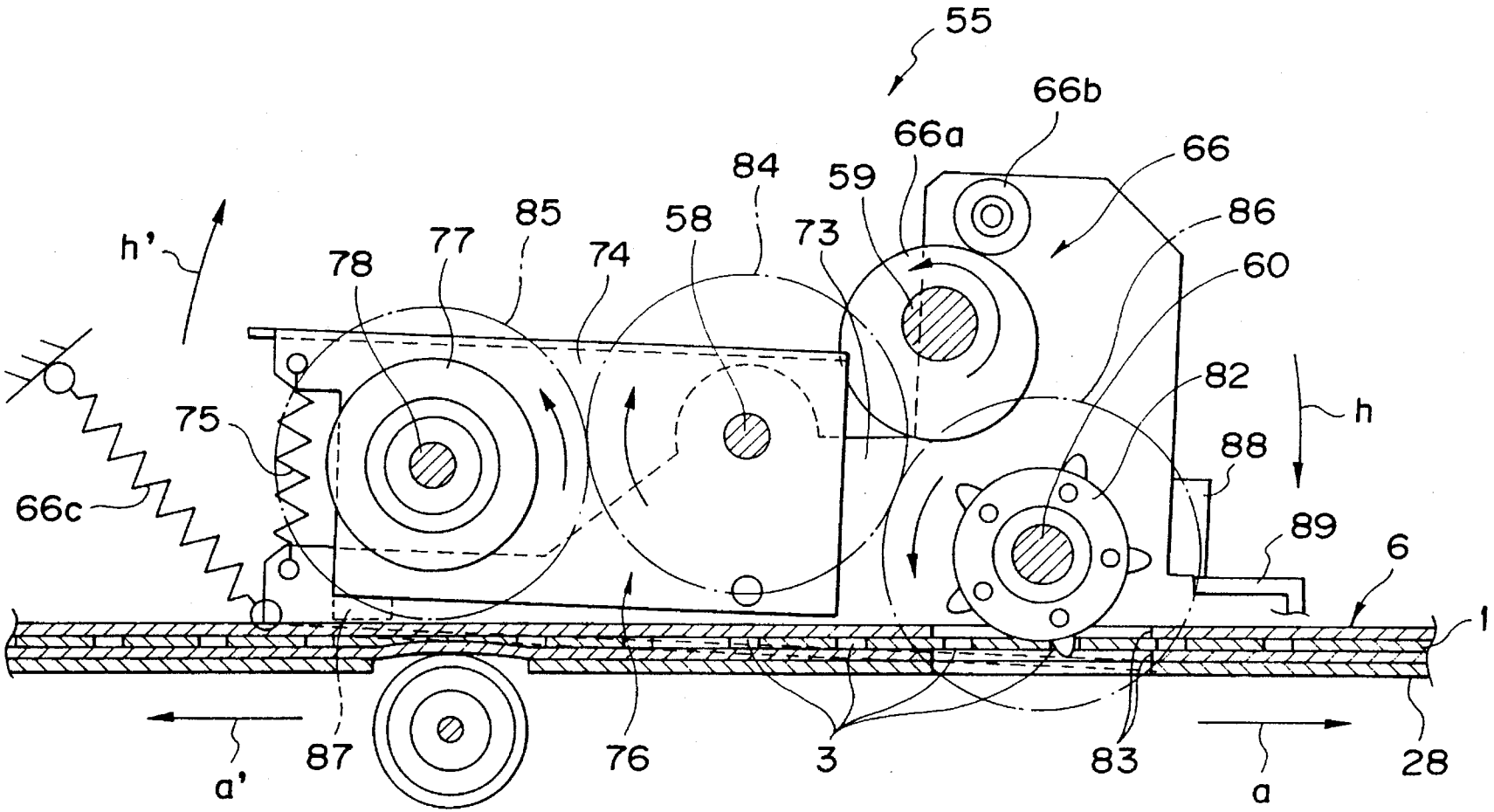
Figure 17:
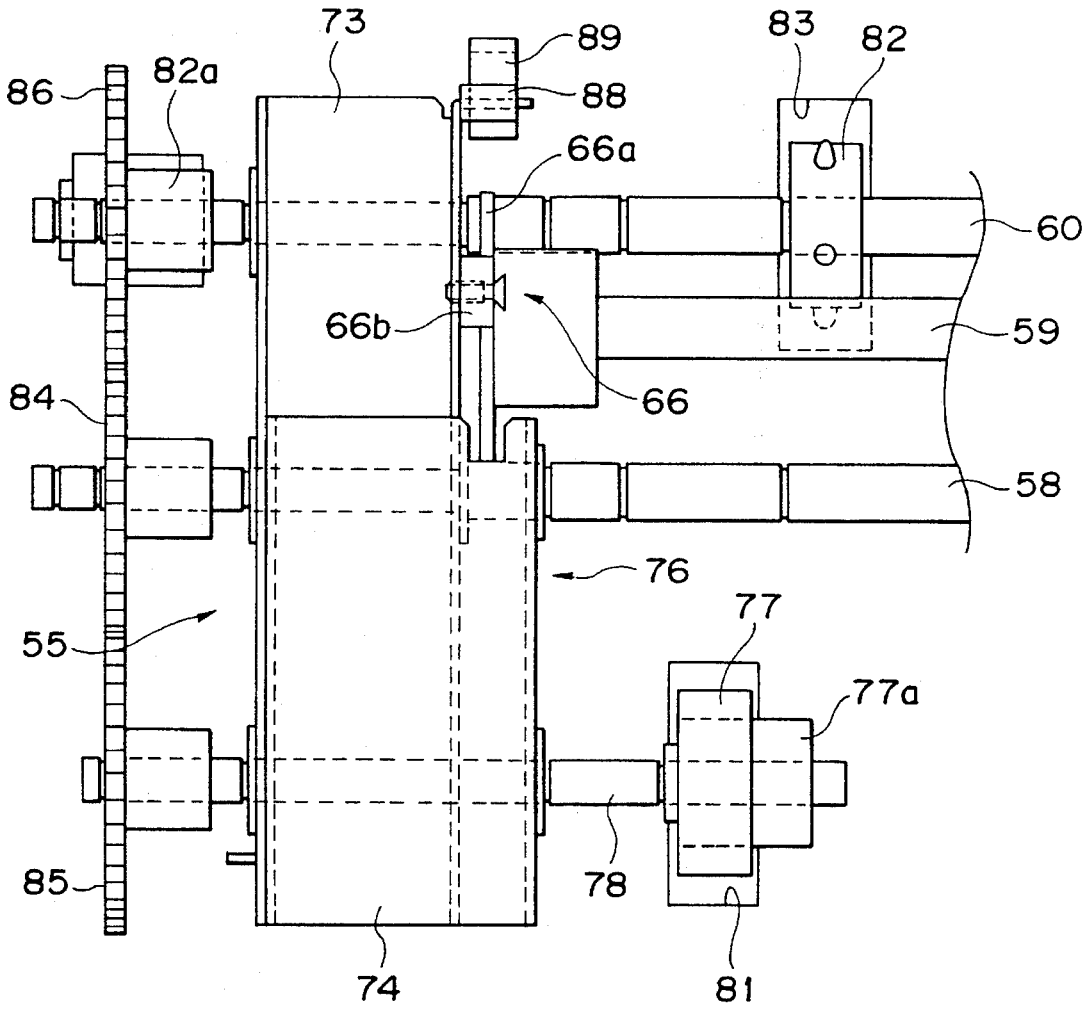
Figure 18:
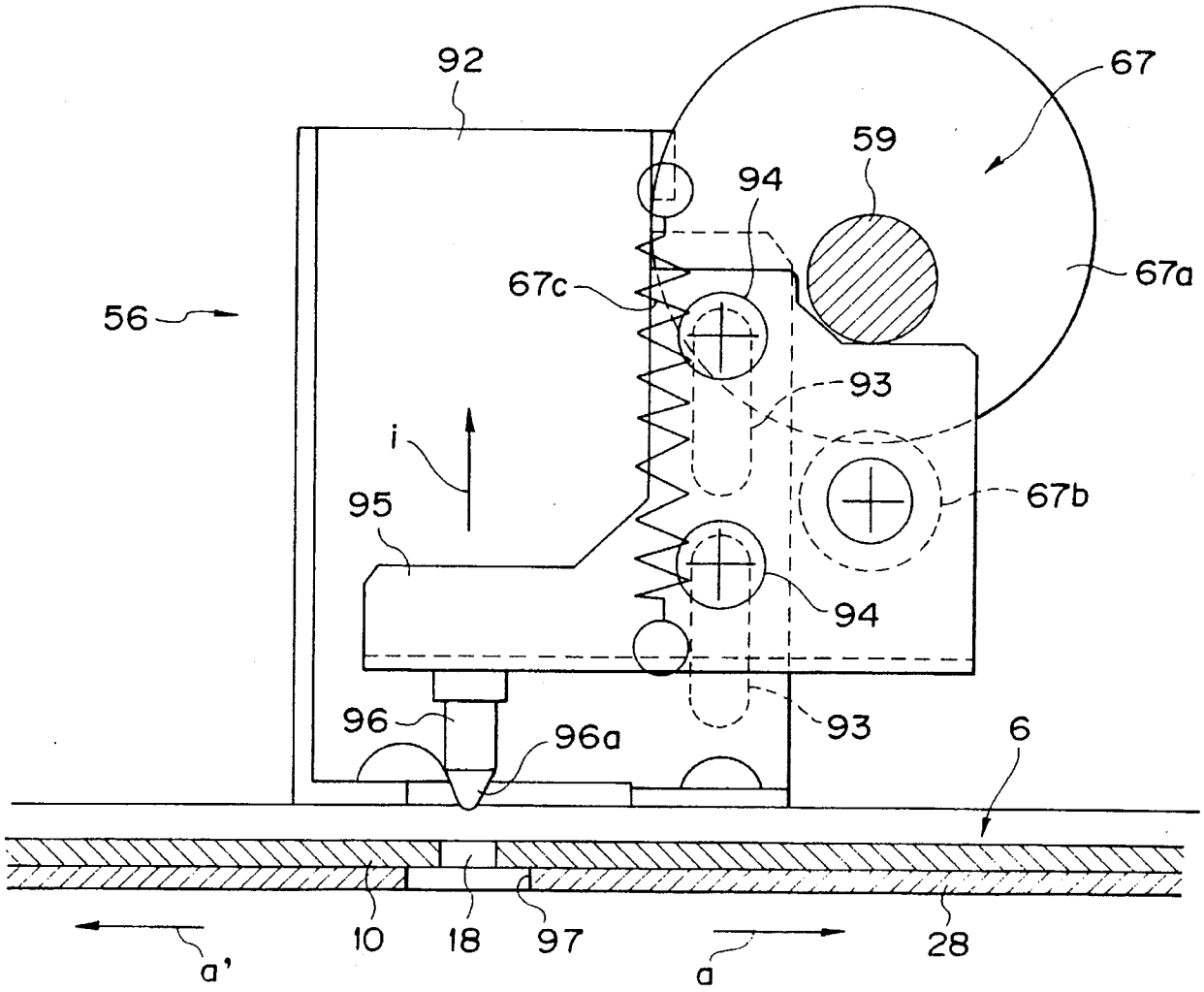
Figure 19:
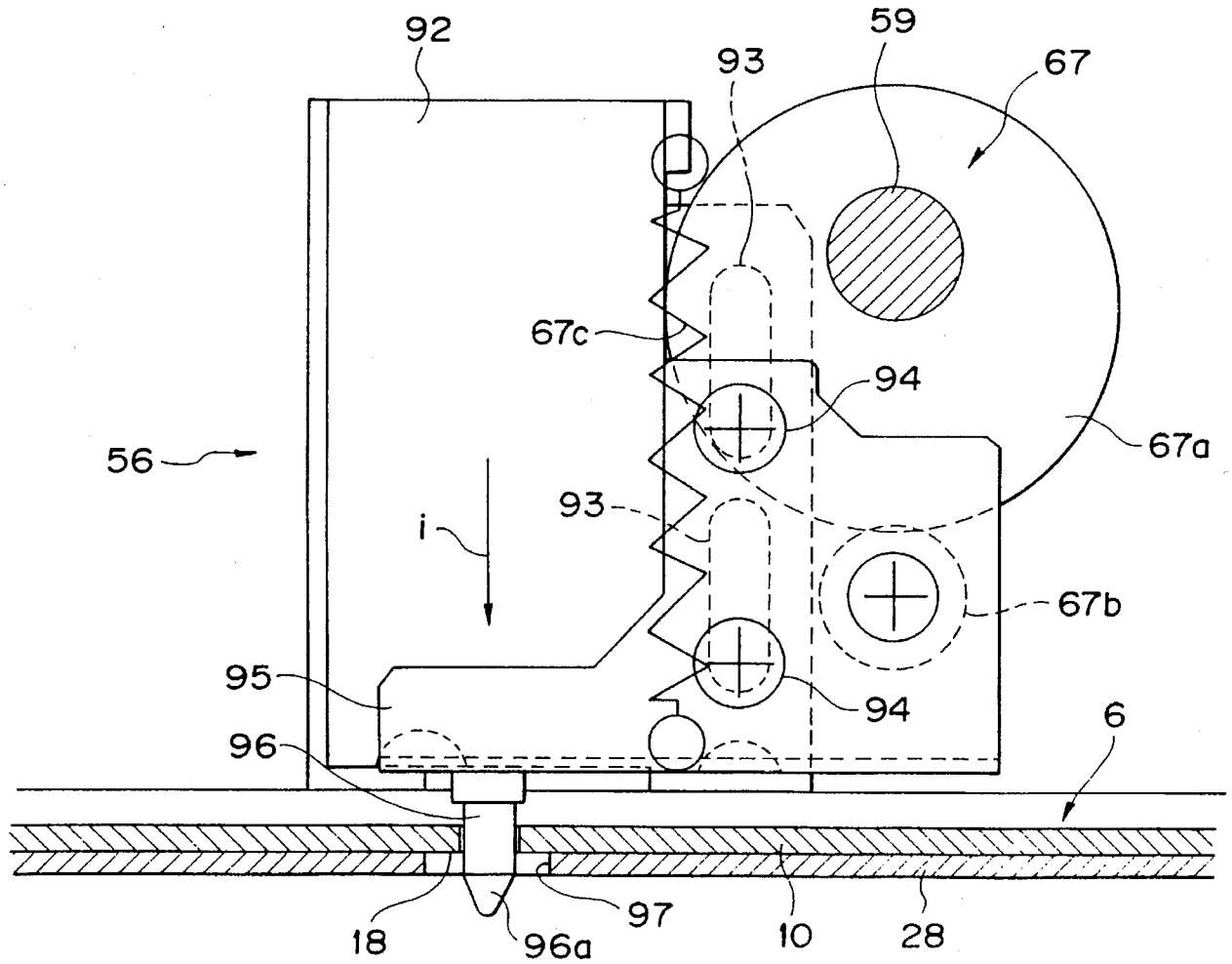
Figure 20:
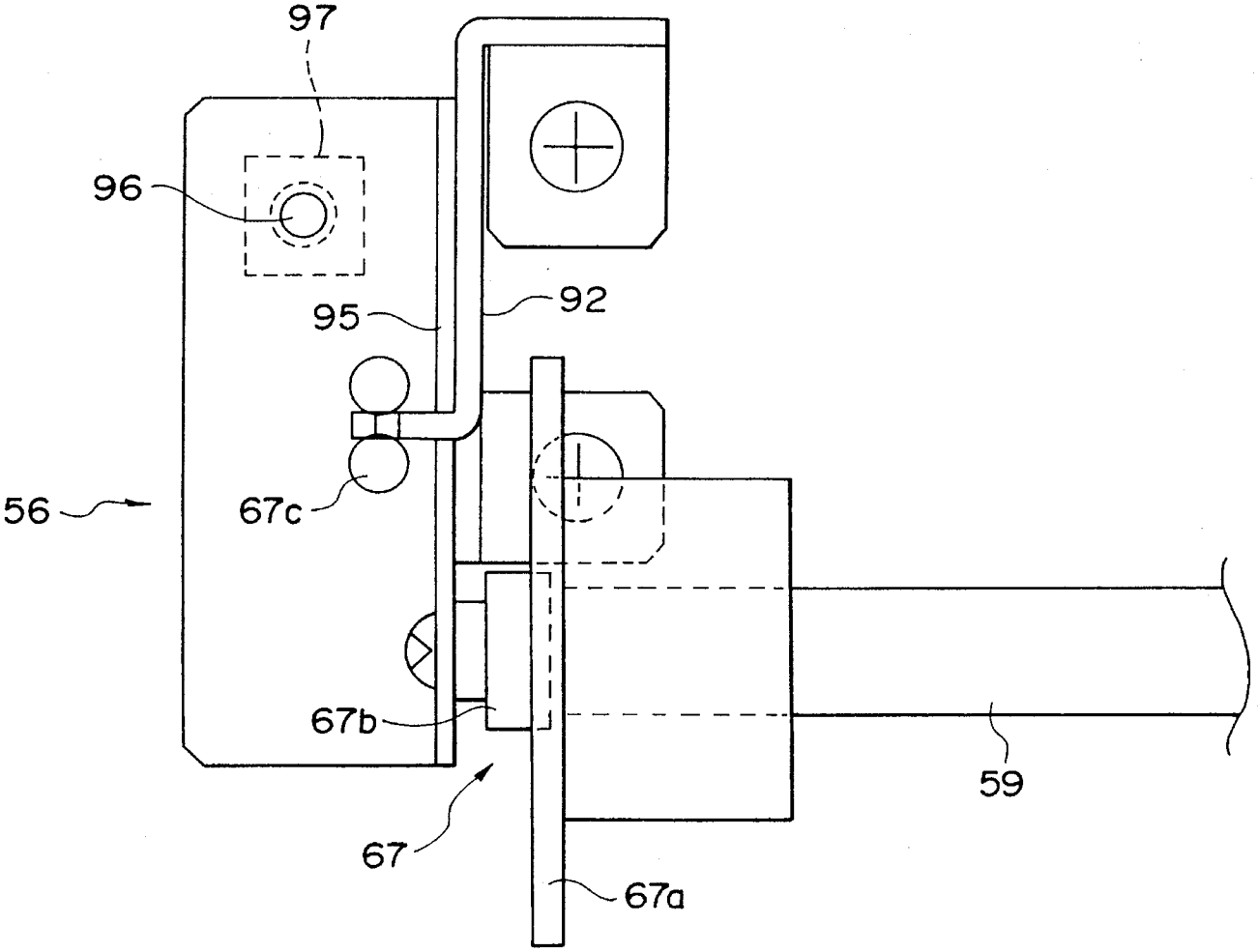
Figure 21:
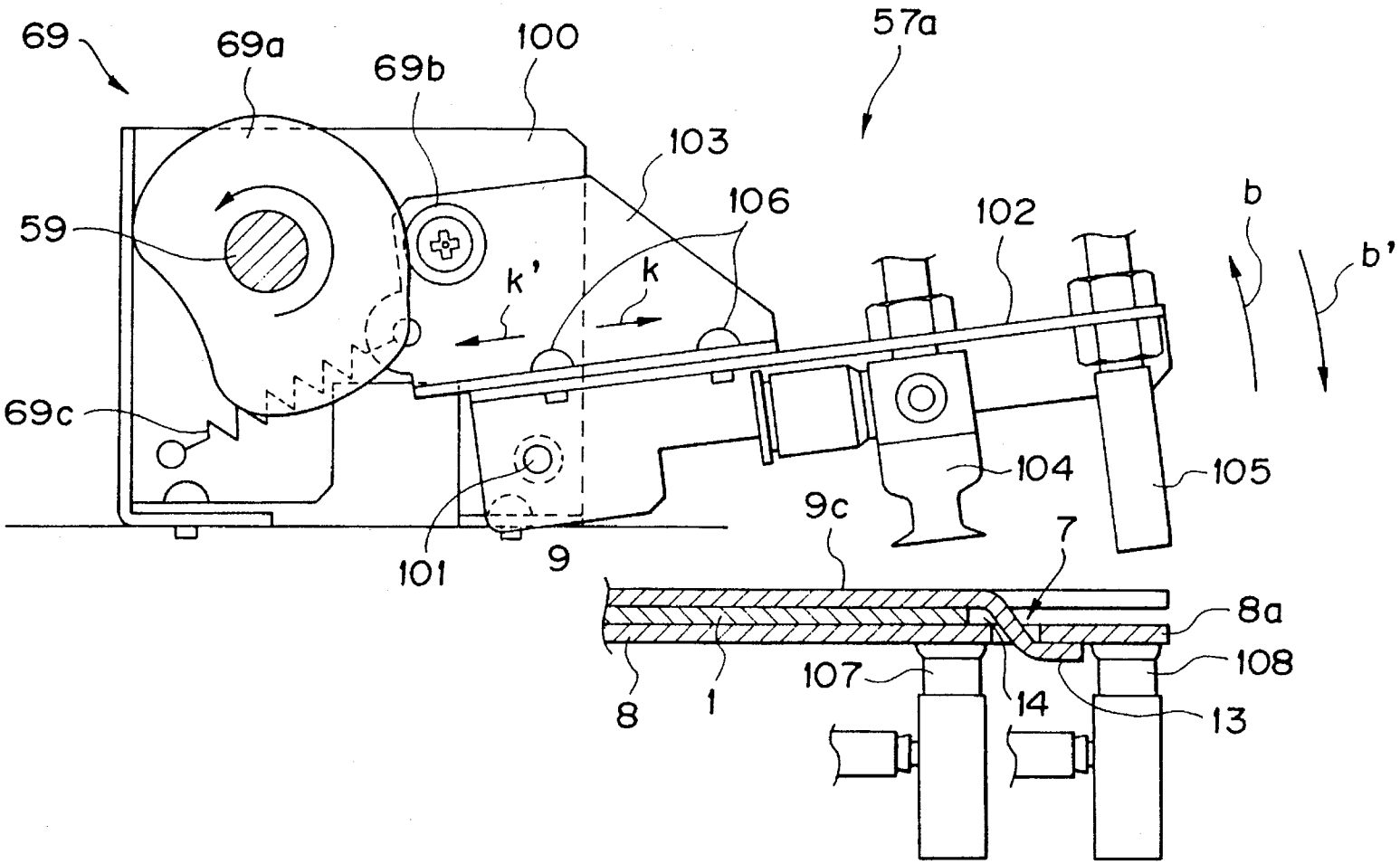
Figure 22:
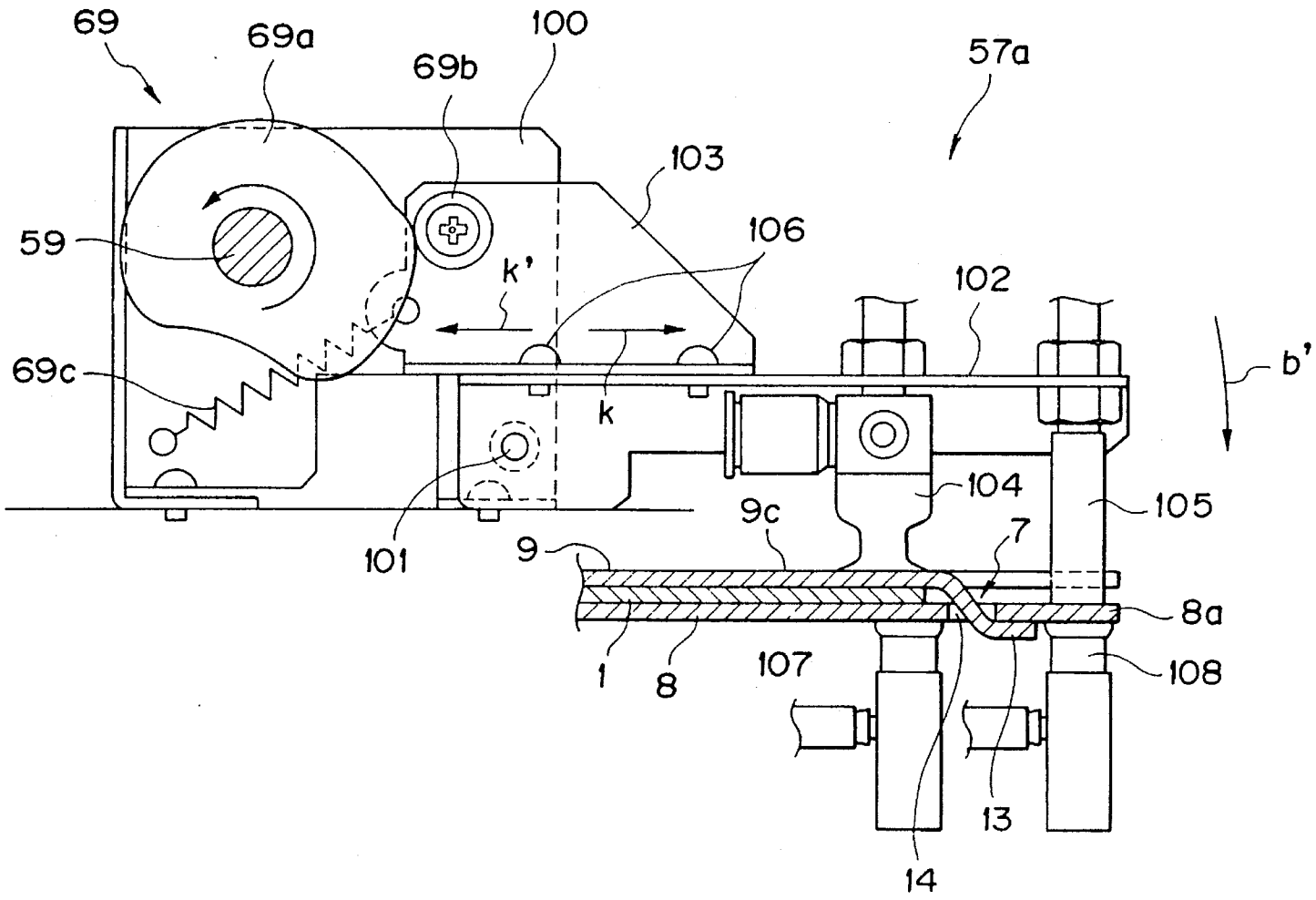
Figure 23:
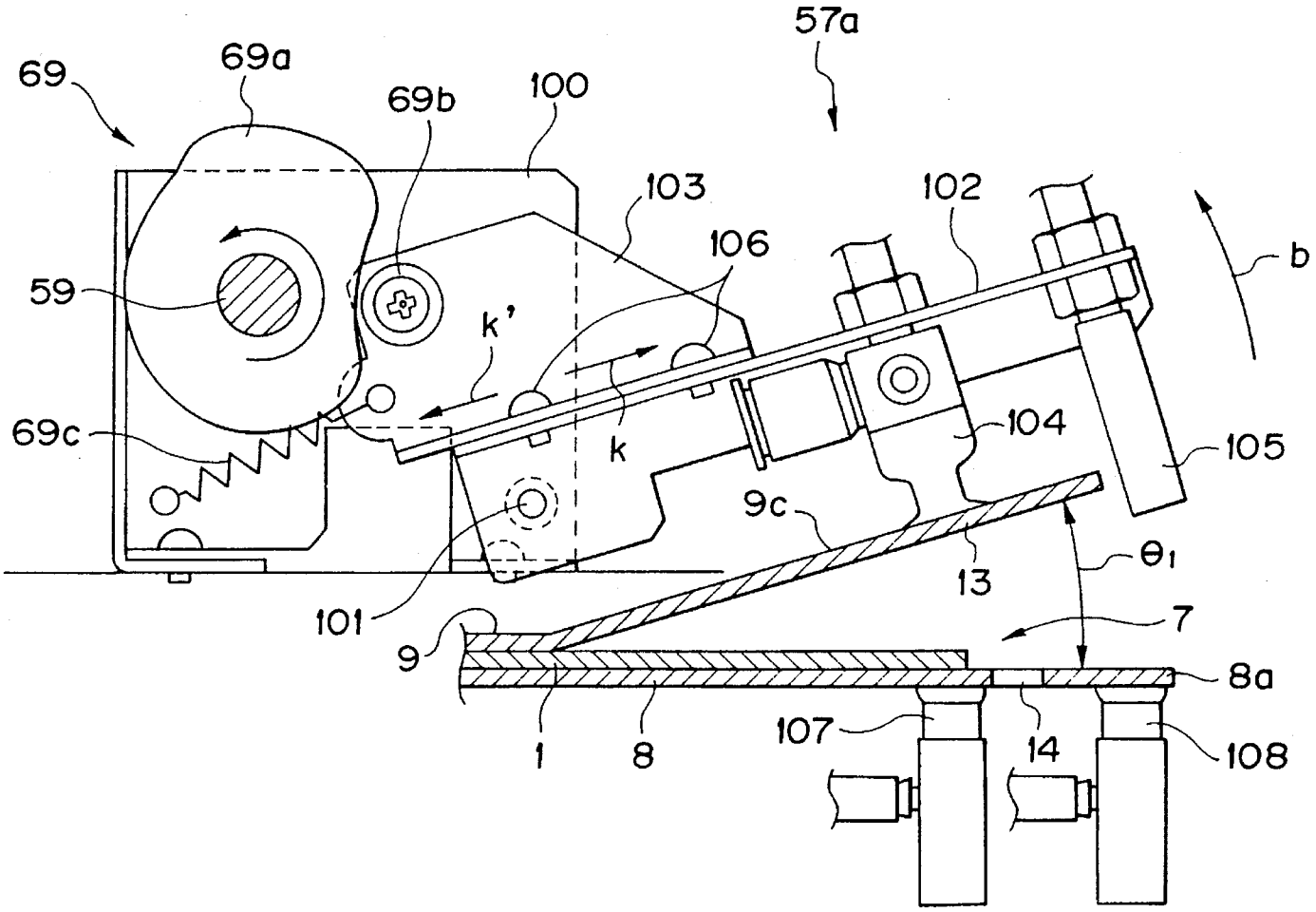
Figure 24:
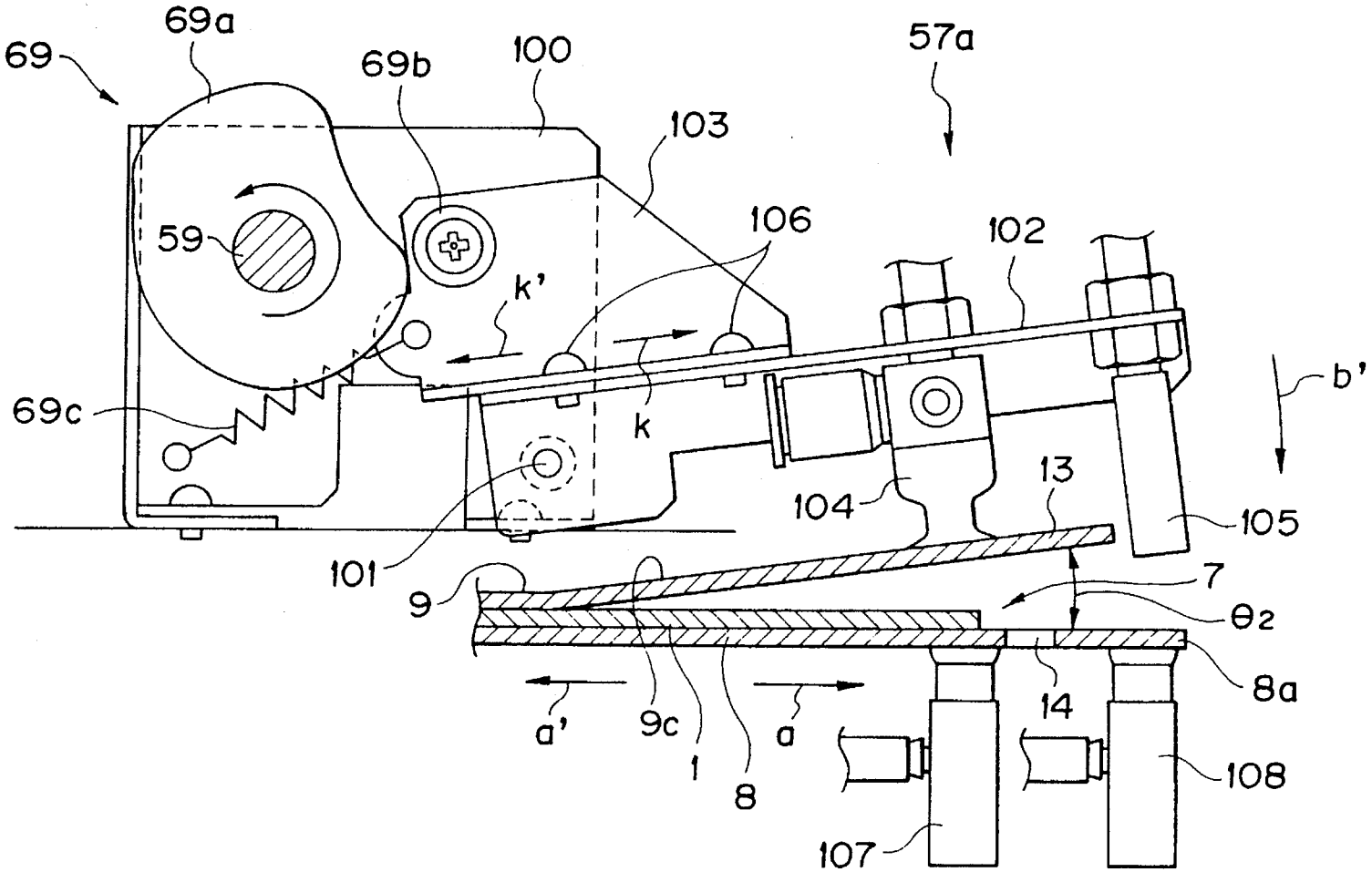
Figure 25:
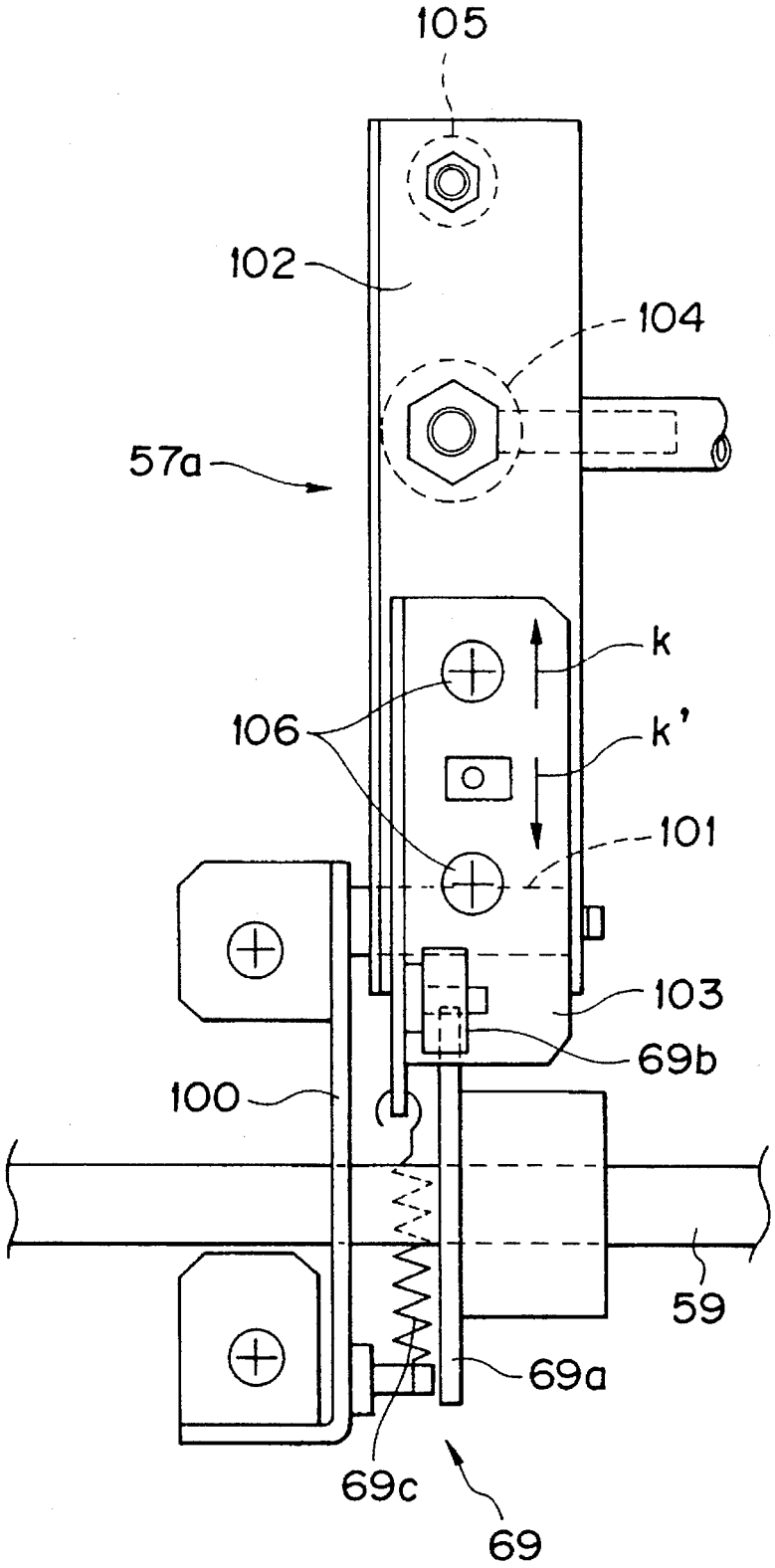
Figure 26:
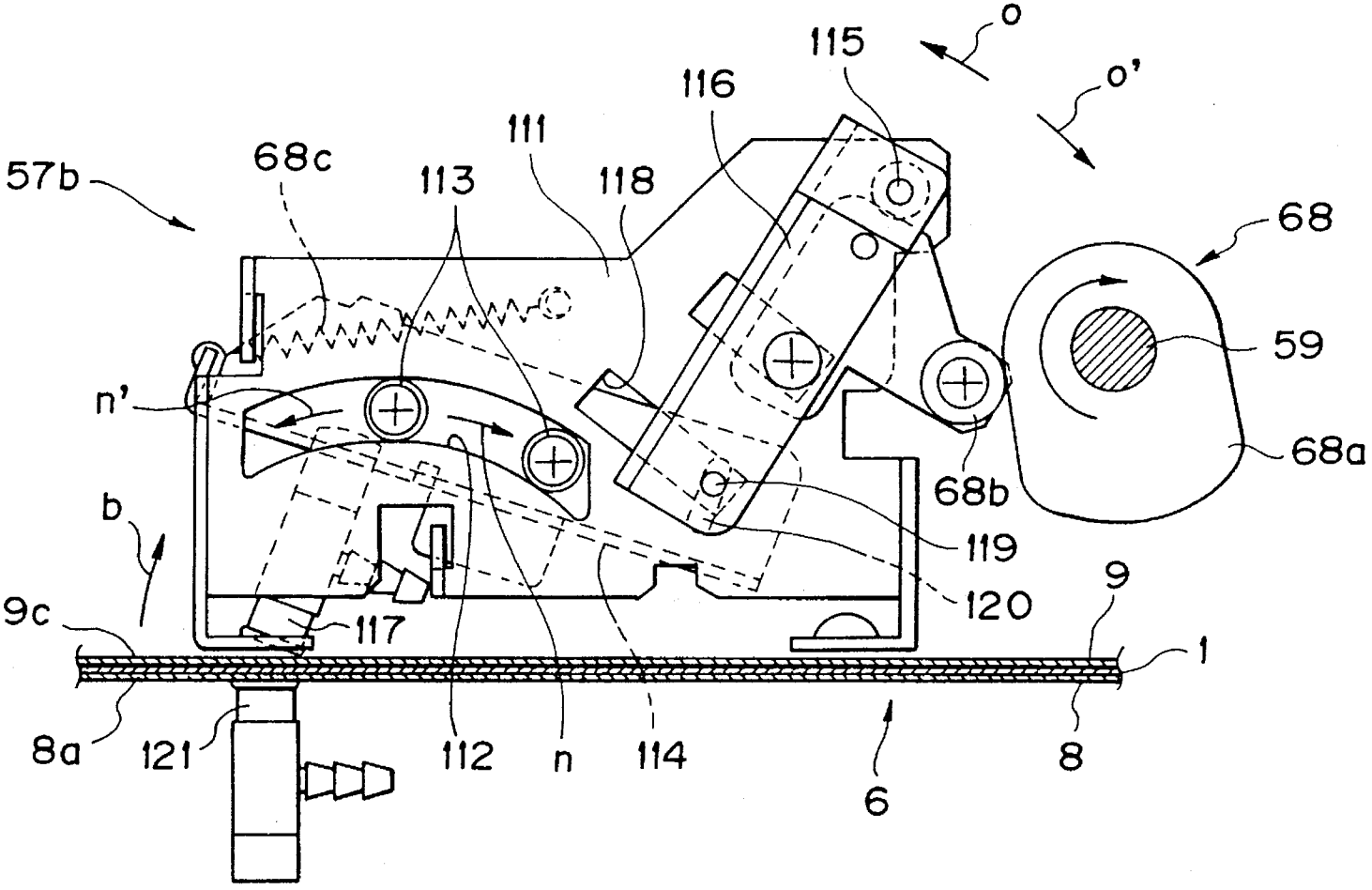
Figure 27:
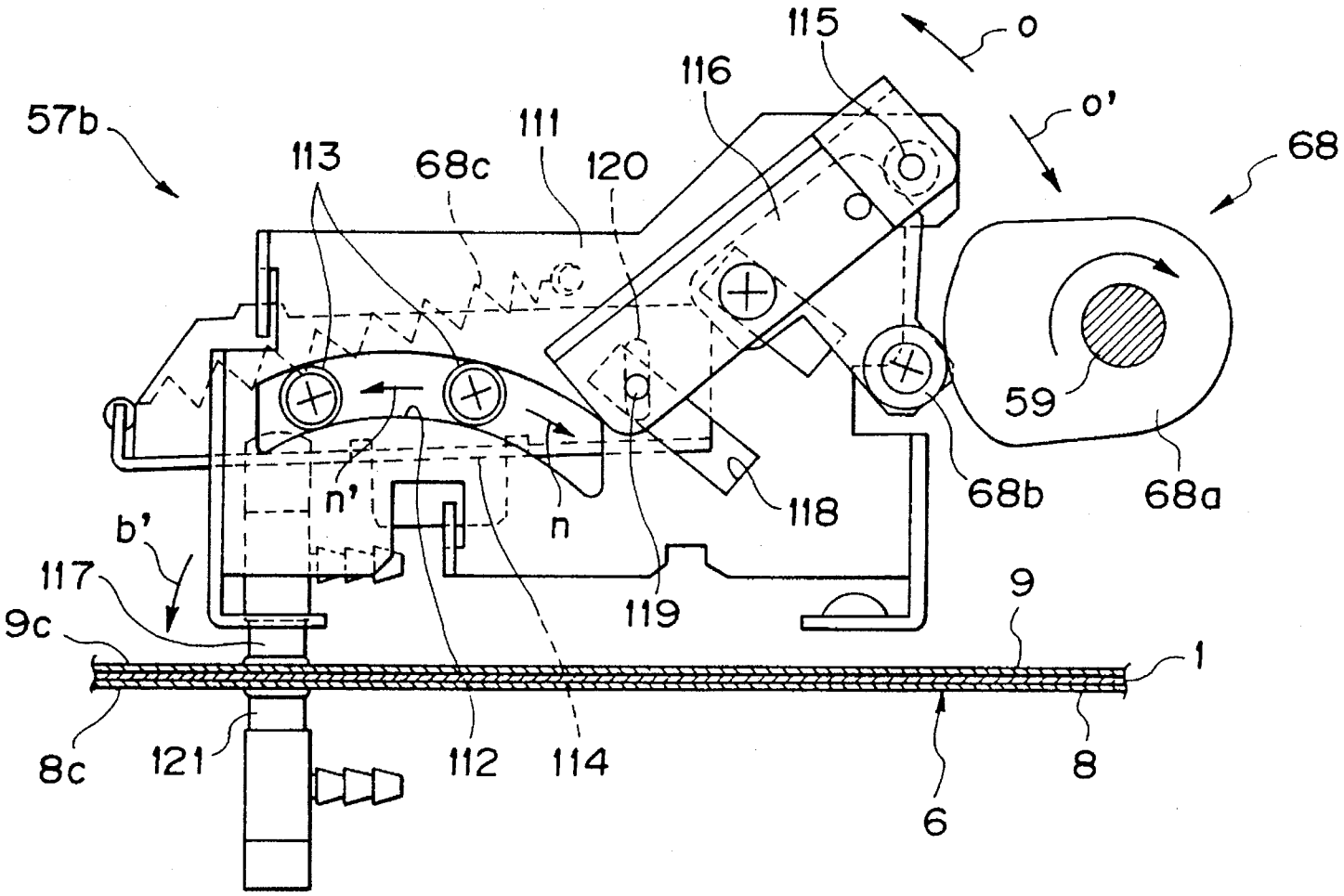
Figure 28:
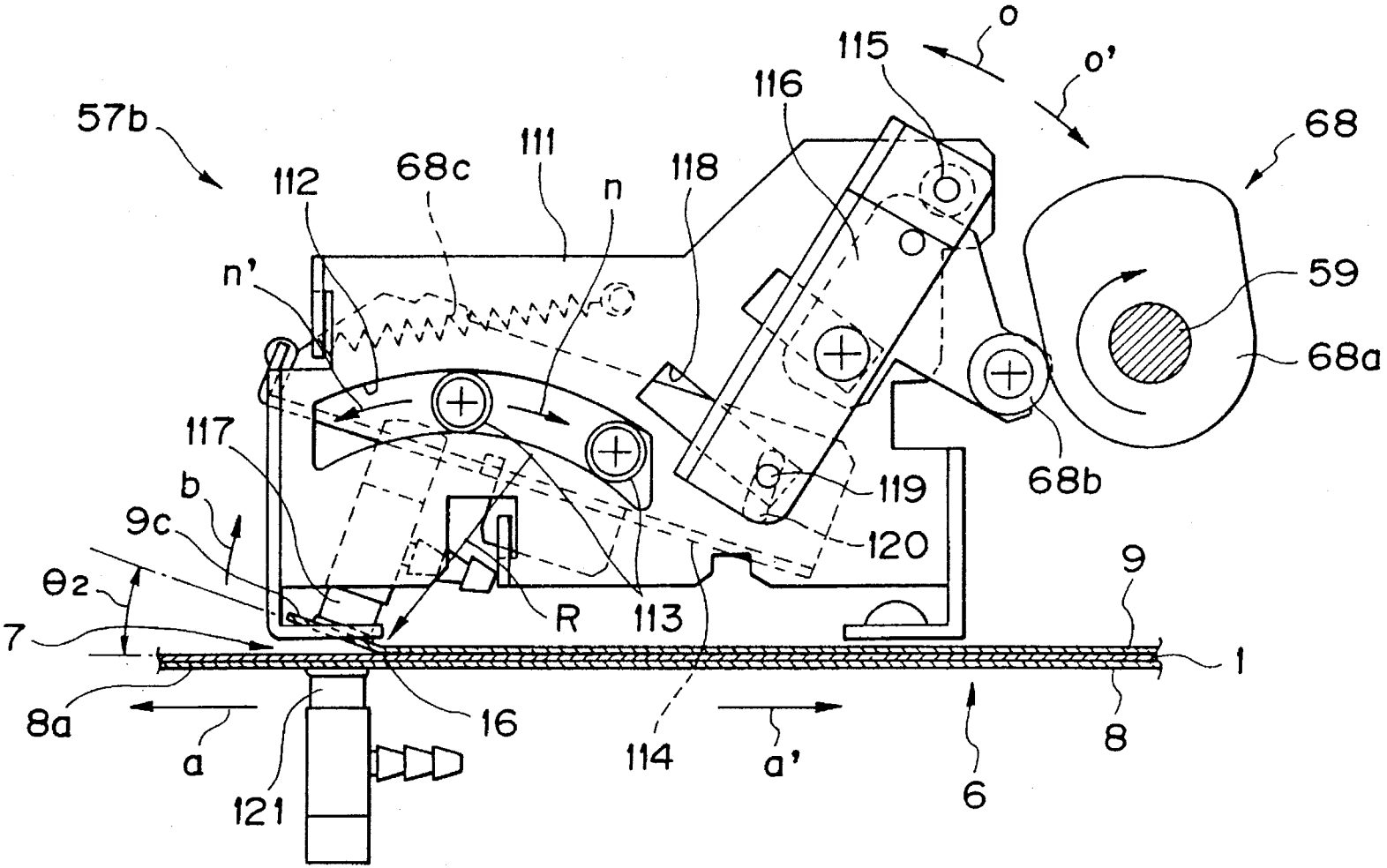
Figure 29:
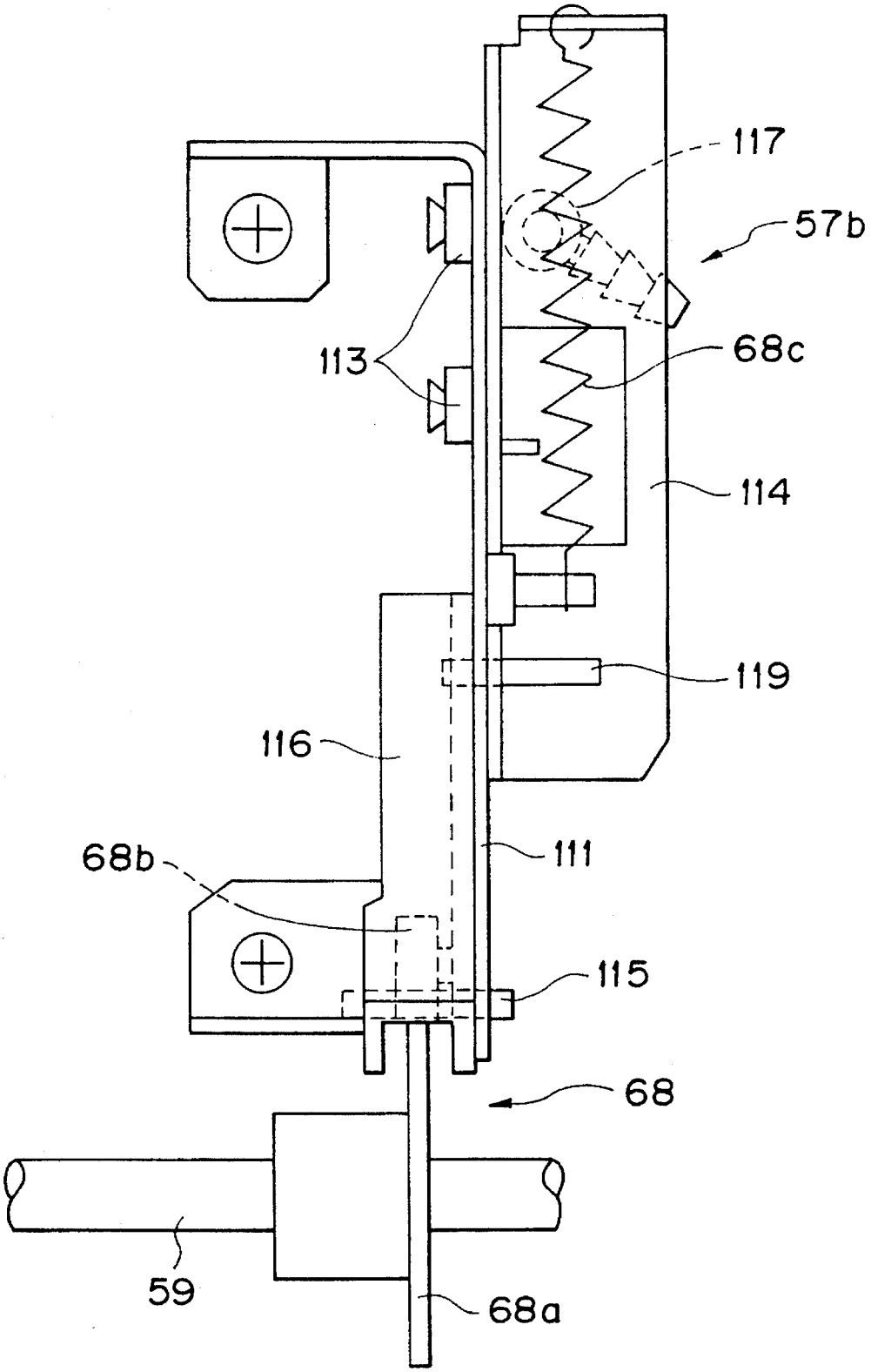
Figure 30:
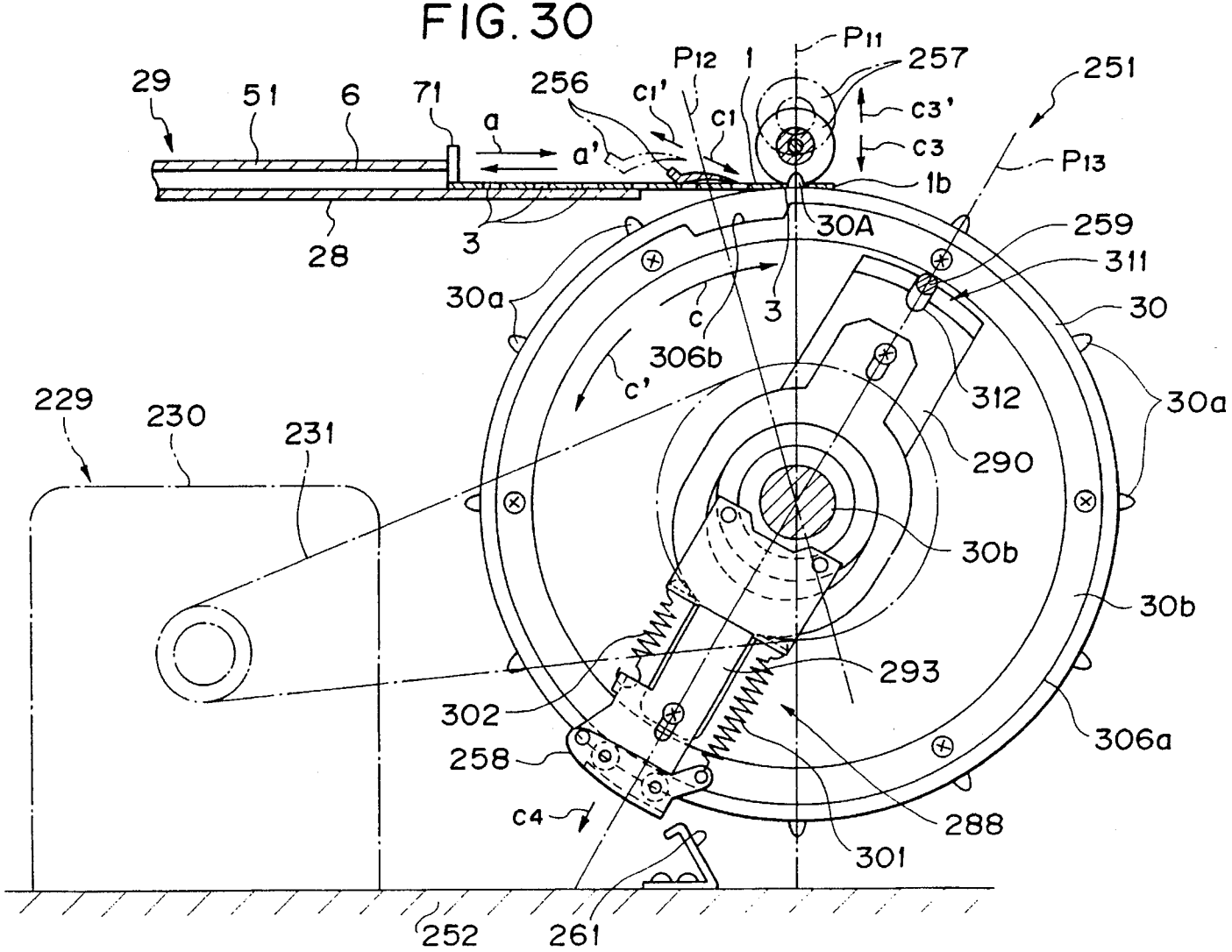
Figure 31:
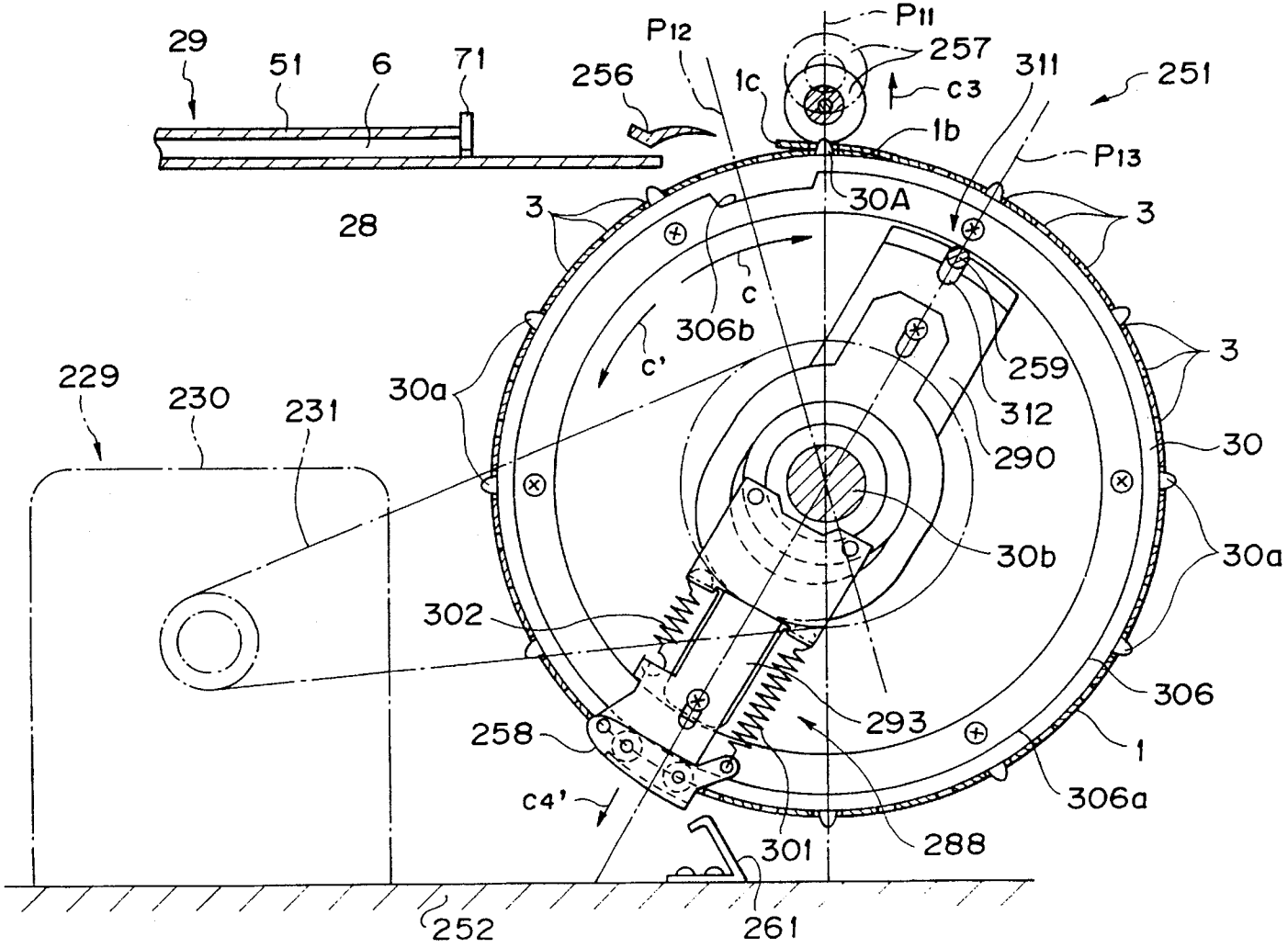
Figure 32:
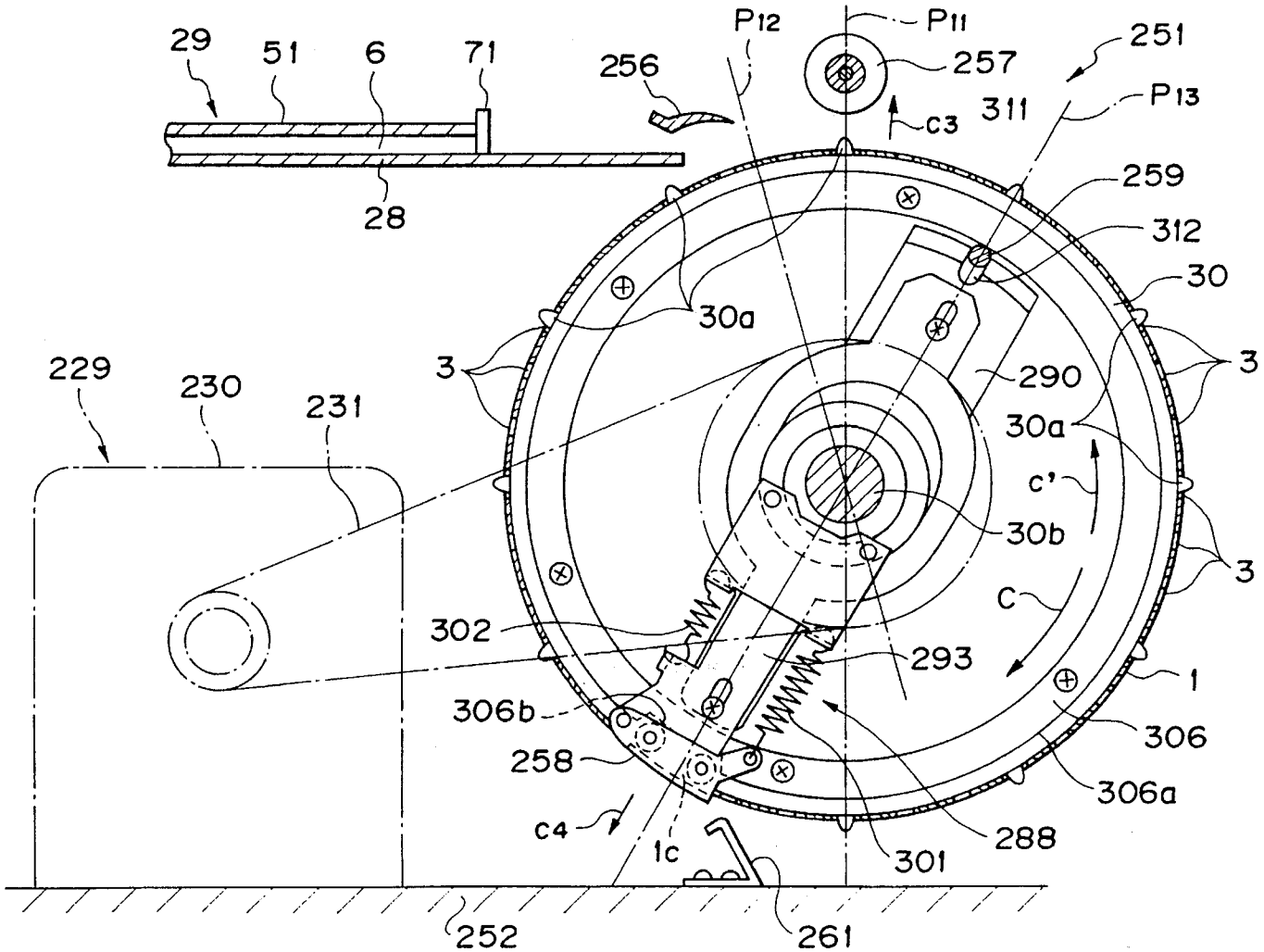
Figure 33:
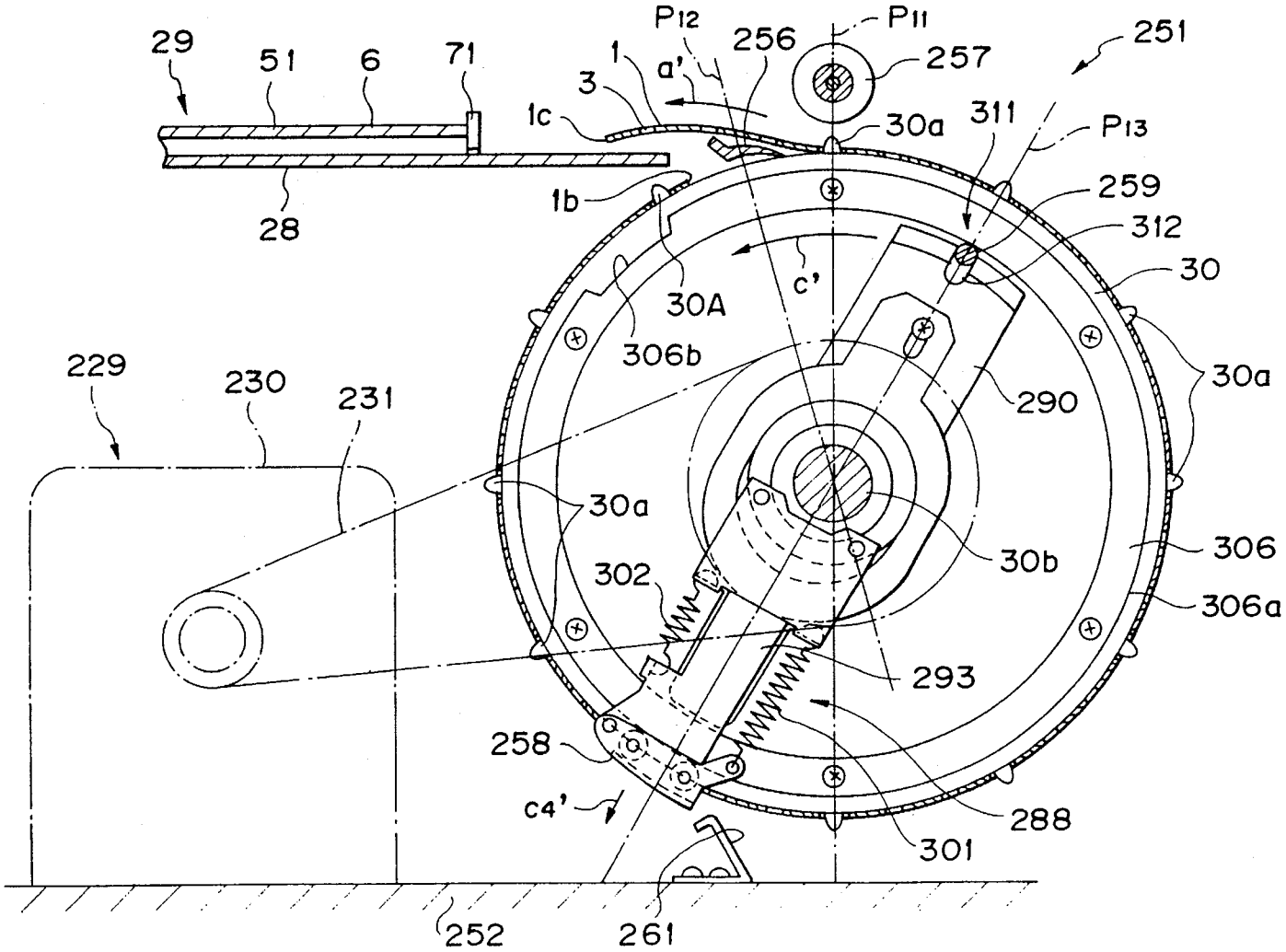
Figures 34A, 34B:
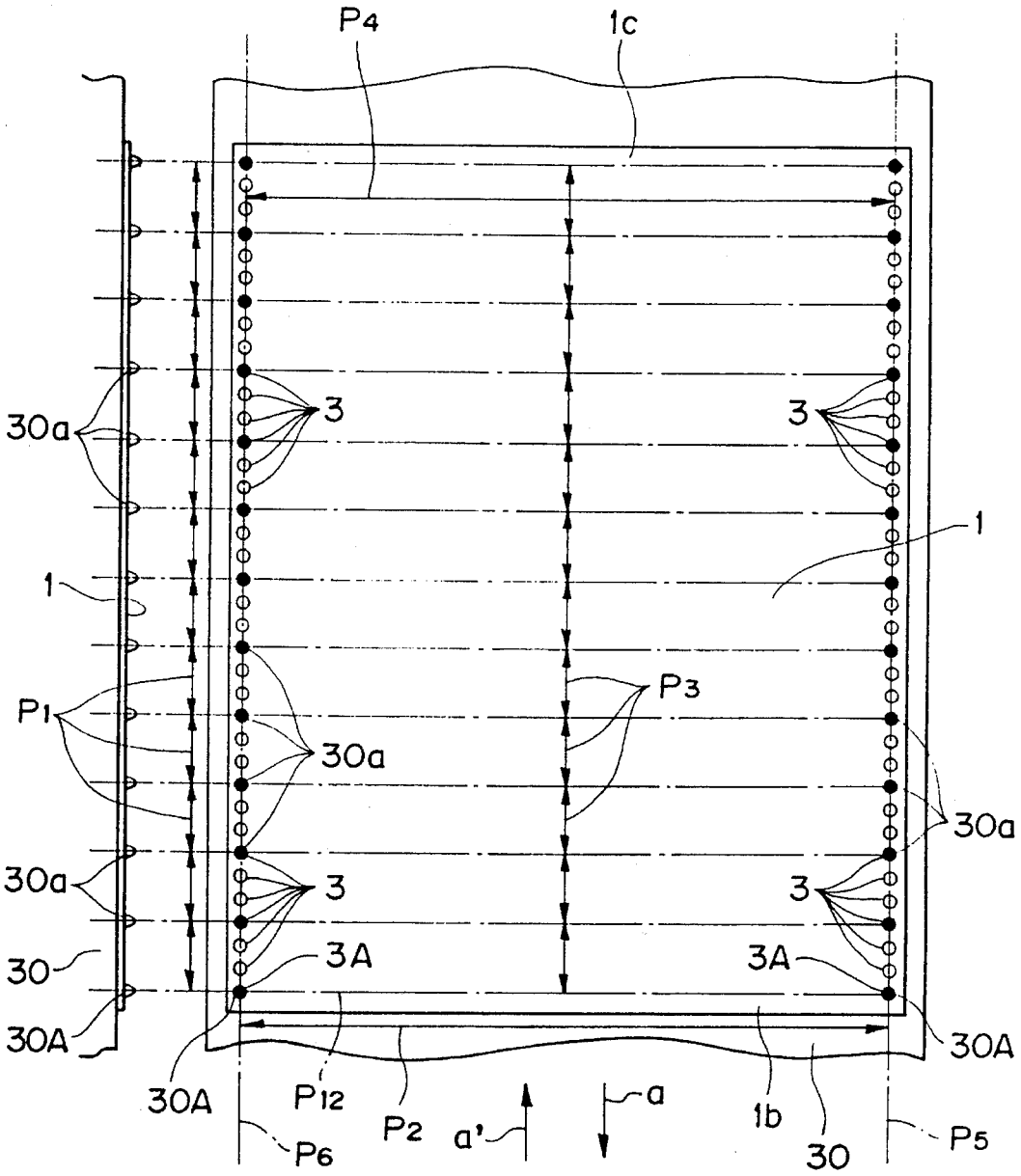
Figures 35A, 35B:
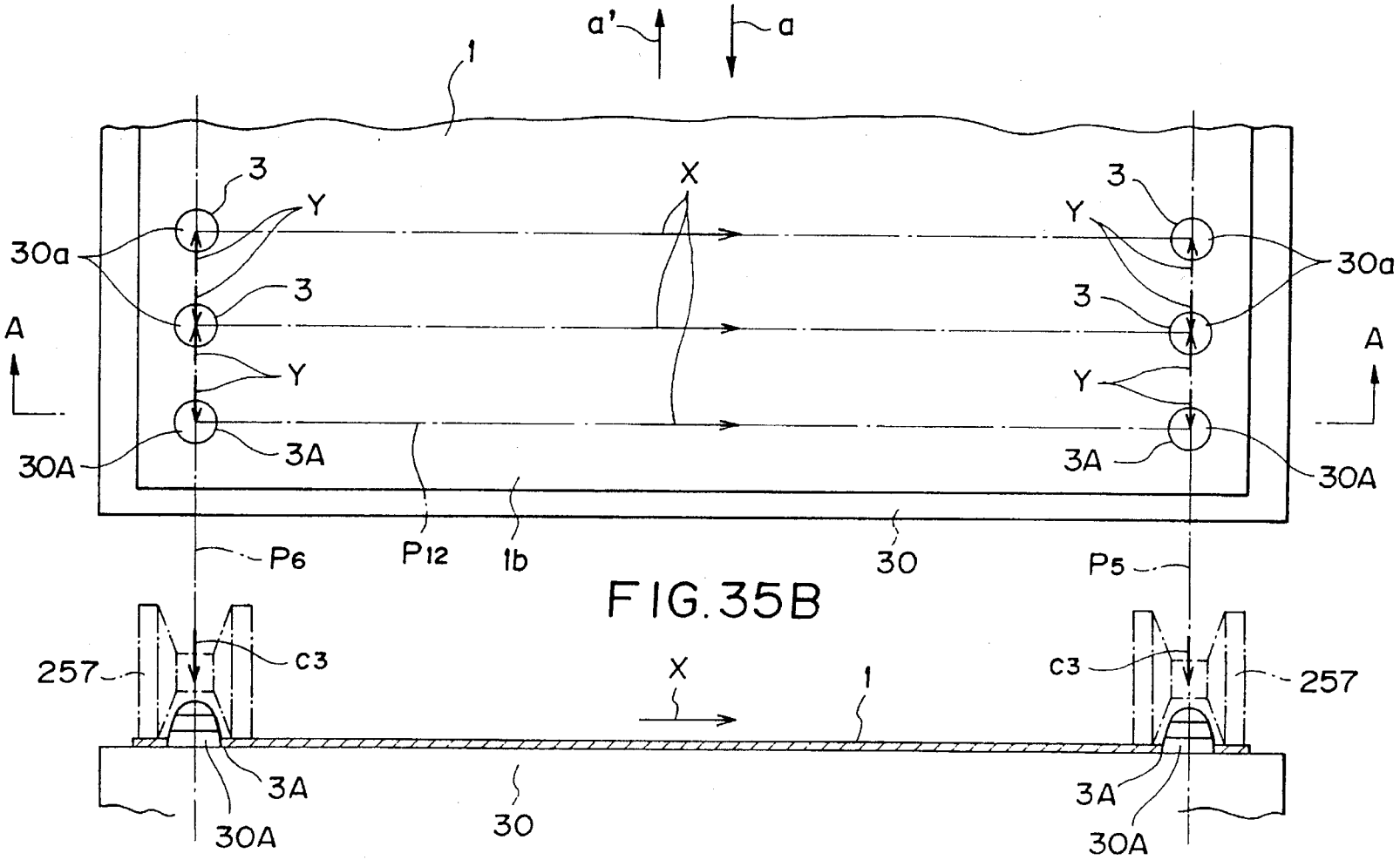
Figure 36A:
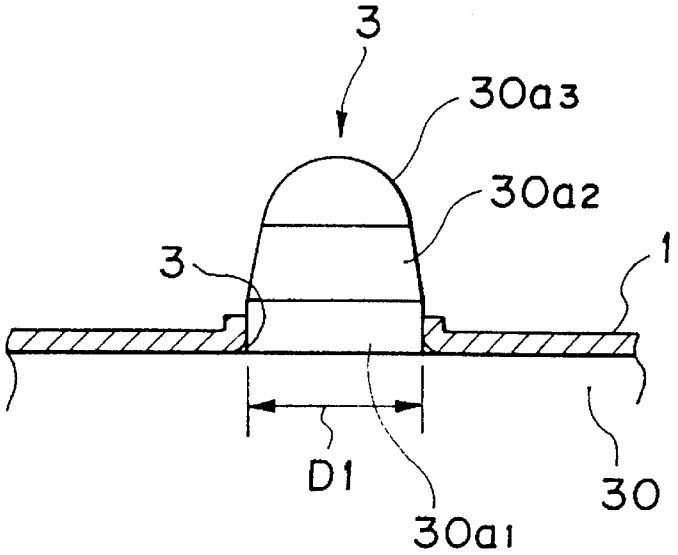
Figure 36B:
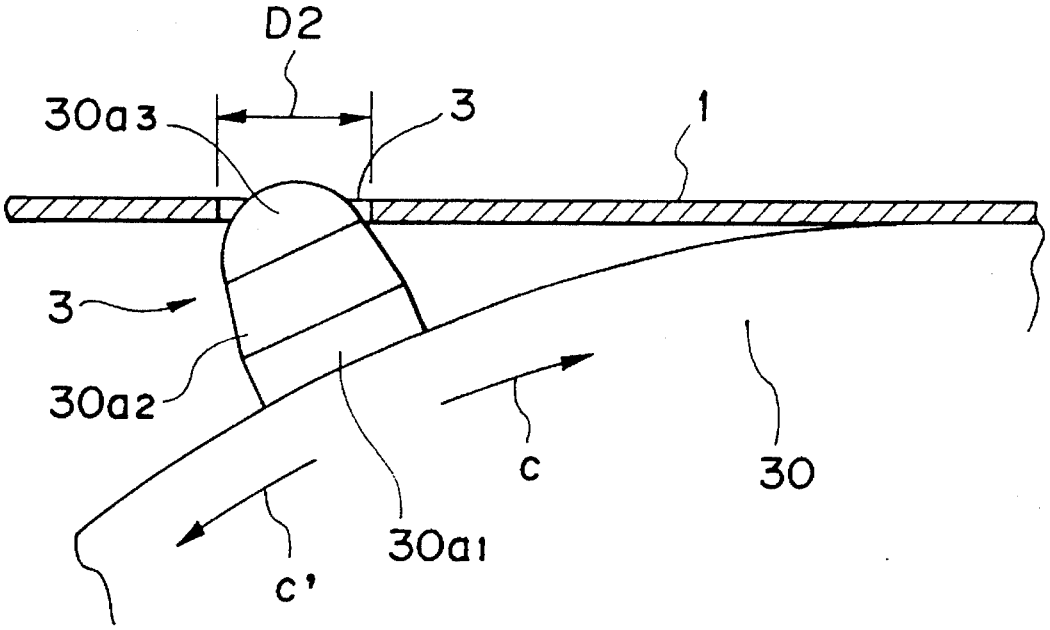
Figure 37:
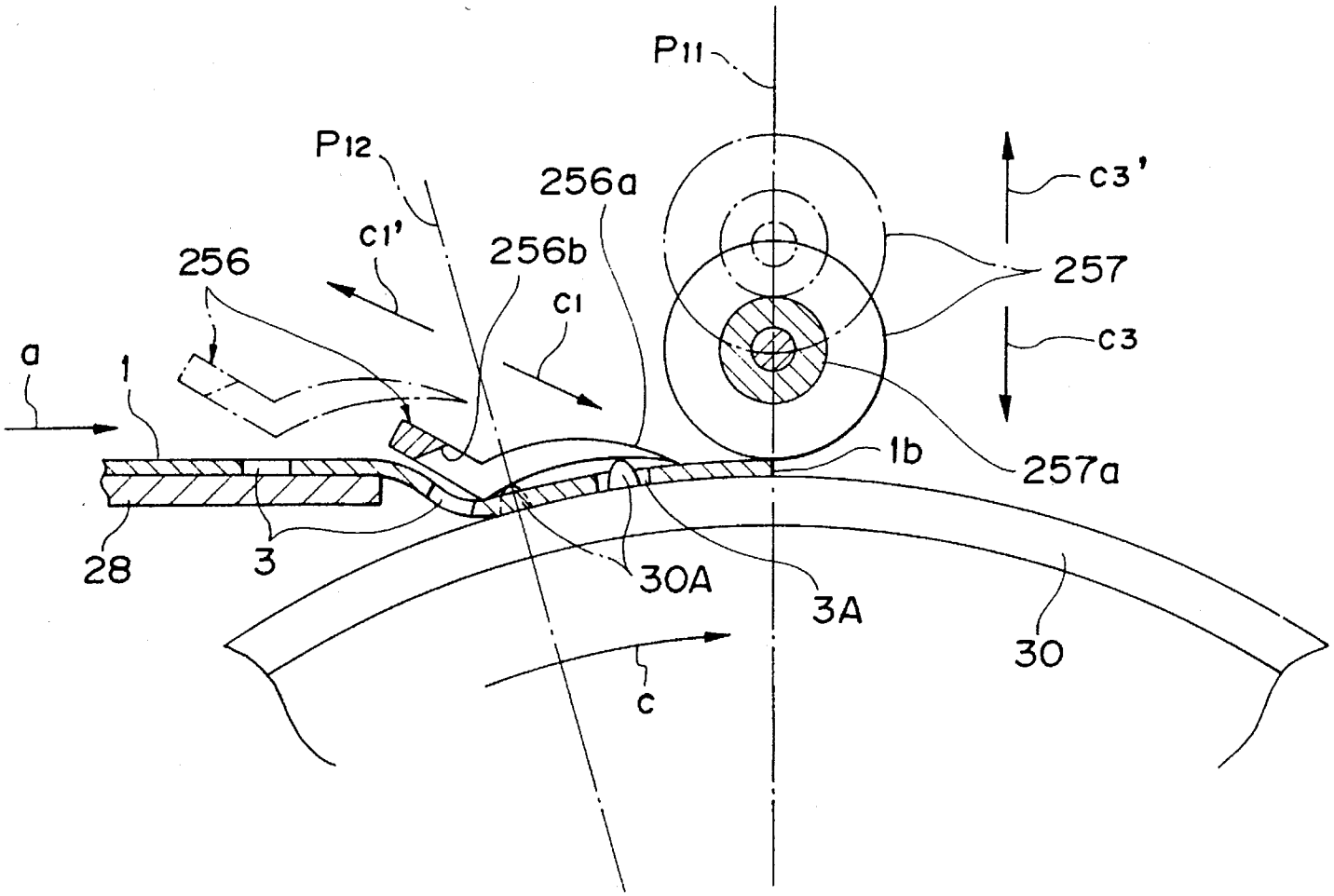
Figure 38:
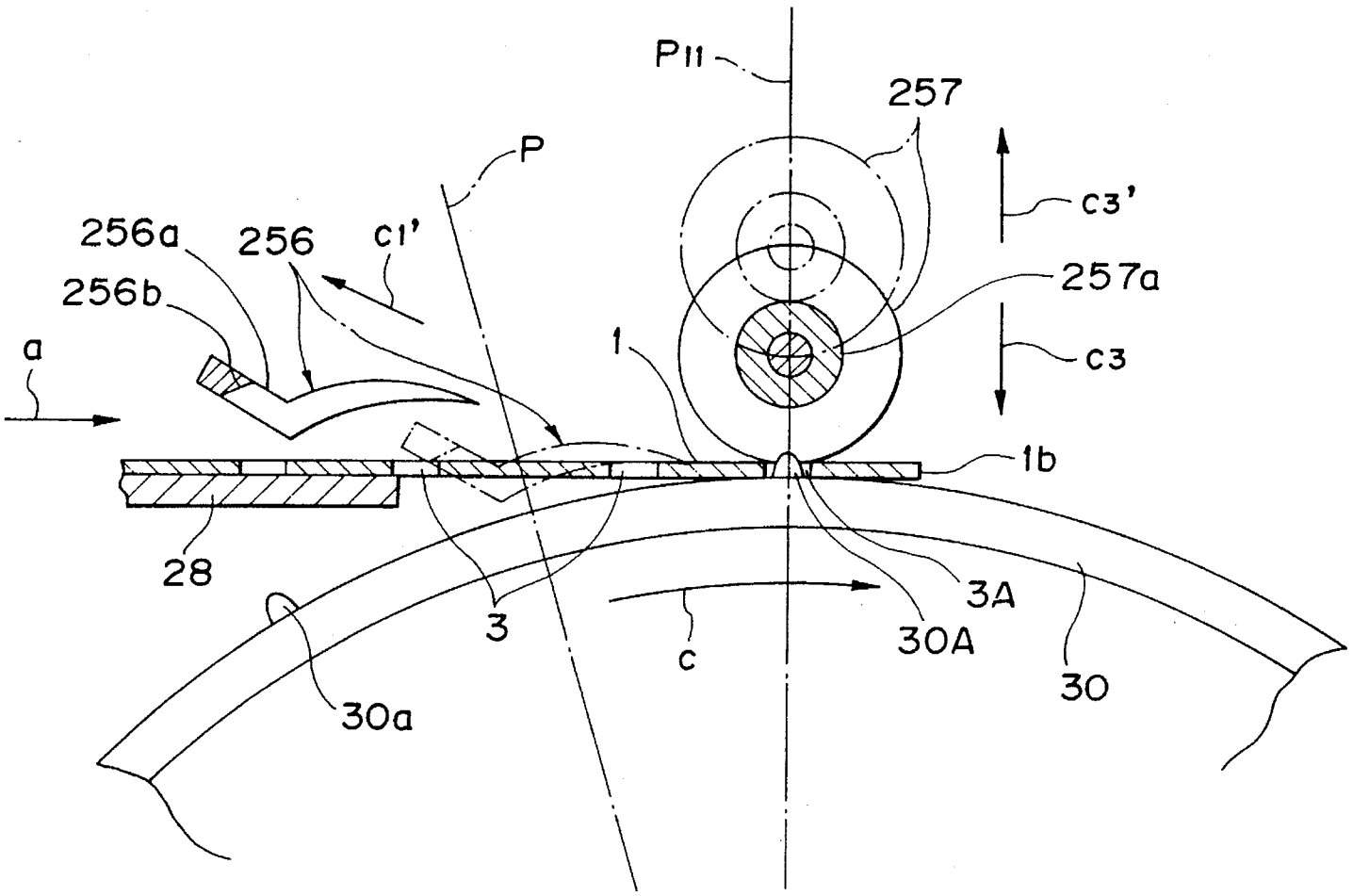
Figure 39:
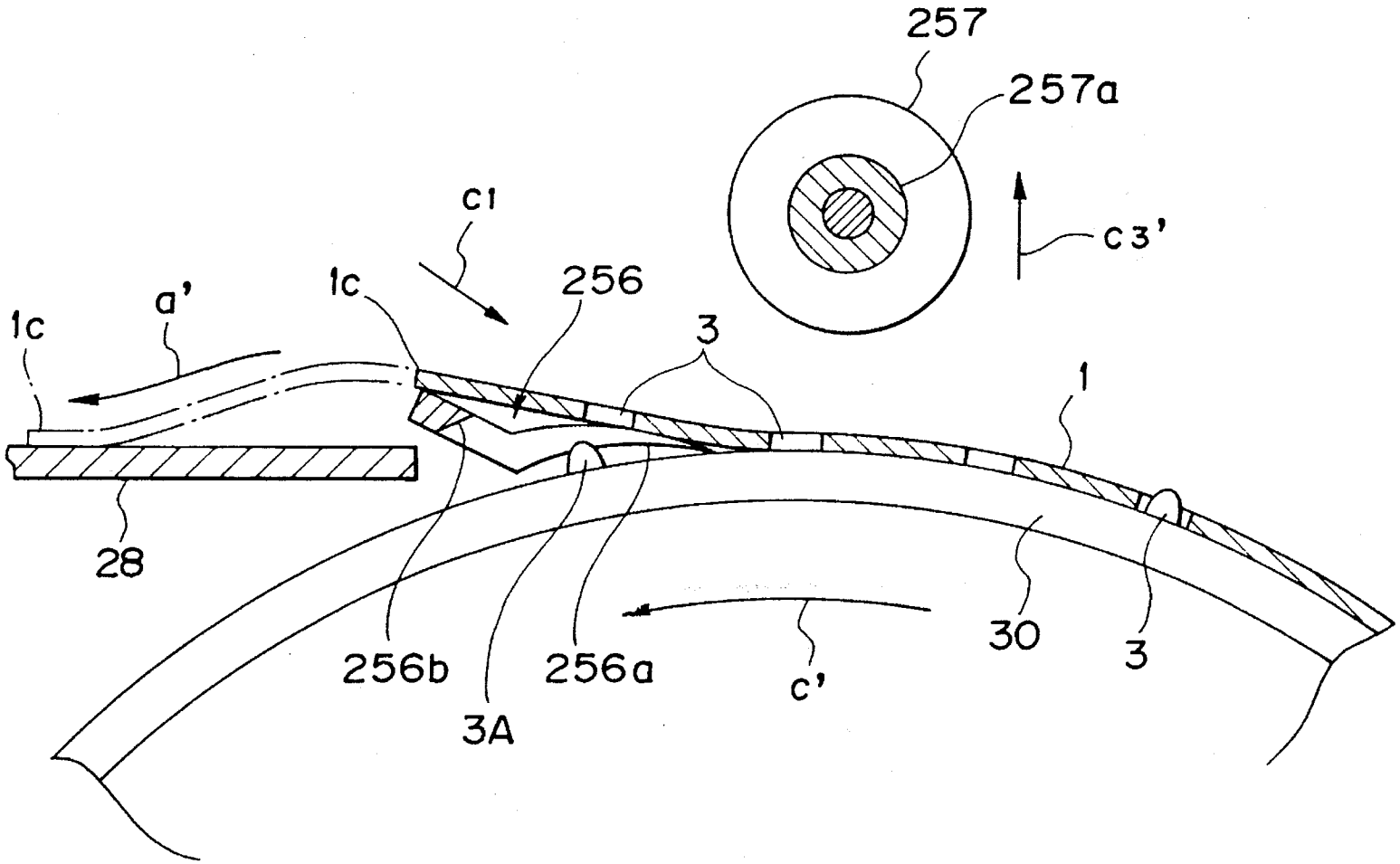
Figure 40:
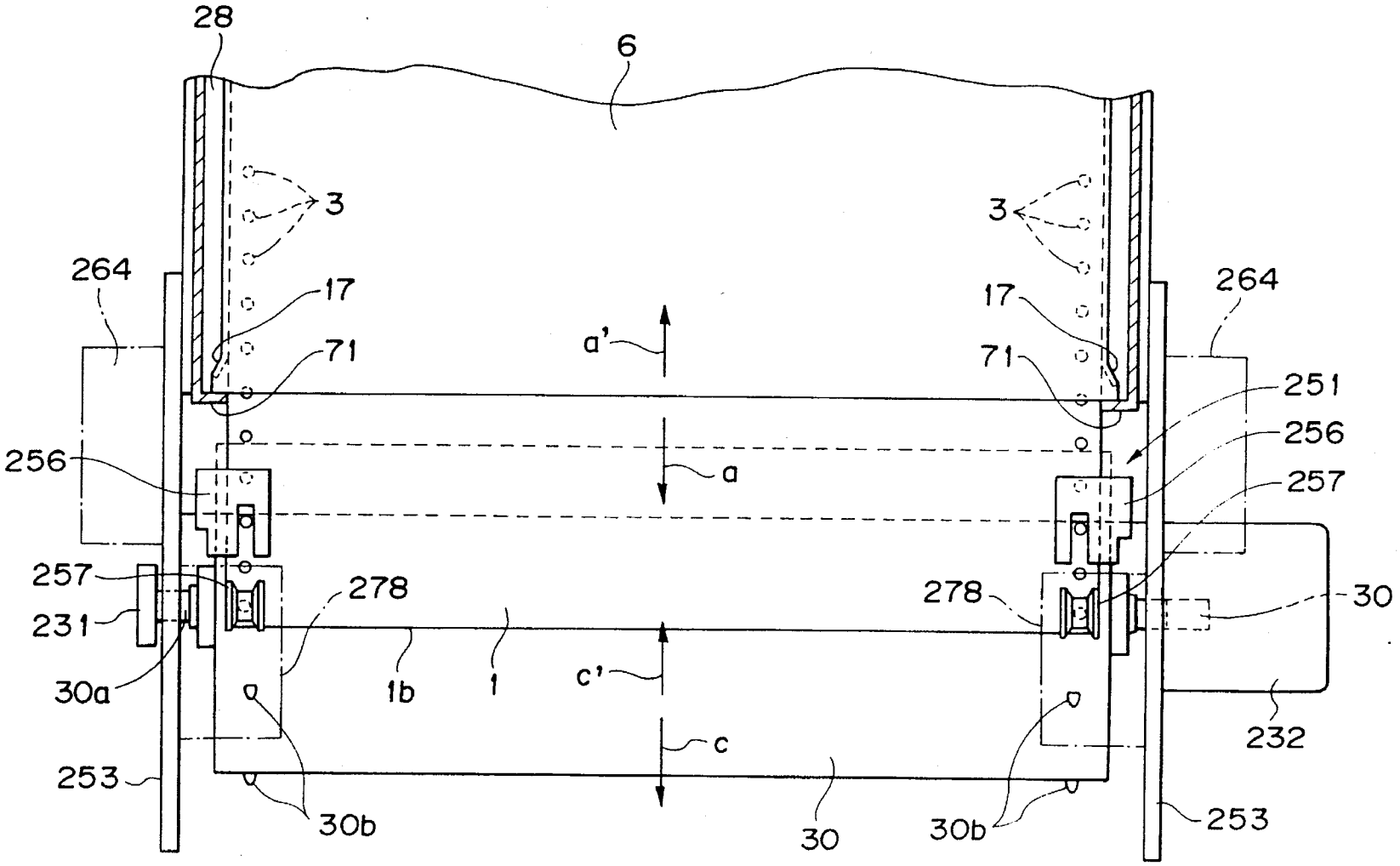
Figure 41:
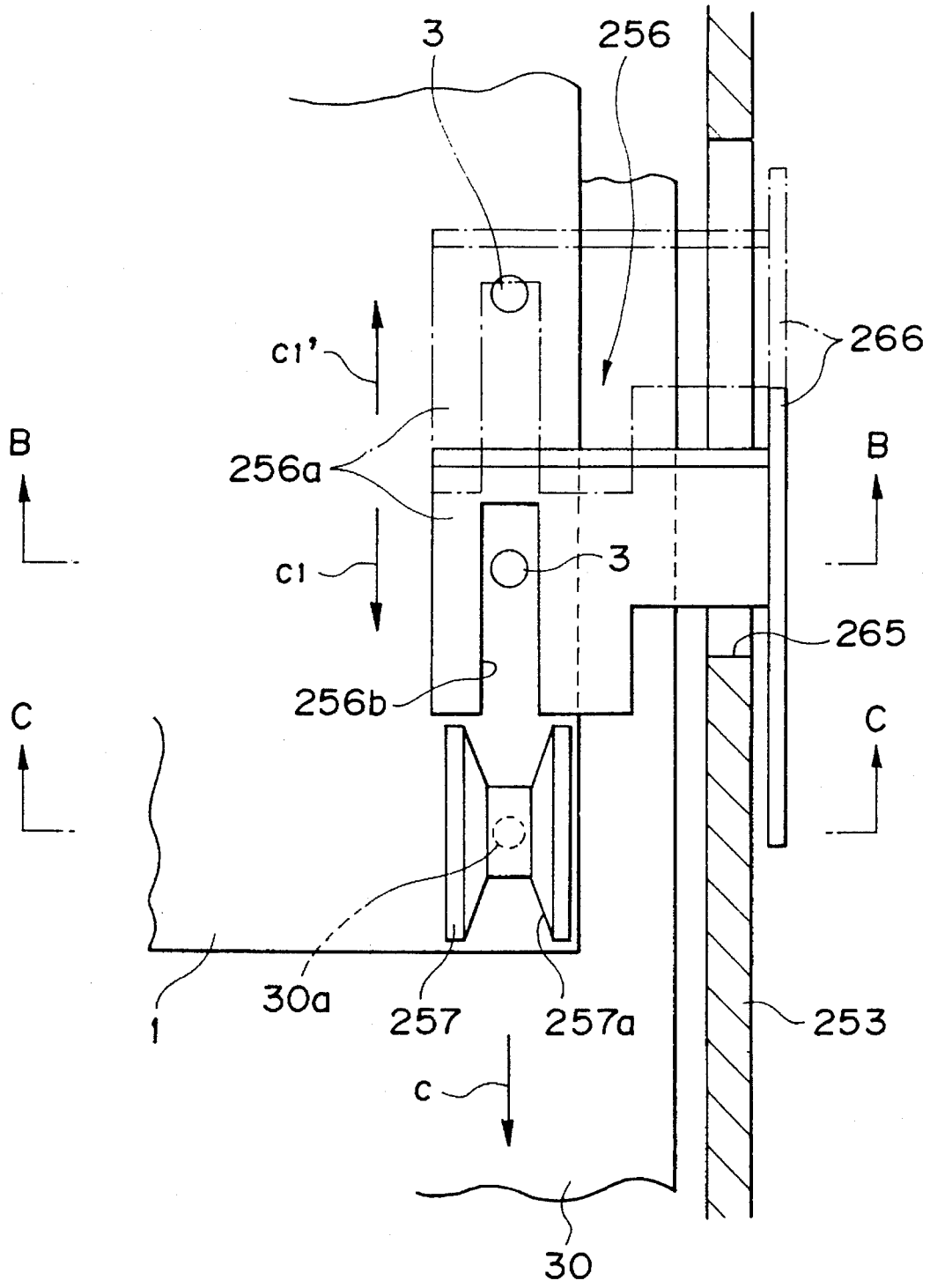
Figure 42A:
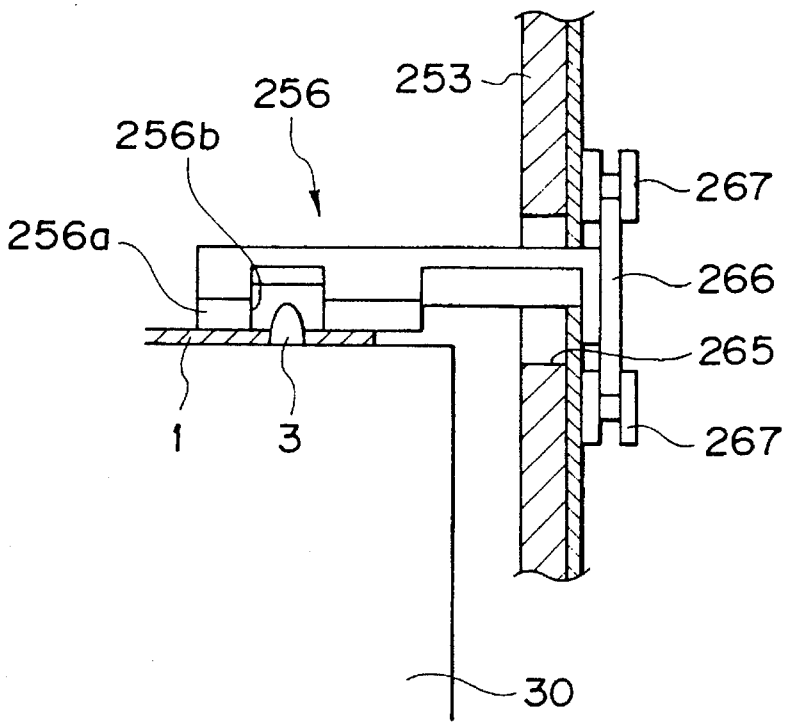
Figure 42B:
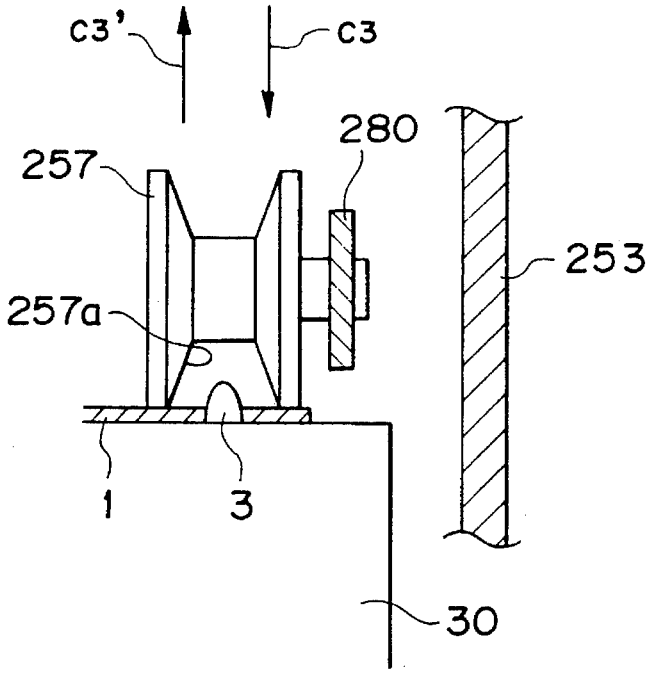
Figure 43:
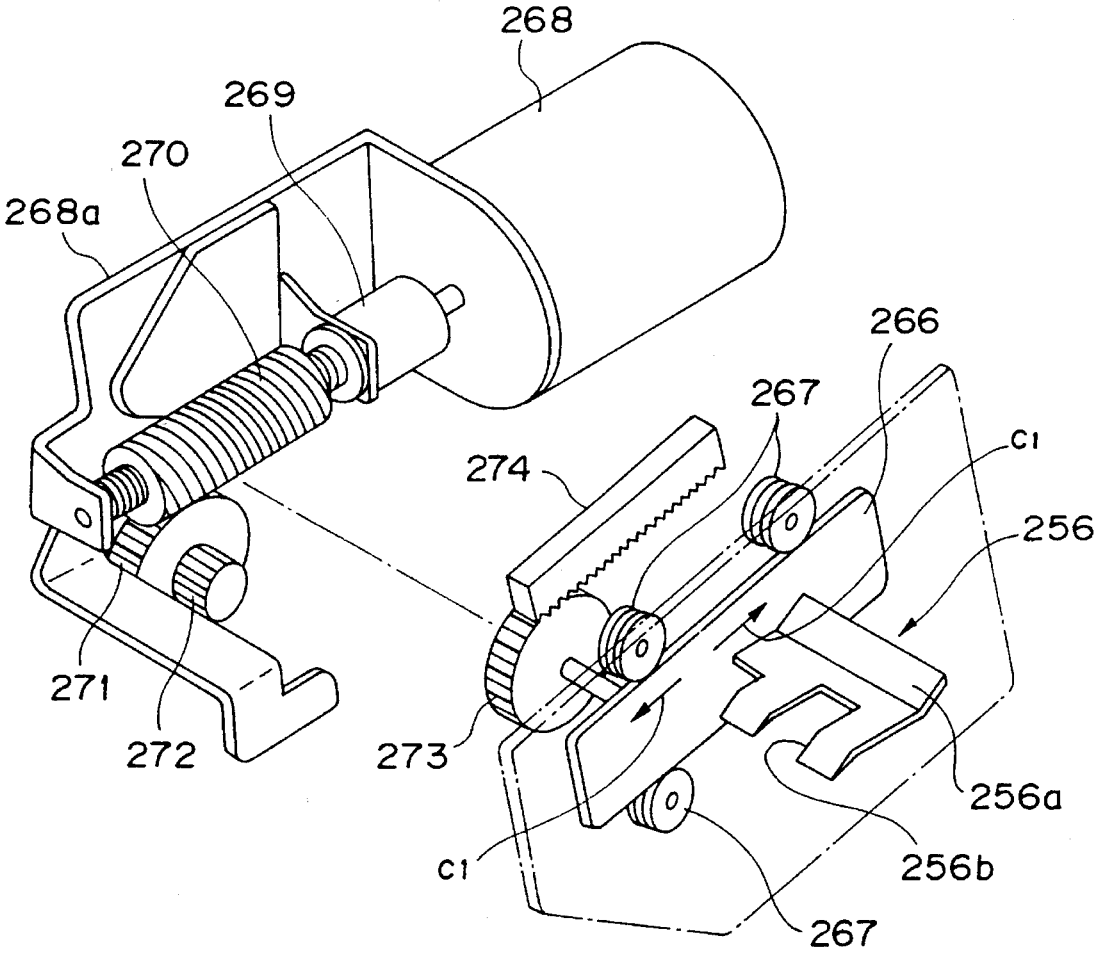
Figure 44:
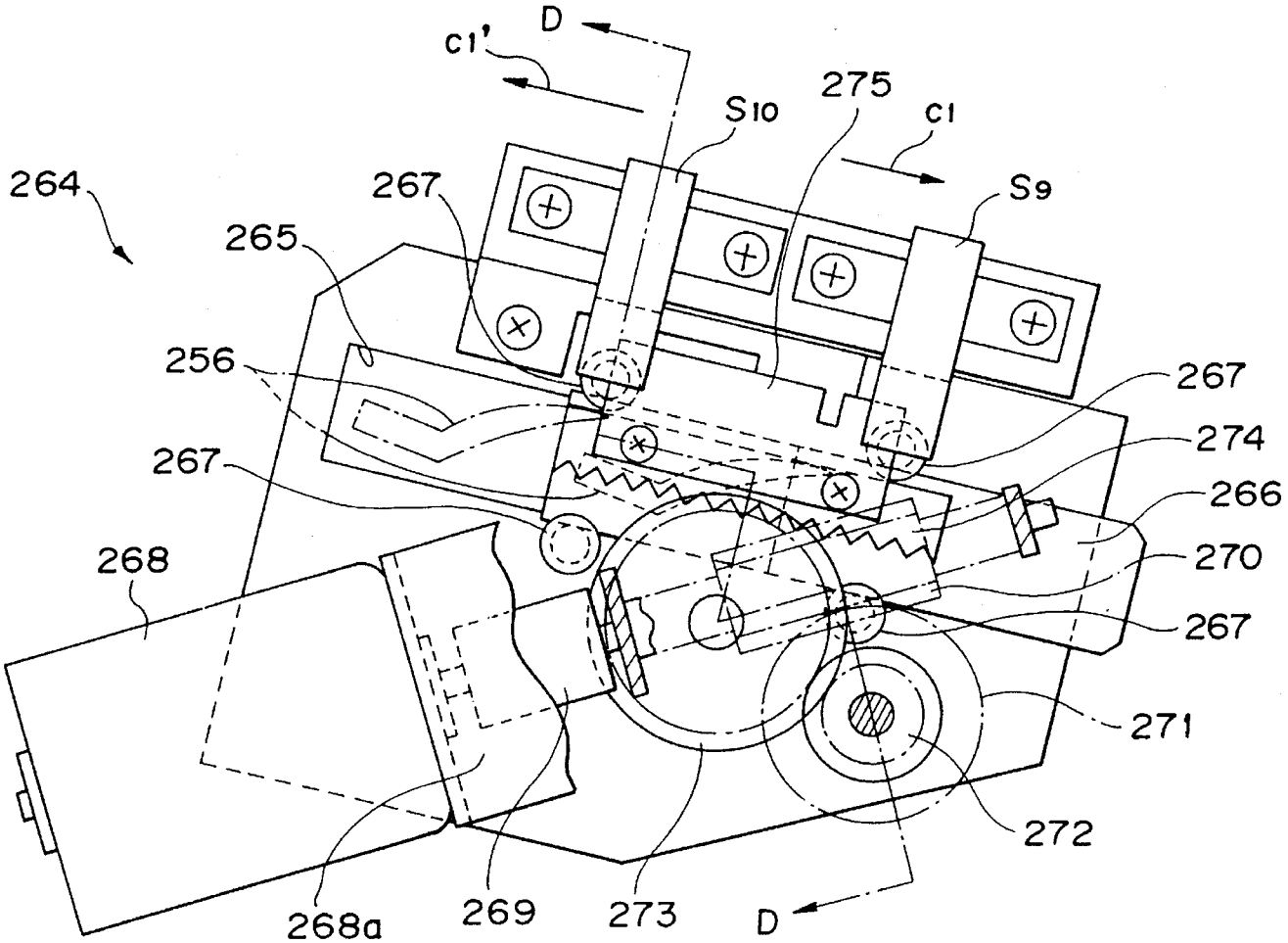
Figure 45:
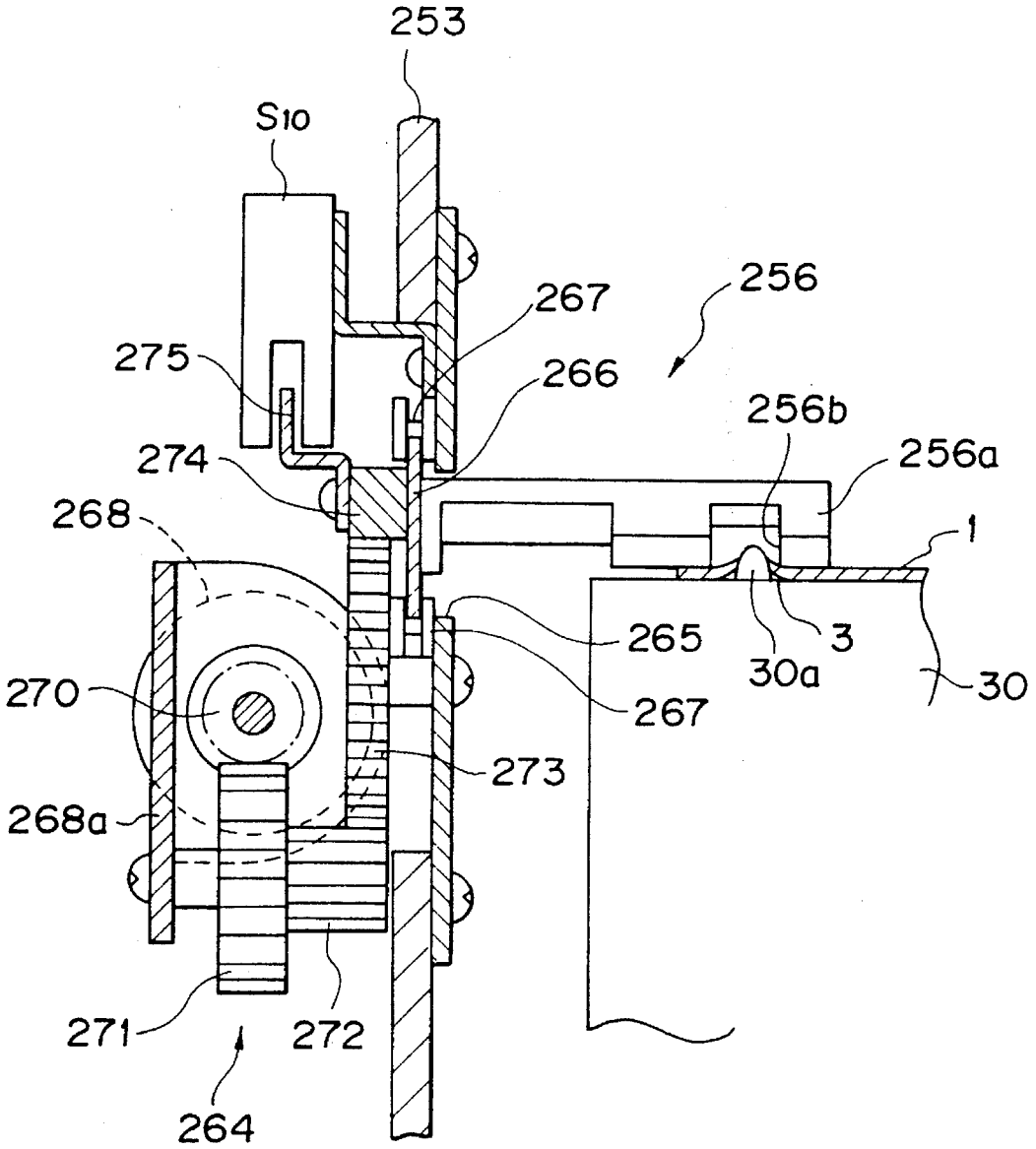
Figure 46:
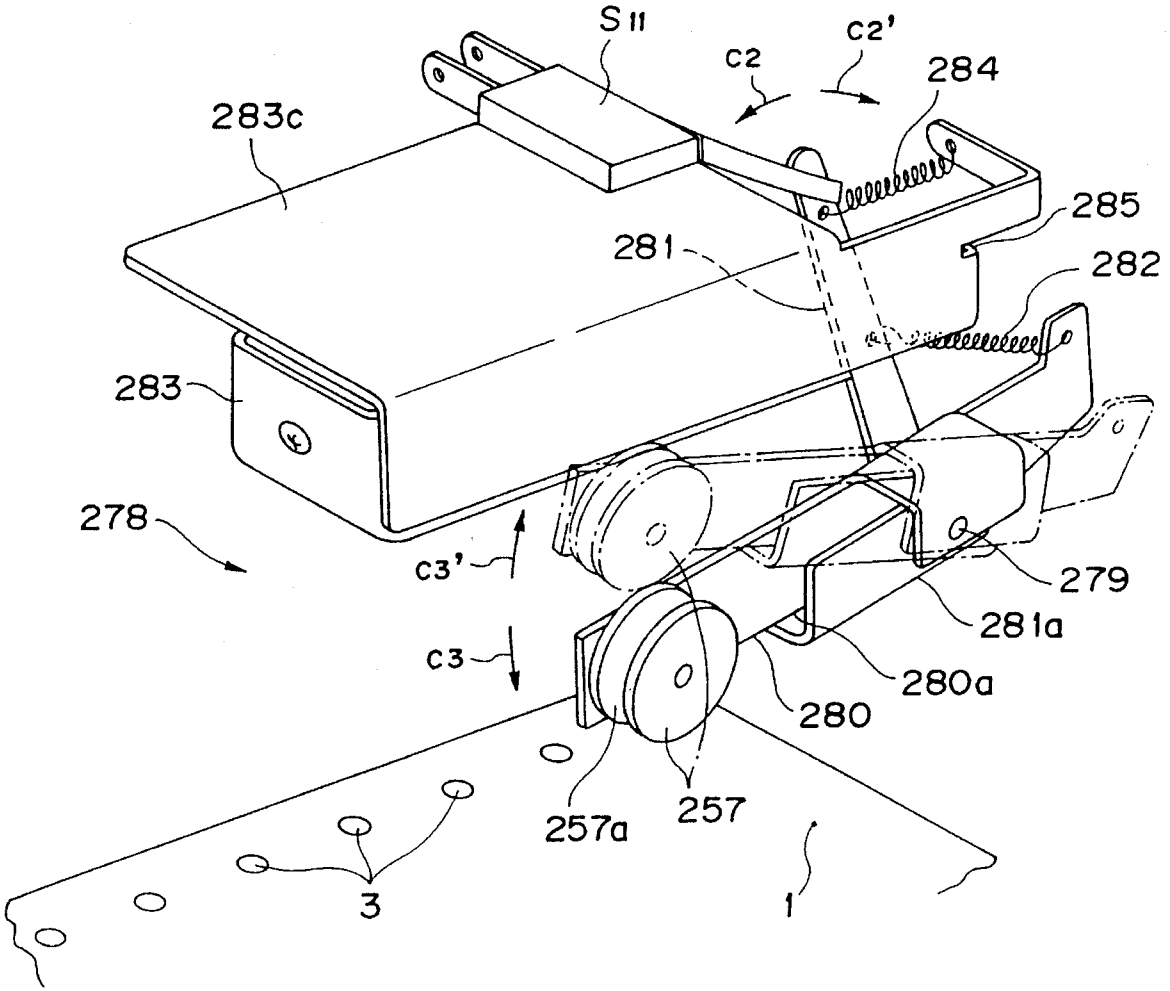
Figure 47:
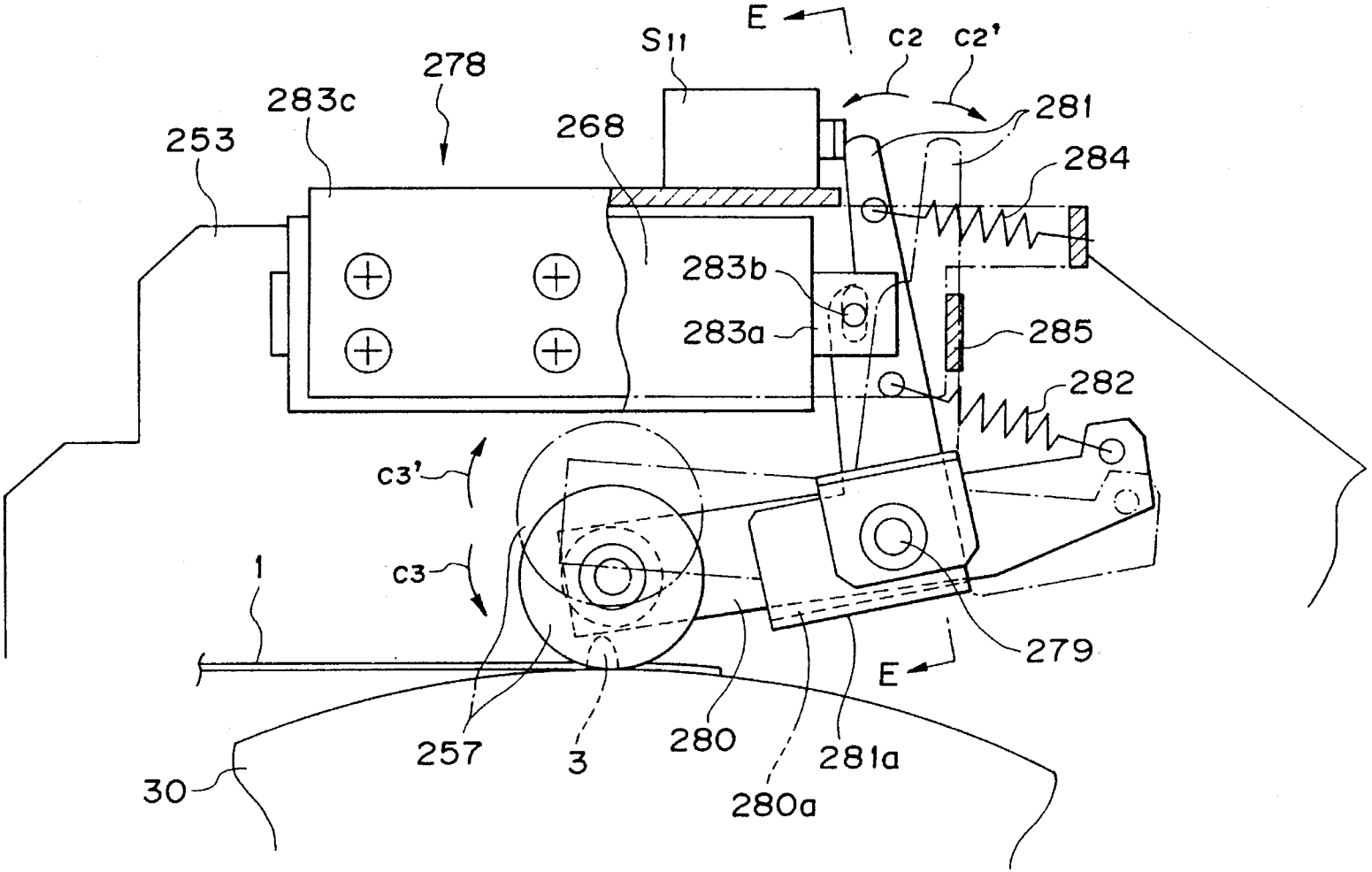
Figure 48:
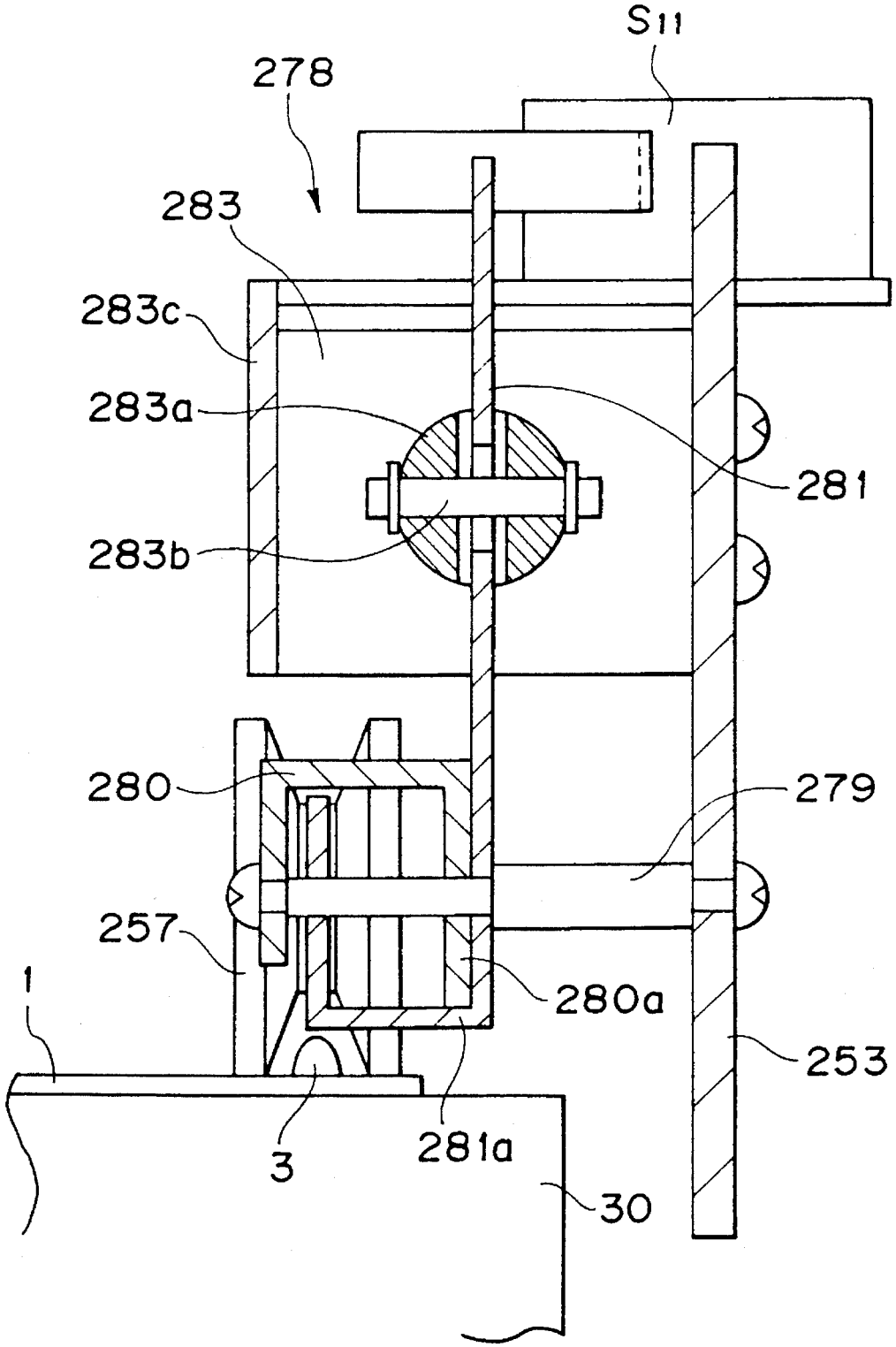
Figure 49:
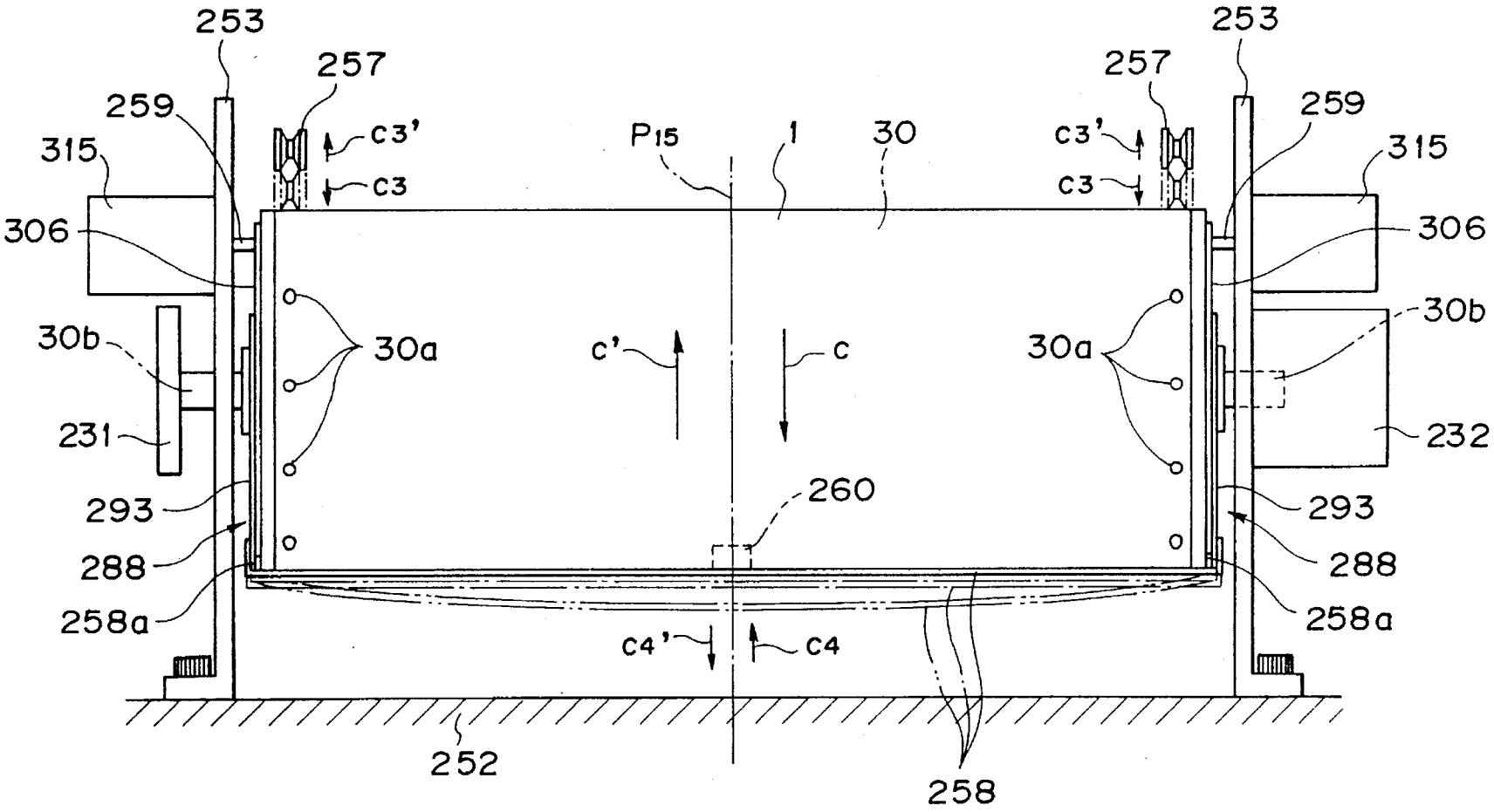
Figure 50:
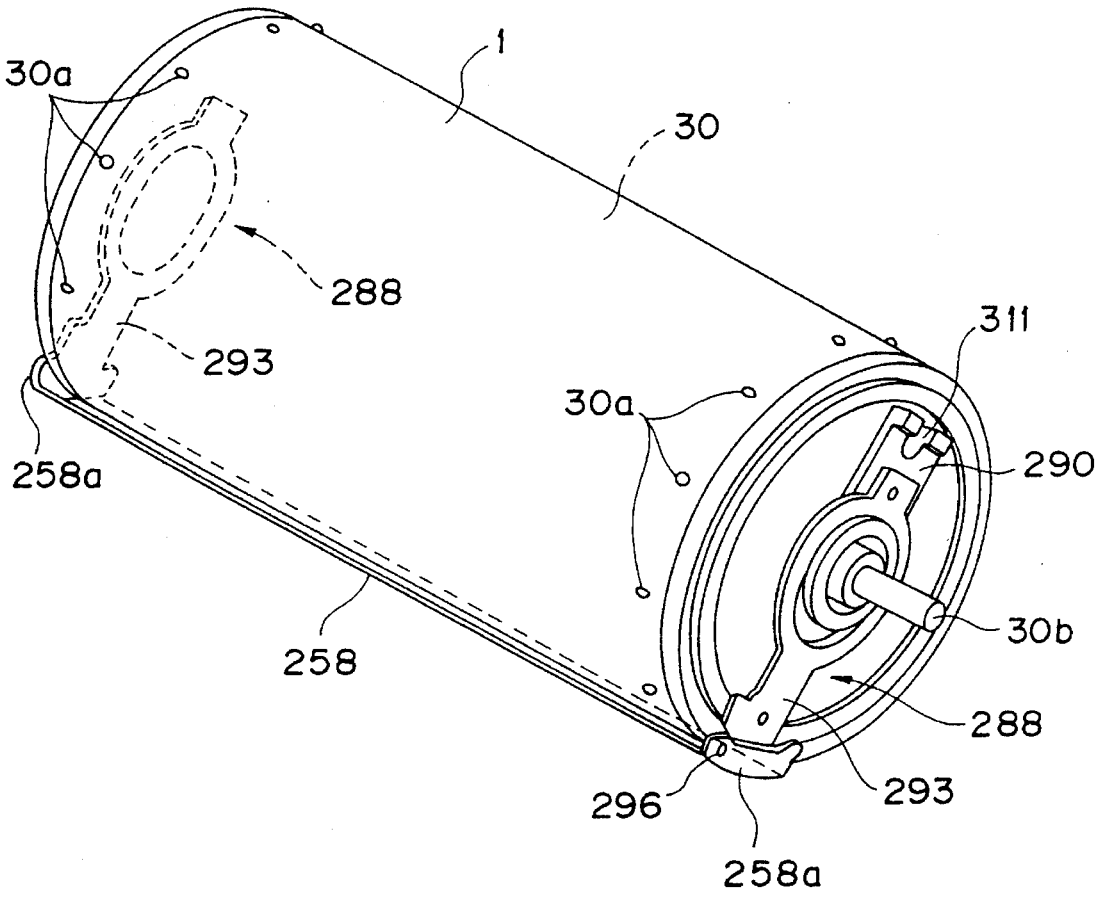
Figure 51:
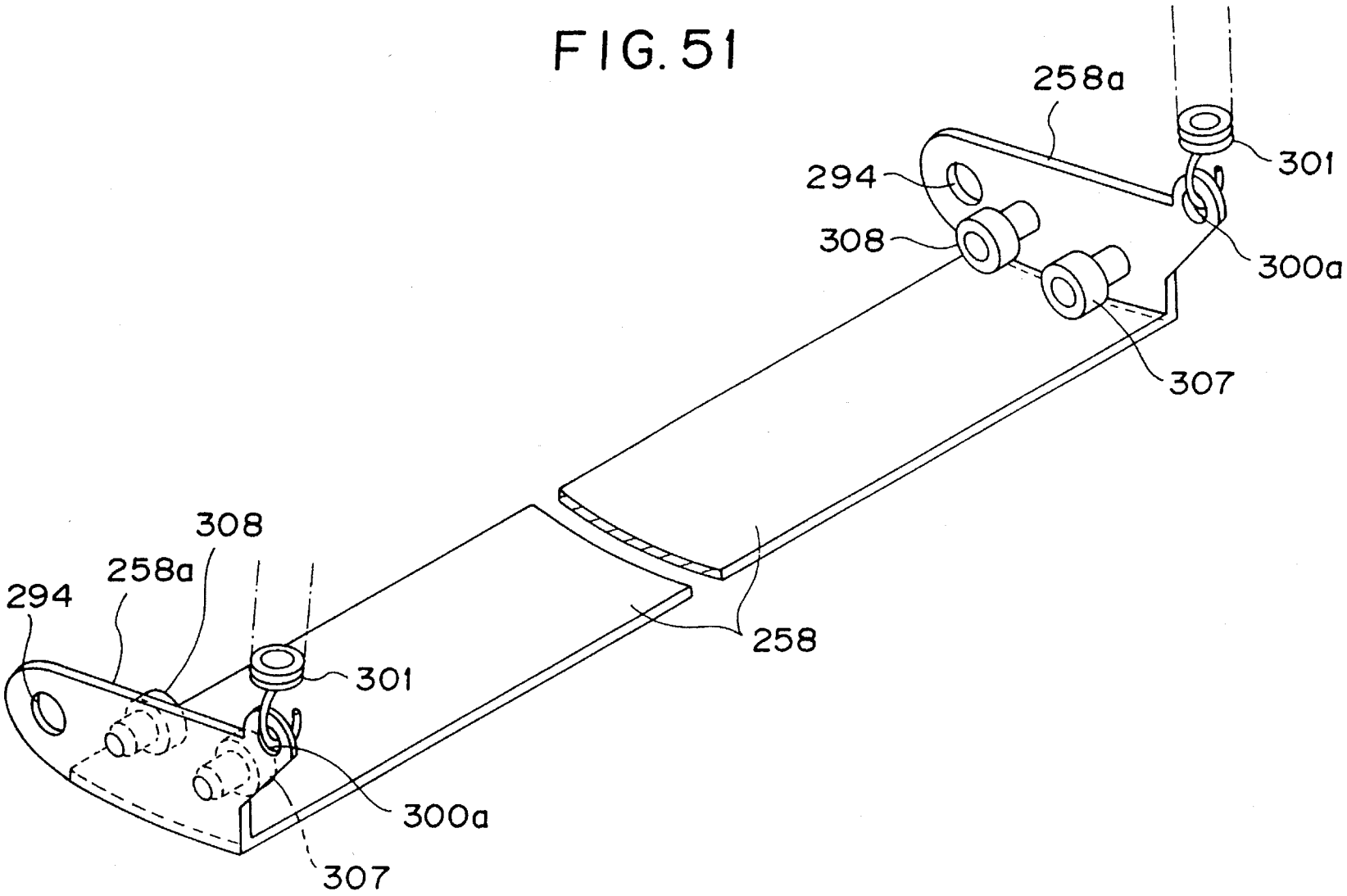
Figure 52:
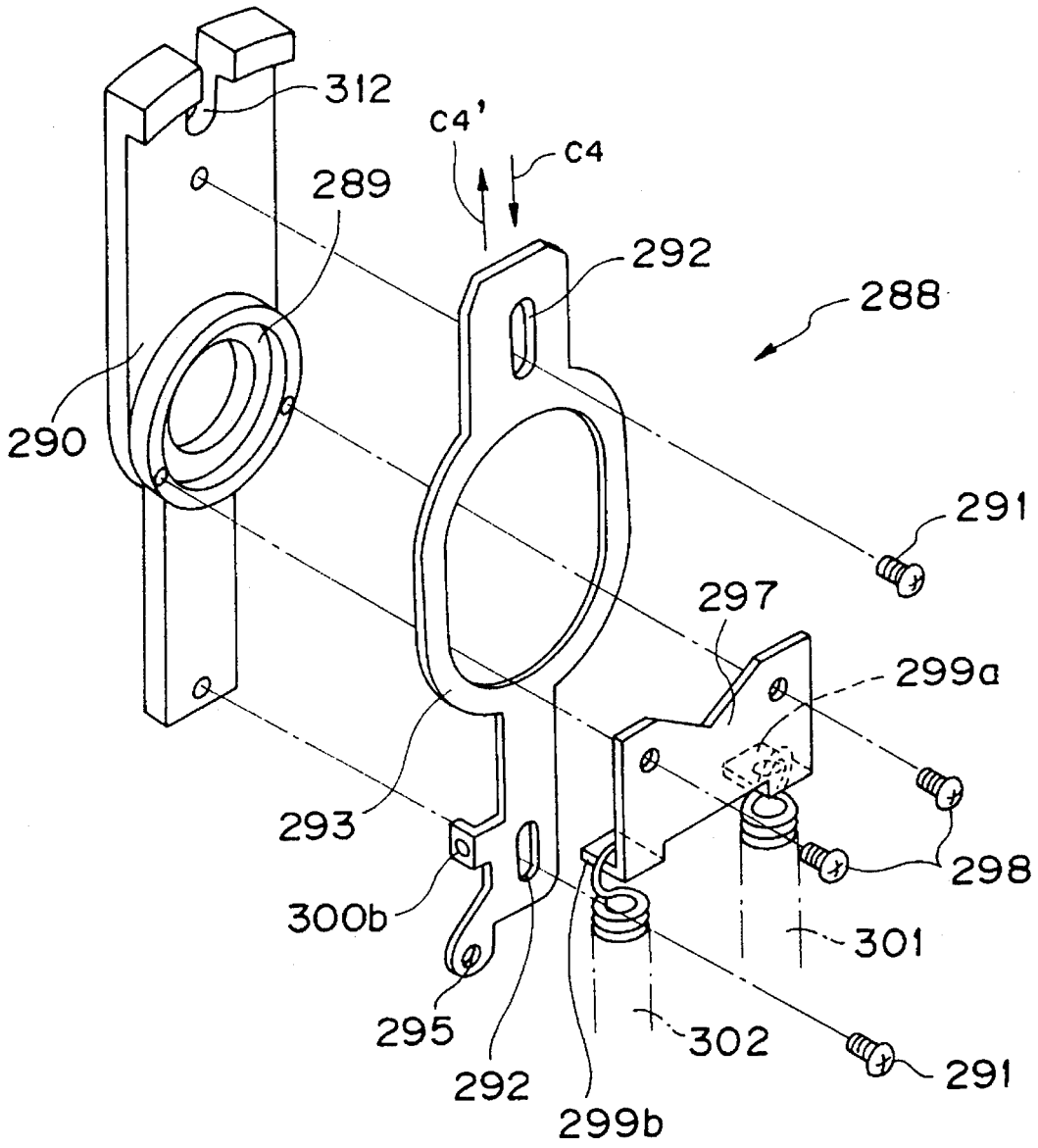
Figure 53:
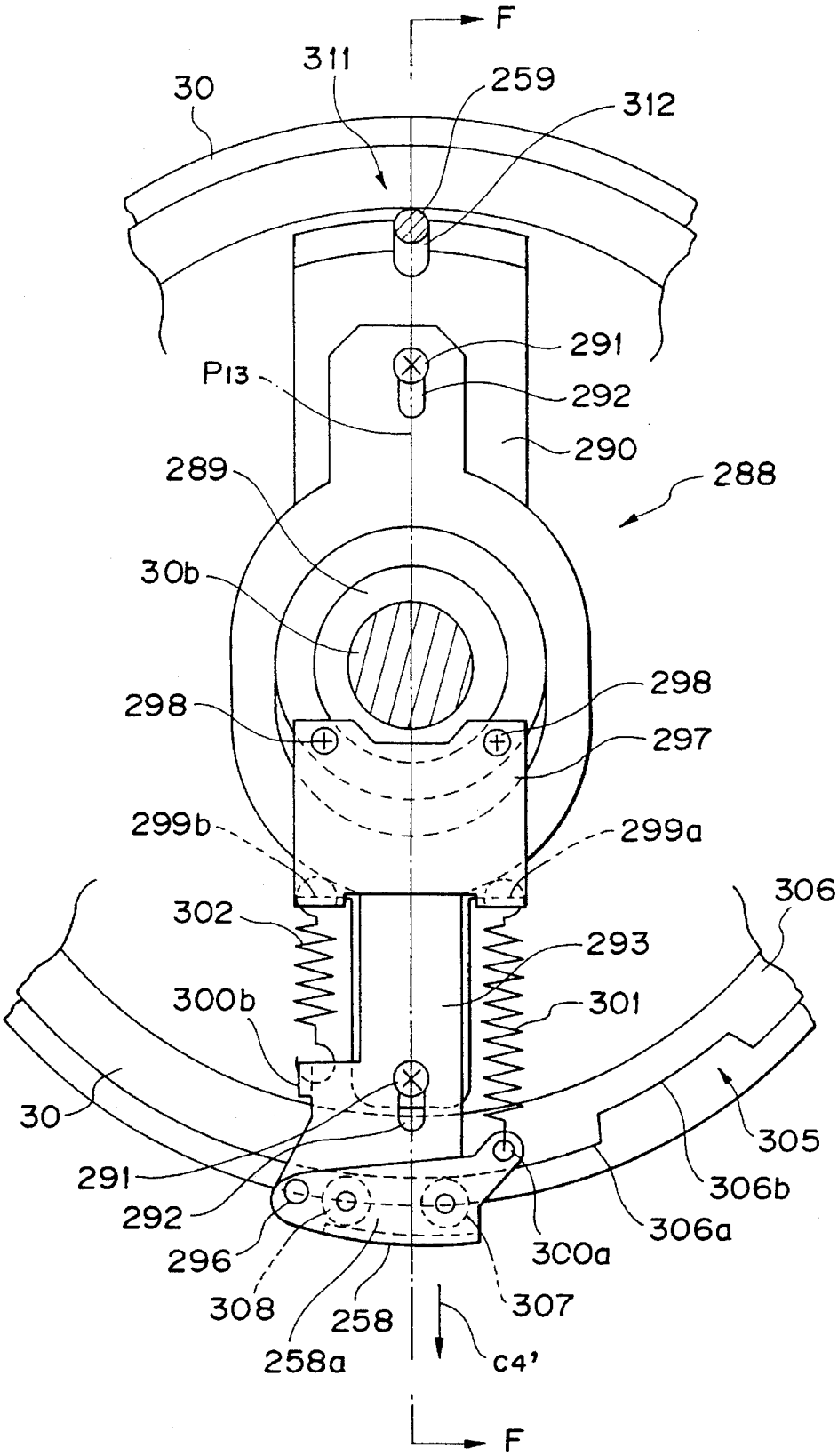
Figure 54:
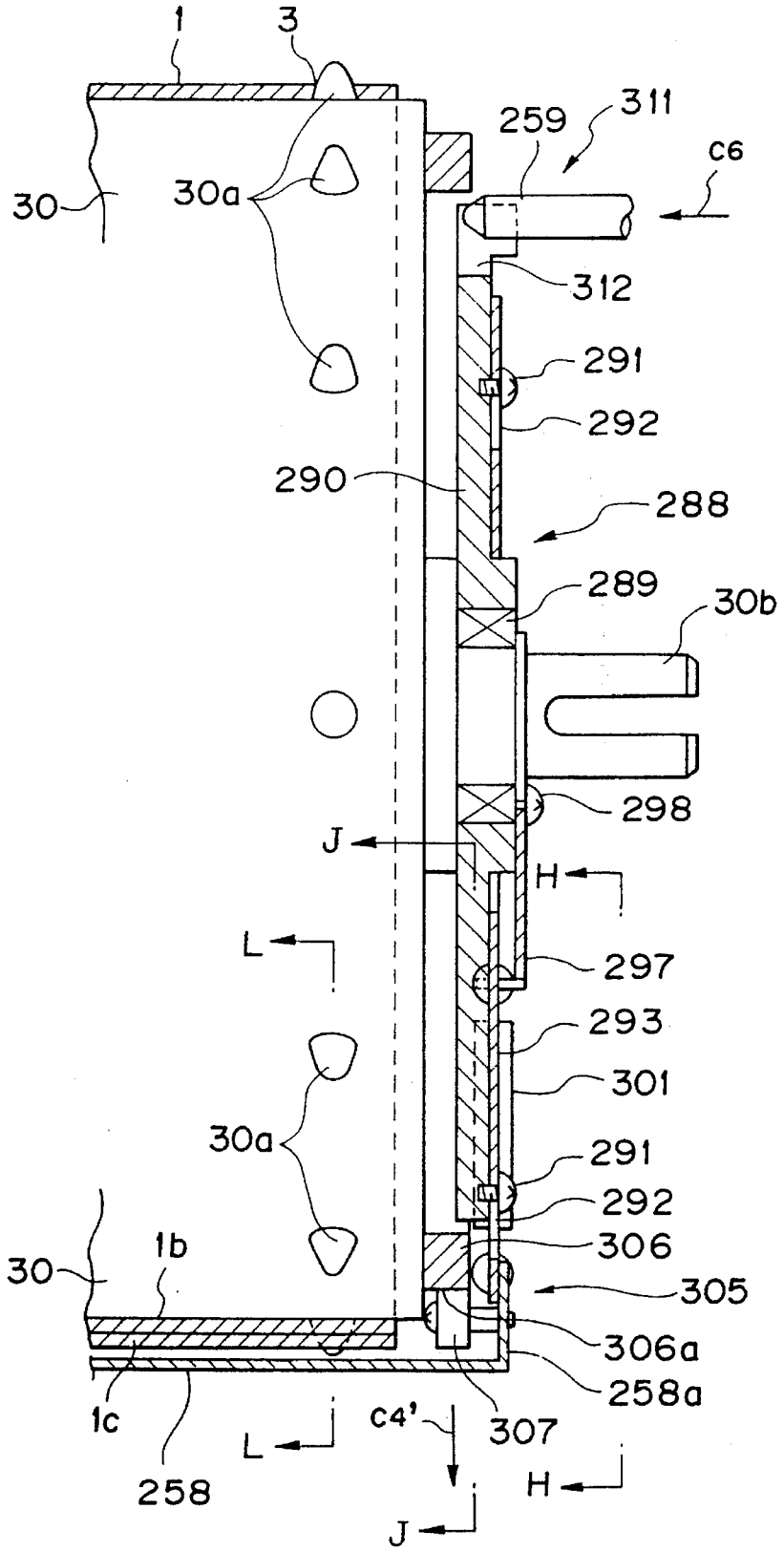
Figure 55:
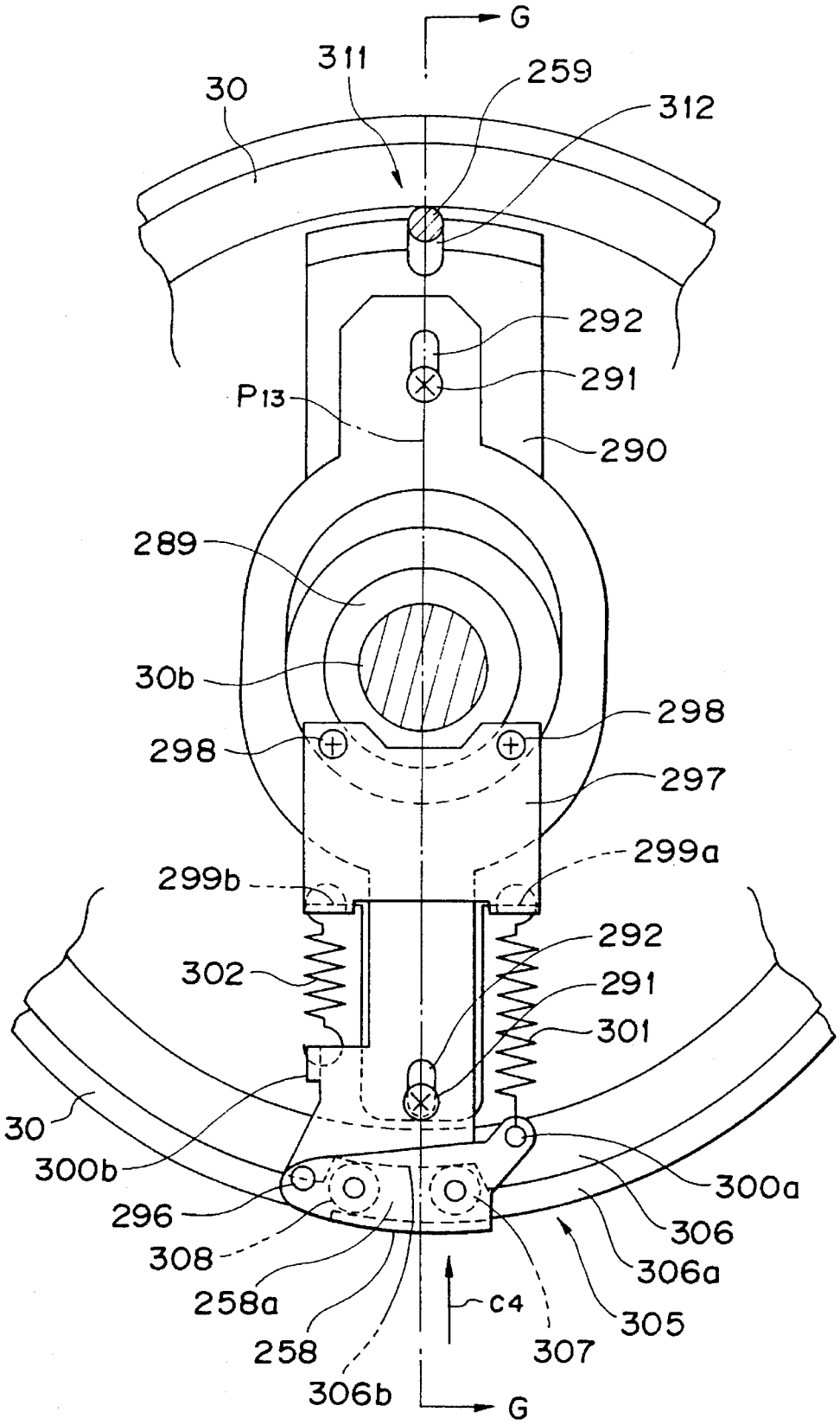
Figure 56:
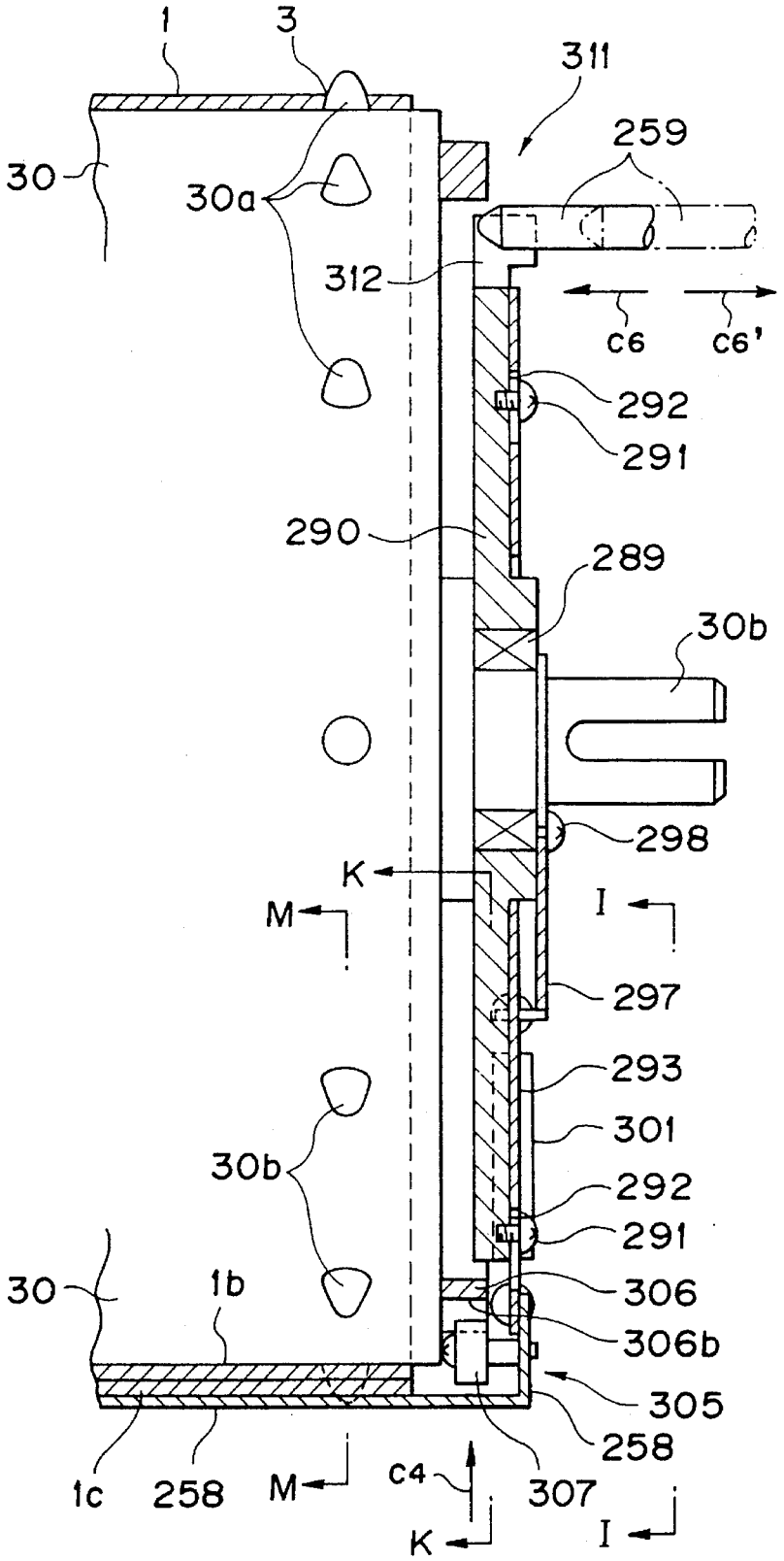
Figure 57:
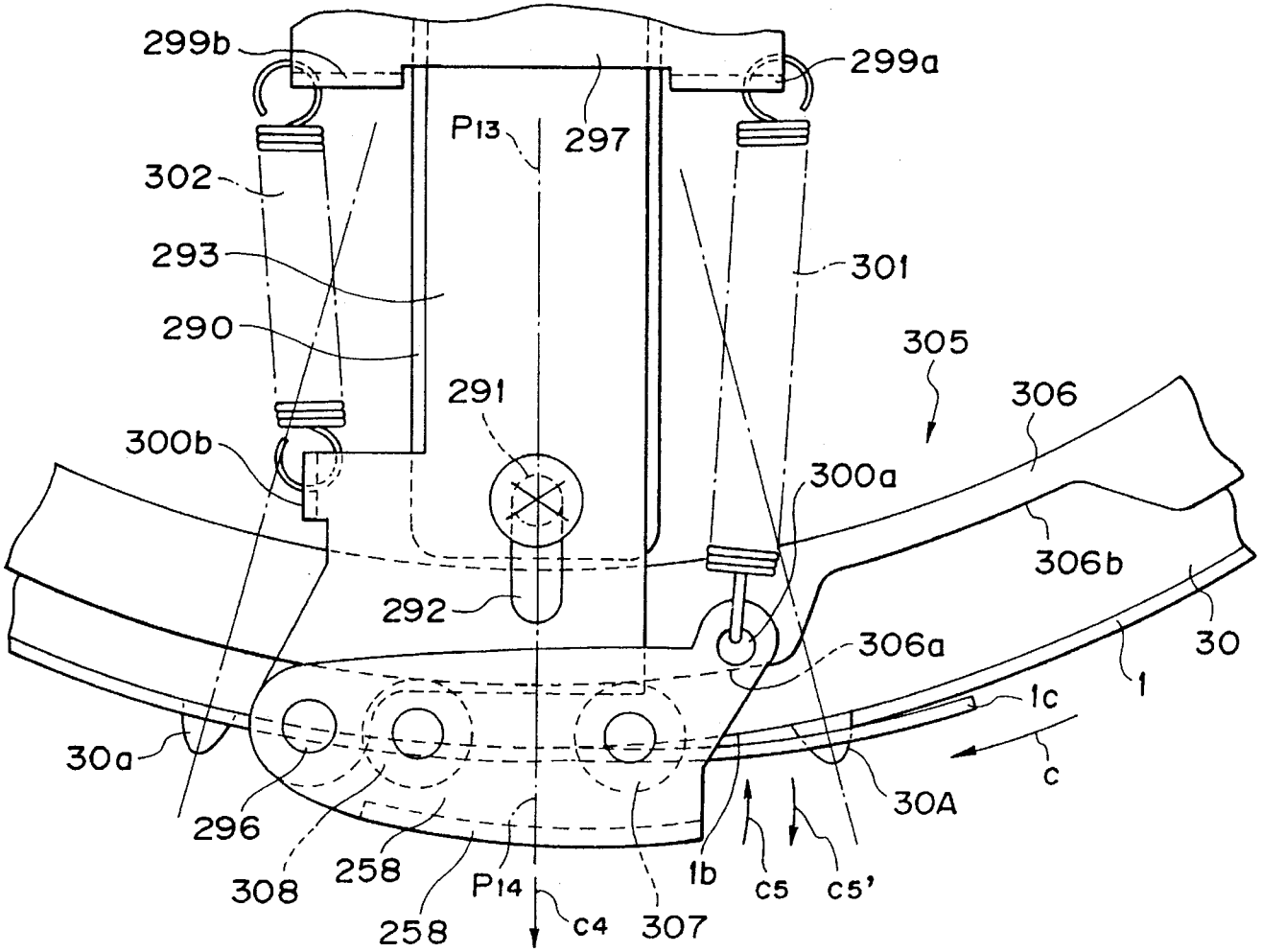
Figure 58:
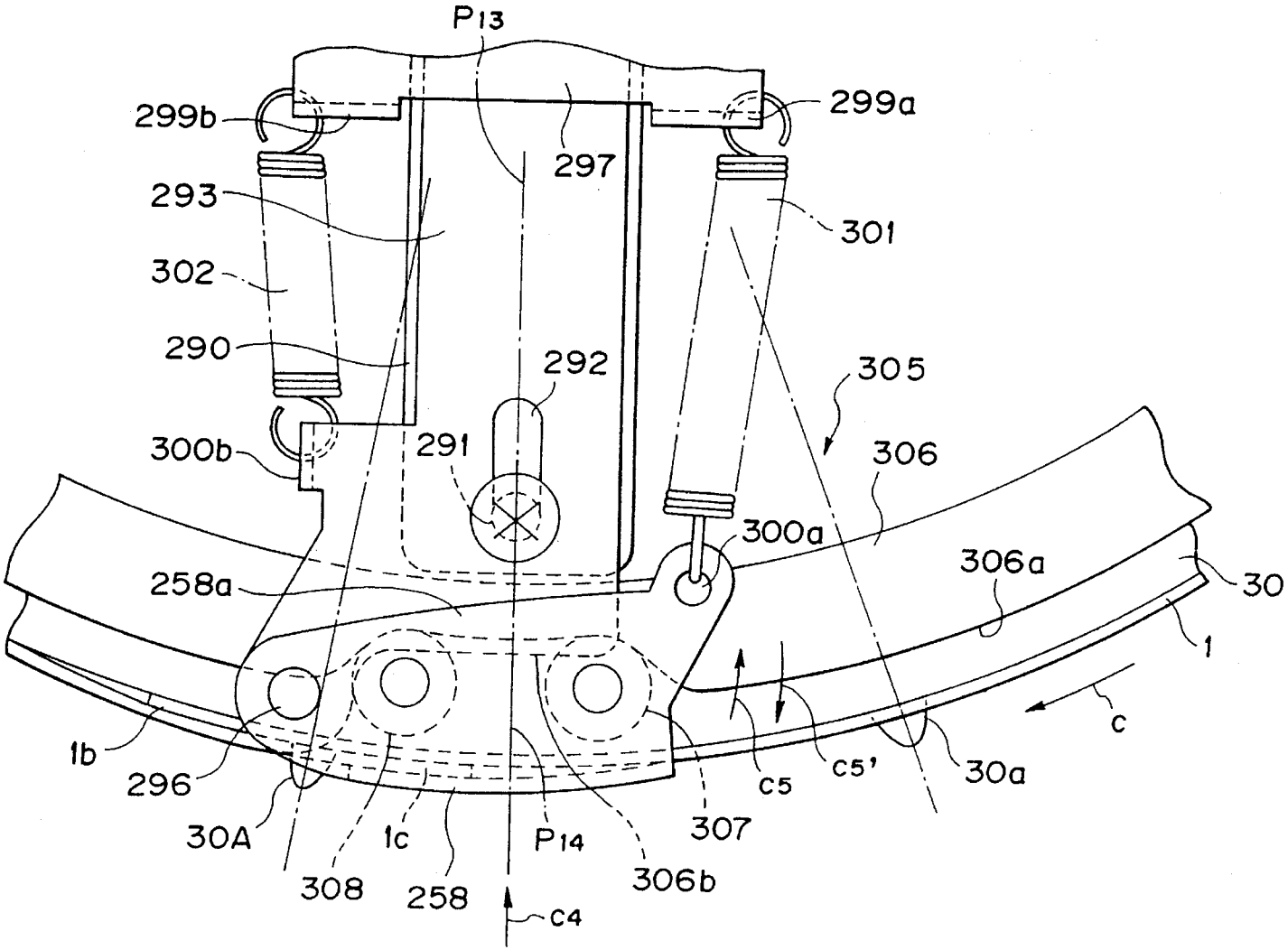
Figure 59:
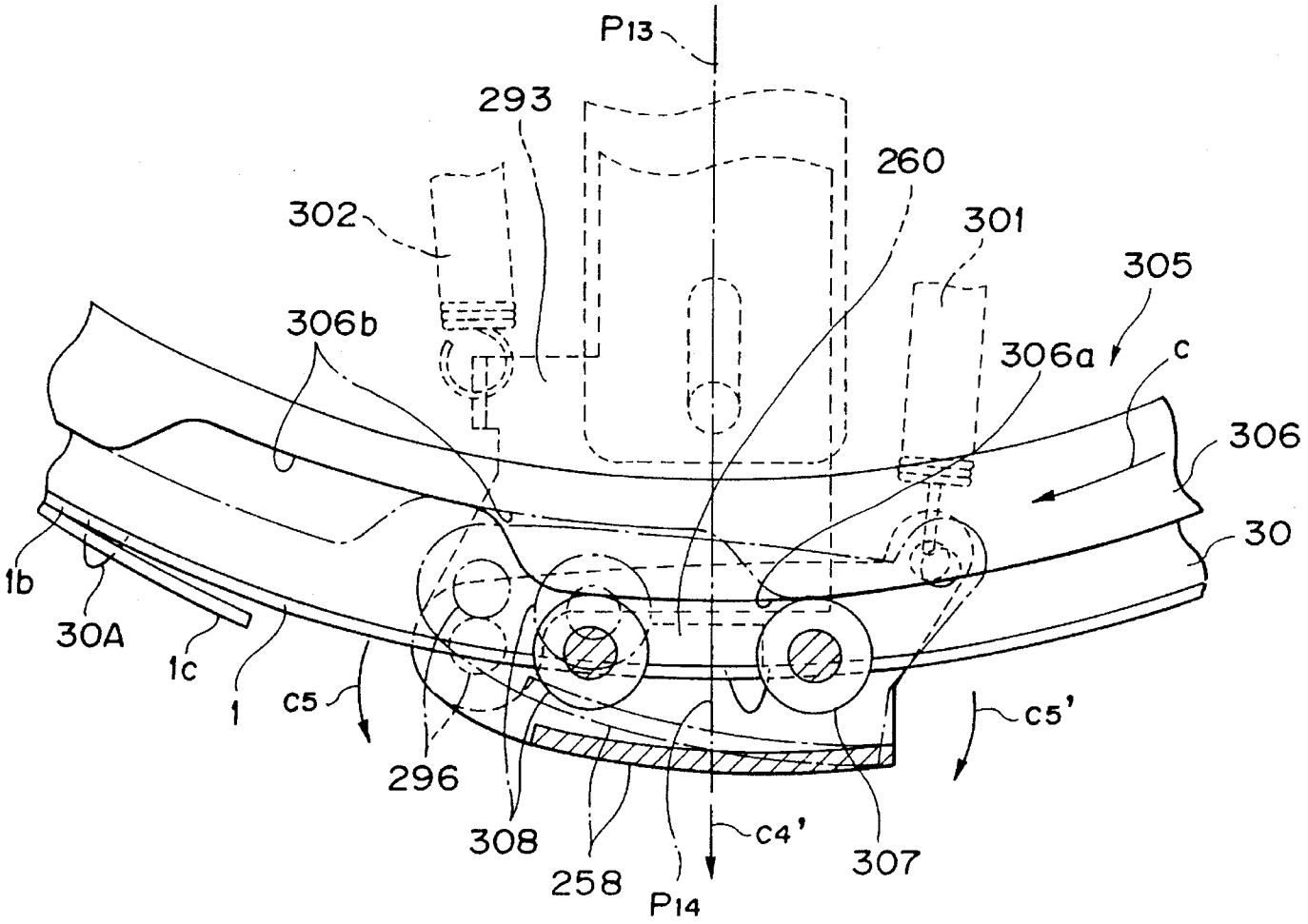
Figure 60:
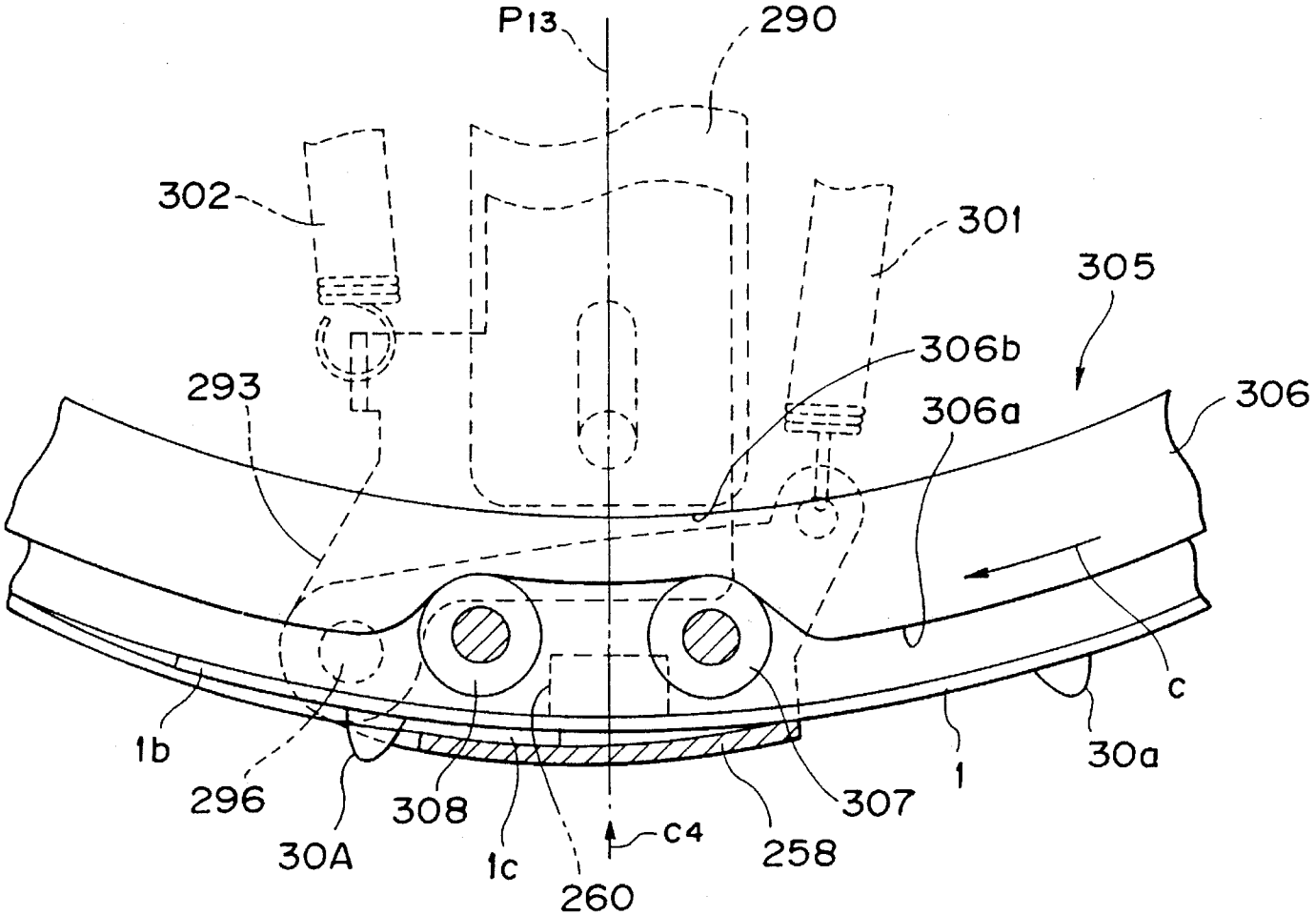
Figure 61:
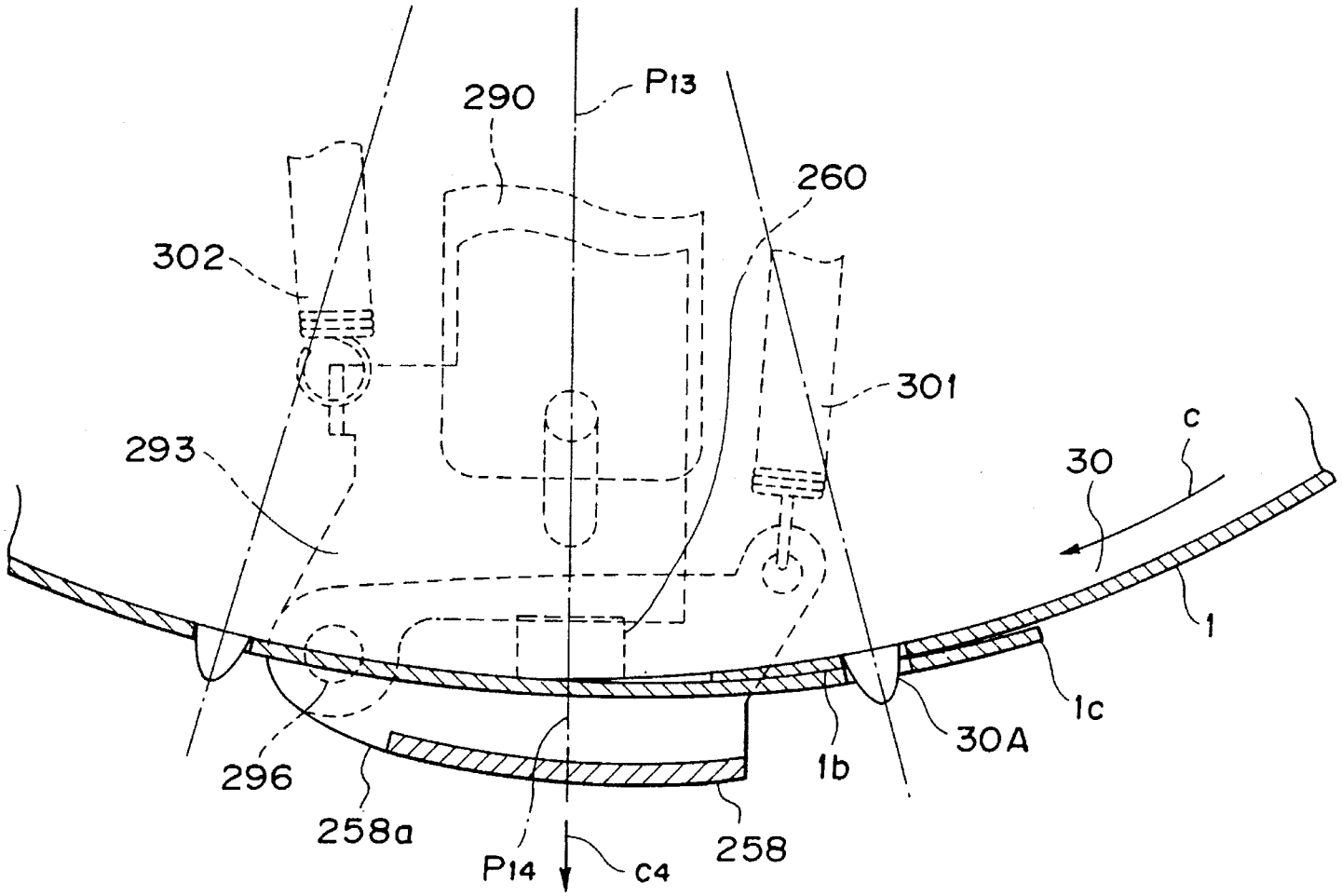
Figure 62:
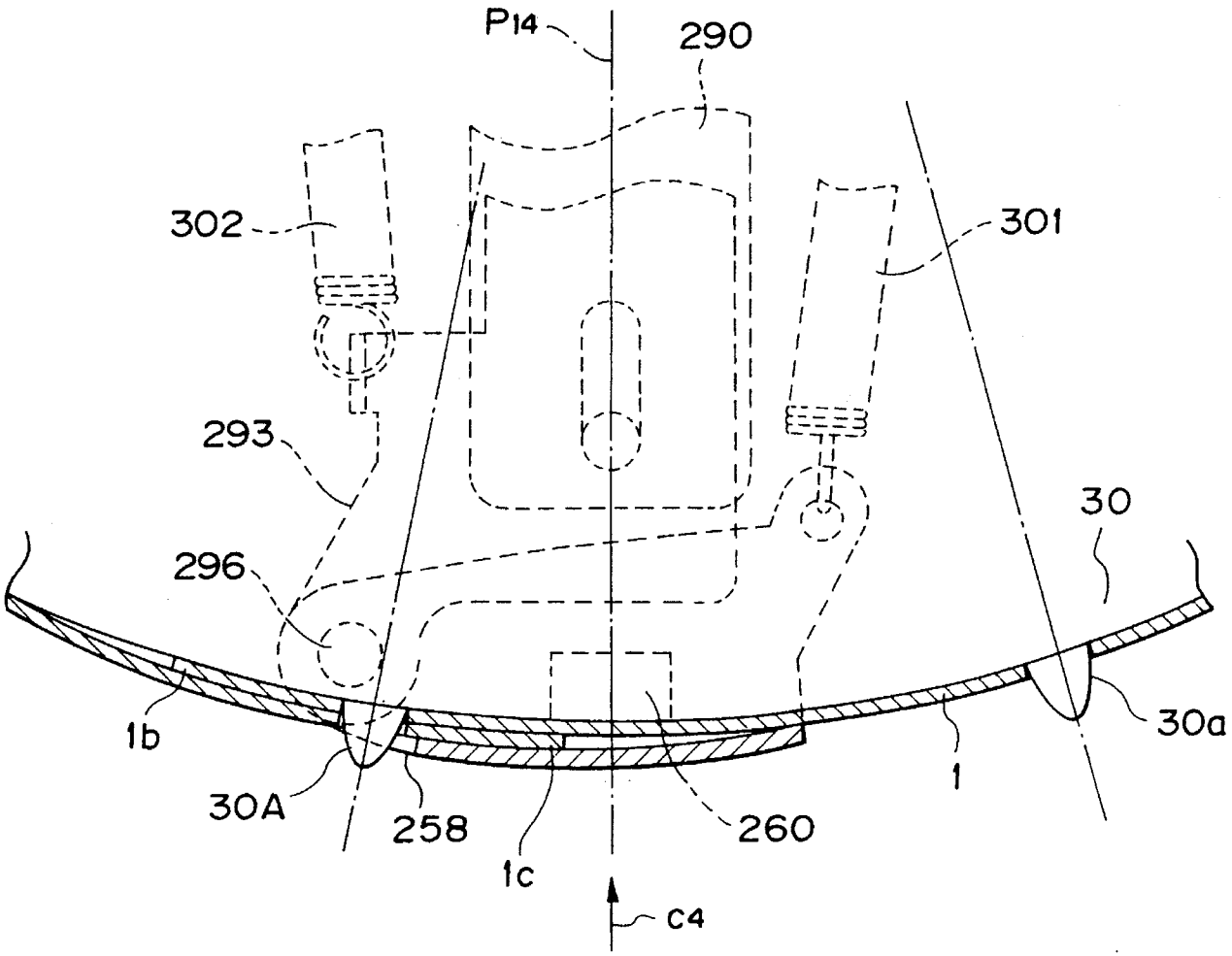
Figure 63:
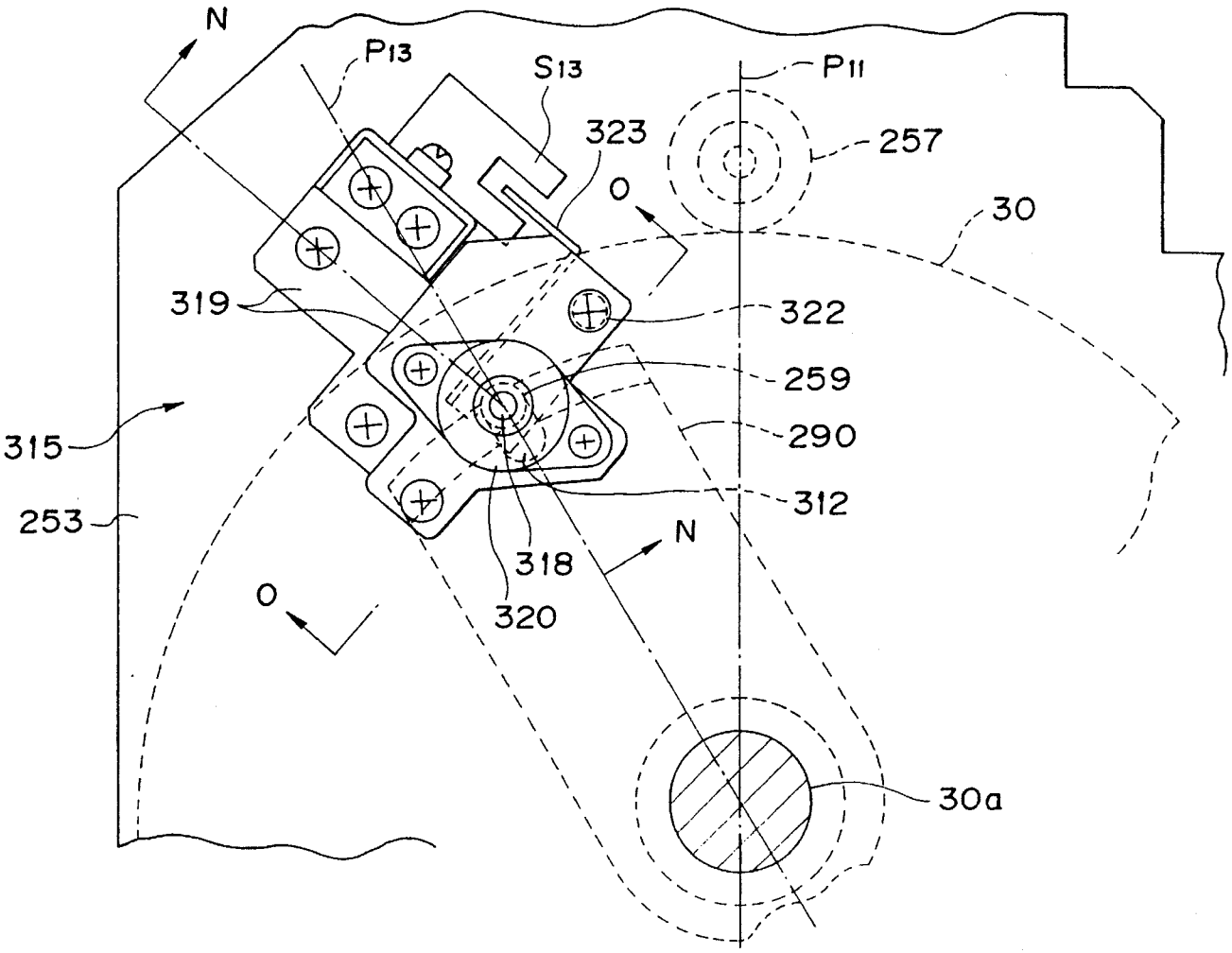
Figure 64:
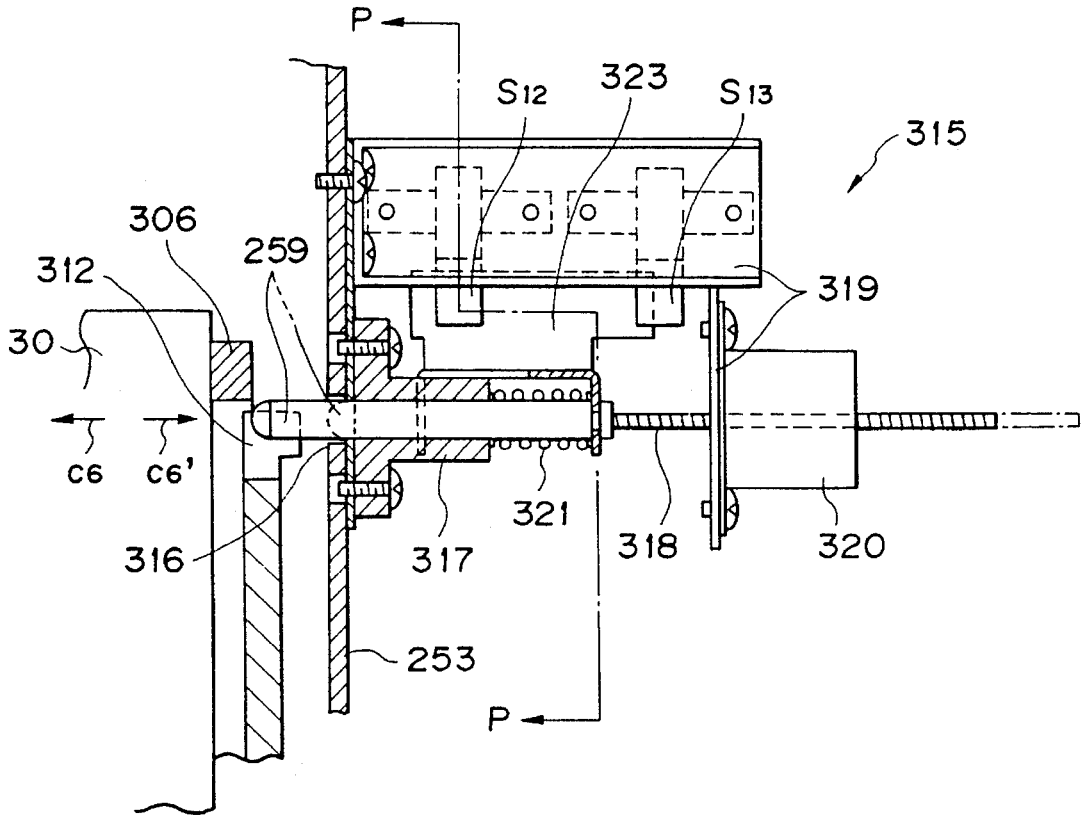
Figure 65:
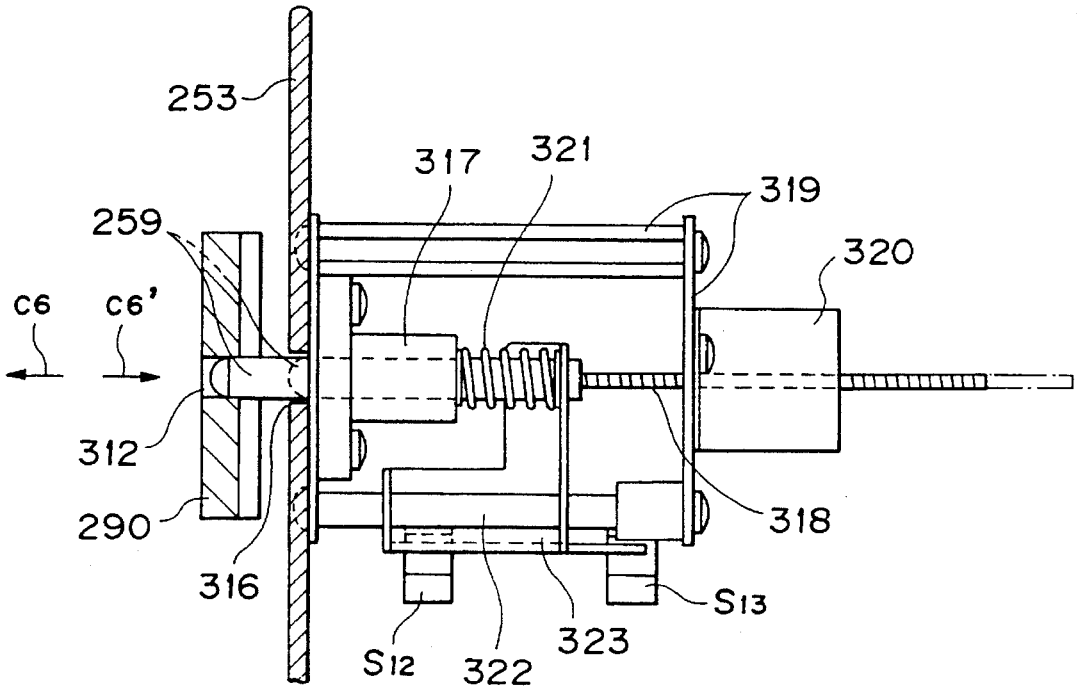
Figure 66:
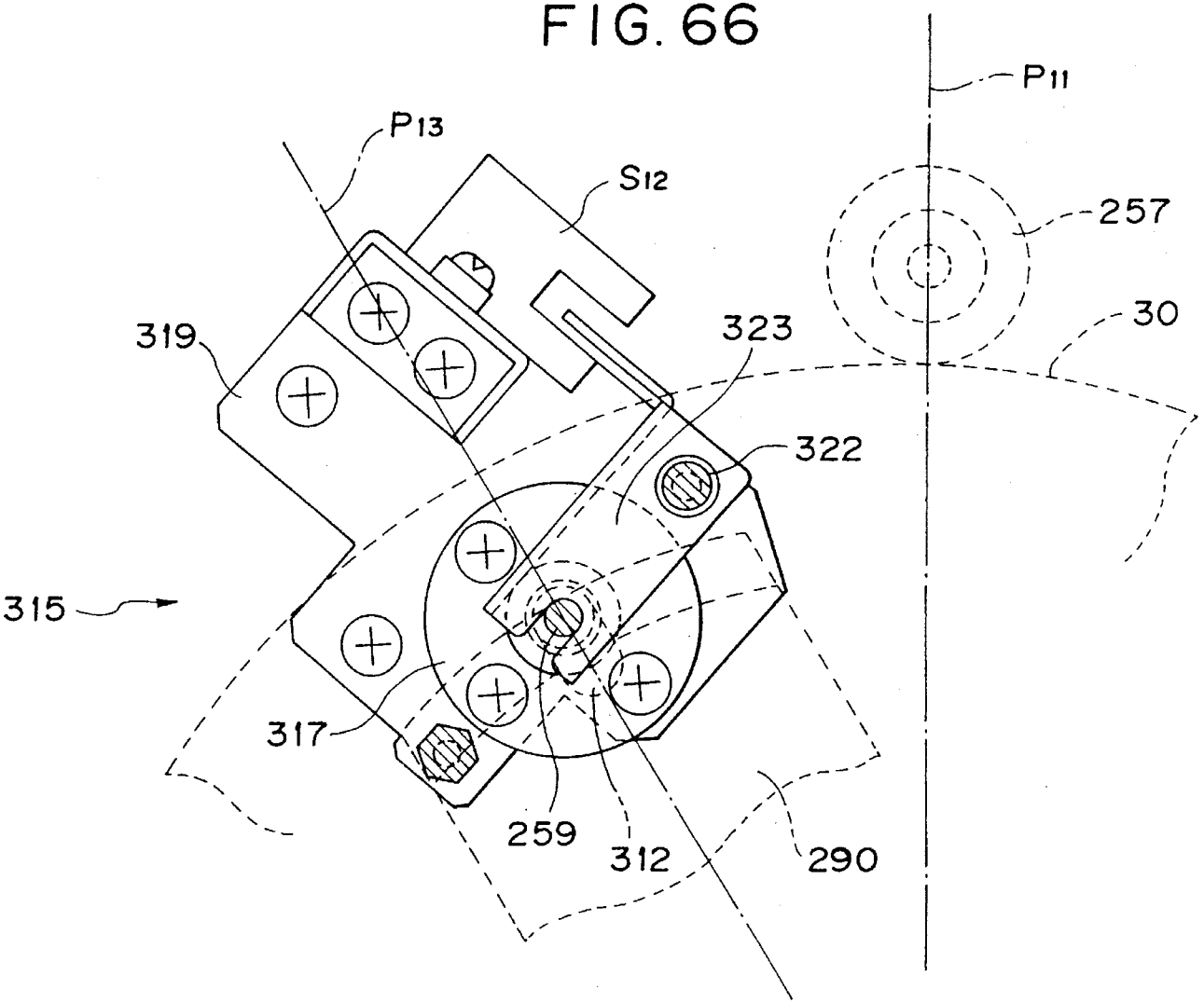
Figure 67:
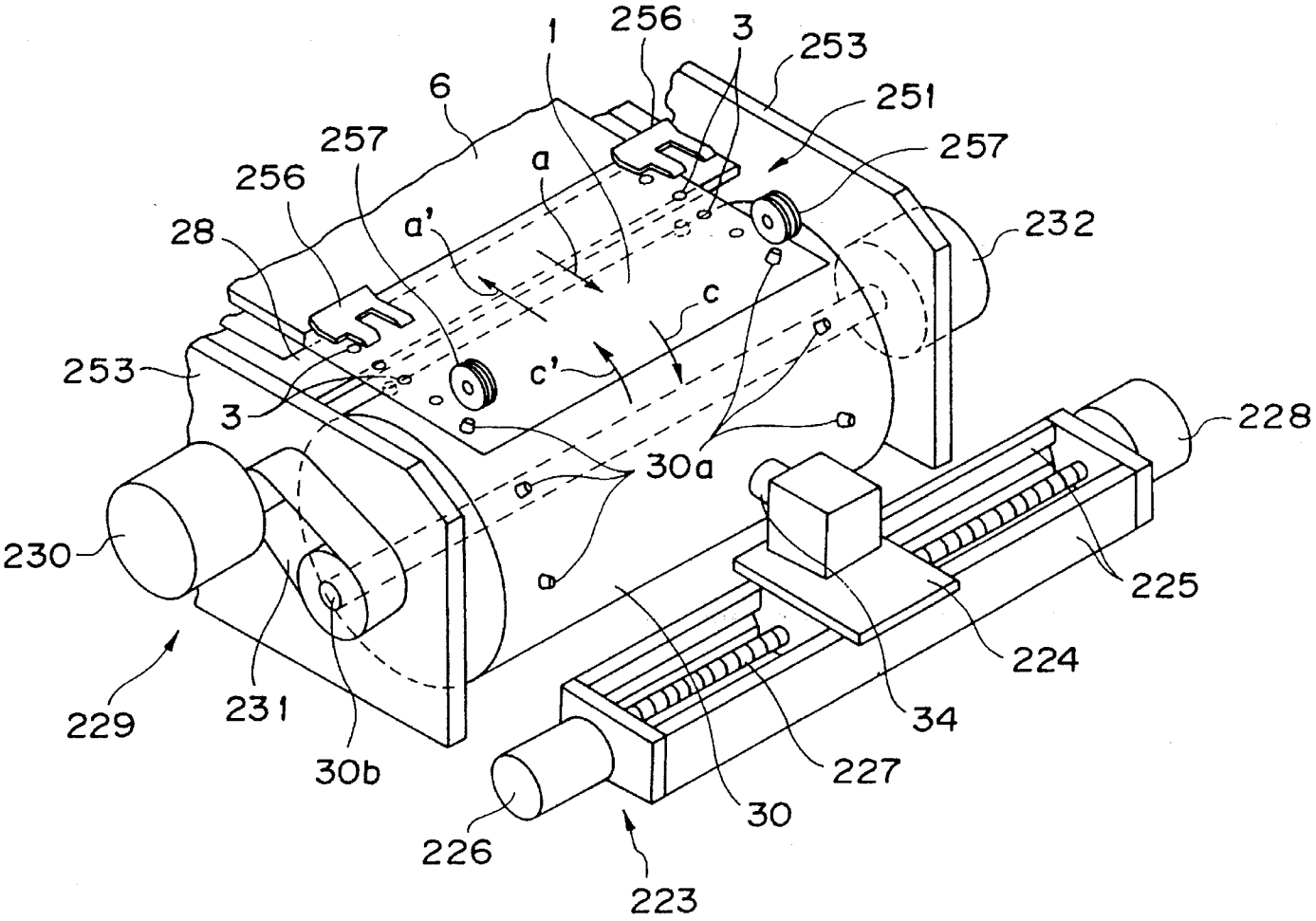
Figure 68:
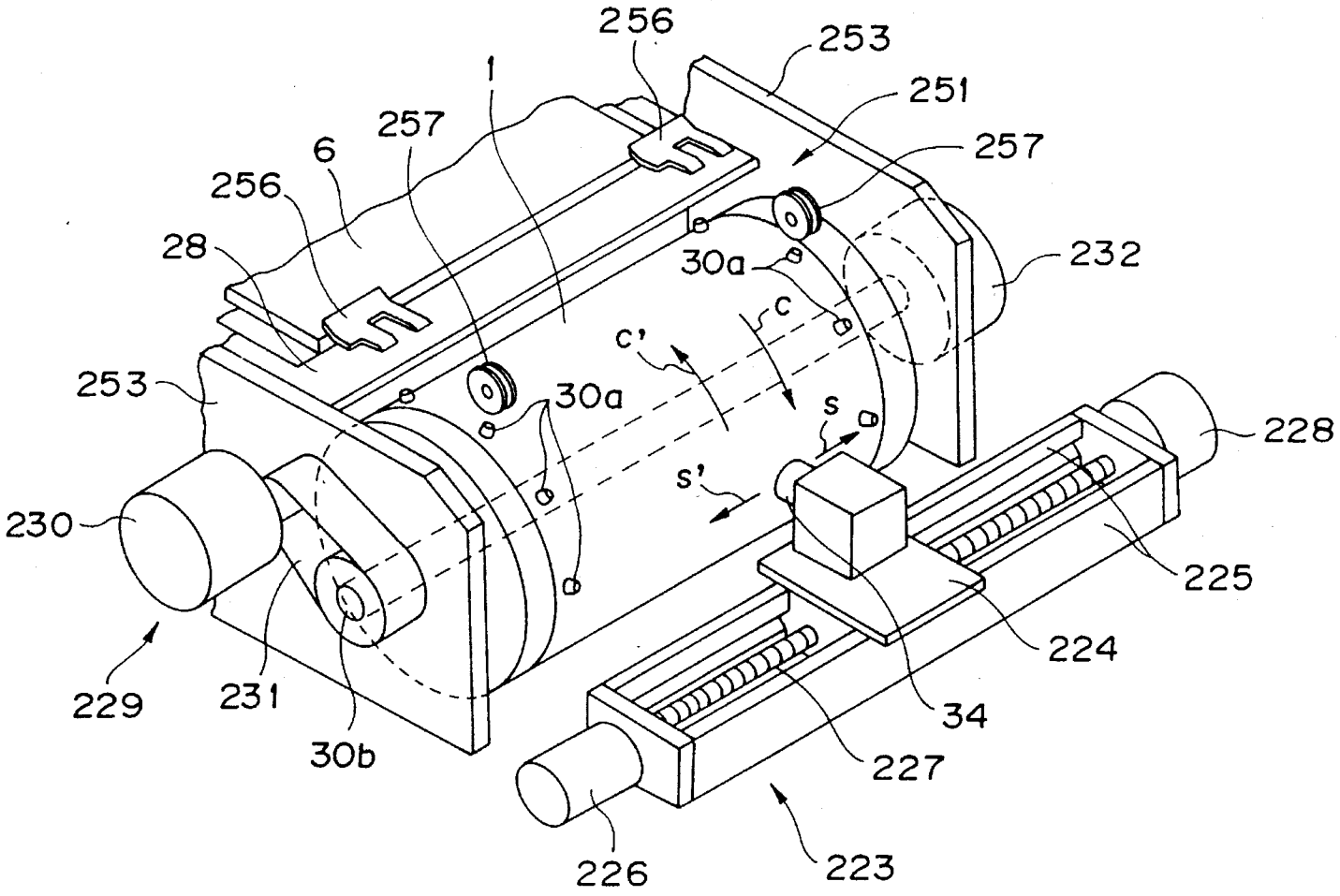

shows the opening/closing flap in its locked state;

FIG. 6(A) is an enlarged sectional view taken along the line B—B in FIG. 4, and FIG. 6(B) is an enlarged sectional view taken along the line C—C in FIG. 4;

FIG. 7(A) is an enlarged view showing slit and taper portions of a printing sheet jacket, and FIG. 7(B) is a sectional view taken along the line D—D in FIG. 7(A);

FIG. 8(A) is an outline side view of a printing sheet making machine, and FIG. 8(B) is a sectional side view of a main part of the printing sheet making machine illustrating an engraving step;

FIG. 9(A) is an outline side view of a printing machine, and FIG. 9(B) is a sectional side view of a main part of the printing machine illustrating a printing step;

FIG. 10 is an overall plan view of a printing sheet feed and eject apparatus;

FIG. 11 is a simplified side view taken along the line E—E in FIG. 10, mainly illustrating the arrangement of a jacket and printing sheet pulling in device, a jacket holding device and a jacket side flap opening device;

FIG. 12 is a side view taken along the line E—E in FIG. 10 mainly illustrating the arrangement of a number of sensors;

FIG. 13 is an enlarged sectional view taken along the line F—F in FIG. 10;

FIG. 14 is a simplified side view illustrating a jacket and printing sheet pulling in device showing a manual printing sheet jacket loading (insertion) state;

FIG. 15 is a simplified side view illustrating a jacket and printing sheet pulling in device showing an automatic printing sheet jacket pulling in operation performed by drive rollers;

FIG. 16 is a simplified side view illustrating a jacket and printing sheet pulling in device showing an automatic printing sheet pulling out operation performed by sprockets;

FIG. 17 is a plan view of a jacket and printing sheet pulling in device;

FIG. 18 is a simplified side view illustrating a jacket holding device showing a printing sheet jacket in an unheld state;

FIG. 19 is a simplified side view illustrating a jacket holding device showing a printing sheet jacket in a held state;

FIG. 20 is a plan view of a jacket holding device;

FIG. 21 is a simplified side view illustrating a jacket central flap opening device before the start of printing sheet jacket flap opening;

FIG. 22 is a simplified side view illustrating a jacket central flap opening device showing the start of a printing sheet jacket flap opening operation;

FIG. 23 is a simplified side view illustrating a jacket central flap opening device showing a state midway through a printing sheet jacket flap opening operation;

FIG. 24 is a simplified side view illustrating a jacket central flap opening device showing the end of a printing sheet jacket flap opening operation;

FIG. 25 is a plan view of a jacket central flap opening device;

FIG. 26 is a simplified side view illustrating a jacket side flap opening device before the start of printing sheet jacket flap opening;

FIG. 27 is a simplified side view illustrating a jacket side flap opening device showing the start of a printing sheet jacket flap opening operation;

FIG. 28 is a simplified side view illustrating a jacket side flap opening device showing the end of a printing sheet jacket flap opening operation;

FIG. 29 is a plan view of a jacket side flap opening device;

FIG. 30 is a side view illustrating an apparatus for winding a printing sheet onto a cylinder of a printing sheet making machine of a preferred embodiment of the invention showing the start of printing sheet winding onto the cylinder;

FIG. 31 is a side view of the same cylinder showing the state at the end of printing sheet winding onto the cylinder;

FIG. 32 is a side view of the same cylinder showing the trailing end of a printing sheet clamped to the cylinder;

FIG. 33 is a side view of the same cylinder illustrating the removal of a printing sheet from the cylinder;

FIG. 34(A) is a development plan view illustrating the state in which a printing sheet is wound onto a cylinder and FIG. 34(B) is a side view of FIG. 34(A);

FIG. 35(A) is a plan view illustrating tension in a printing sheet wound on a cylinder, and FIG. 35(B) is a sectional frontal view taken along the line A—A in FIG. 35(A);

FIG. 36(A) is an enlarged sectional frontal view illustrating the press fitting of a sprocket hole of a printing sheet over a sprocket pin of a cylinder, and FIG. 36(B) is an enlarged sectional side view illustrating the entering and withdrawal of a sprocket pin with respect to a sprocket hole;

FIG. 37 is an enlarged sectional side view illustrating an engaging action of a first sprocket pin of a cylinder with a first sprocket hole of a printing sheet;

FIG. 38 is an enlarged sectional side view illustrating a press fitting action of a first sprocket hole of a printing sheet with a first sprocket pin of a cylinder;

FIG. 39 is an enlarged sectional side view illustrating an operation in which a printing sheet is removed from a cylinder;

FIG. 40 is a plan view of FIG. 30;

FIG. 41 is a plan view of FIG. 39;

FIG. 42(A) is a sectional view taken along the line B—B in FIG. 41, and FIG. 42(B) is a sectional view taken along the line C—C in FIG. 41;

FIG. 43 is an exploded perspective view showing a printing sheet pressing plate and a drive device thereof;

FIG. 44 is a side view of a printing sheet pressing plate drive device;

FIG. 45 is a sectional frontal view taken along the line D—D in FIG. 44;

FIG. 46 is a perspective view of a printing sheet press fitting roller and a drive device thereof;

FIG. 47 is a side view of a printing sheet press fitting roller drive device;

FIG. 48 is a sectional side view taken along the line E—E in FIG. 47;

FIG. 49 is an overall frontal view showing a cylinder and a printing sheet clamper;

FIG. 50 is an overall perspective view of a cylinder and a printing sheet clamper;

FIG. 51 is a simplified perspective view showing a printing sheet clamper;

FIG. 52 is an exploded perspective view showing a printing sheet clamper support mechanism;

FIG. 53 is a side view showing the unclamped state of a printing sheet clamper support mechanism;

FIG. 54 is a sectional frontal view taken along the F—F line in FIG. 53;

FIG. 55 is a side view showing the clamped state of a printing sheet clamper support mechanism;

FIG. 56 is a sectional frontal view taken along the line G—G in FIG. 50;

FIG. 57 is an enlarged side view taken along the line H—H in FIG. 54;

FIG. 58 is an enlarged side view taken along the line I—I in FIG. 56;

FIG. 59 is an enlarged sectional side view taken along the line J—J in FIG. 54;

FIG. 60 is an enlarged sectional side view taken along the line K—K in FIG. 56;

FIG. 61 is an enlarged sectional side view taken along the line L—L in FIG. 54;

FIG. 62 is an enlarged sectional side view taken along the line M—M in FIG. 56;

FIG. 63 is a side view showing a lock pin drive device;

FIG. 64 is a sectional frontal view taken along the line N—N in FIG. 63;

FIG. 65 is an underside view taken along the line O—O in FIG. 63;

FIG. 66 is an enlarged side view taken along the line P—P in FIG. 64;

FIG. 67 is a perspective view showing the whole of a printing sheet winding device and a laser block transport device at the start of printing sheet winding; and FIG. 68 is a perspective view showing the whole of a printing sheet winding device and a laser block transport device on completion of printing sheet winding.

DETAILED DESCRIPTION OF THE PREFERRED EMBODIMENTS

A preferred embodiment of the invention applied to an electronic gravure printing system will now be described with reference to the accompanying drawings.

First, with reference to FIGS. 1 to 7, a printing sheet will be described.

A printing sheet 1 is a substantially rectangular sheet of about 200 microns in thickness made of a thermoplastic resin such as polyethylene resin. Image data 2 is formed with high precision in the form of relief of the order of submicrons in a substantially rectangular region, shown with diagonal hatching in FIG. 1, of the surface 1*a* of the printing sheet 1. A row of sprocket holes 3 is formed along each side, the left side and the right side, of the printing sheet 1; the two rows are parallel and the sprocket holes 3 are spaced at a fixed pitch.

Next, with reference to FIGS. 1 to 7, a printing sheet jacket will be described.

A printing sheet jacket 6 is substantially rectangular and has the form of a flat bag with three sides 6*a*, 6*b* and 6*c* closed in a substantial C-shape and a printing sheet removal/insertion opening 7 provided at the fourth side 6*d*.

This printing sheet jacket 6 can be simply manufactured by horizontally superposing a substantially rectangular base sheet 8 and cover sheet 9 of thickness approximately 200 microns made of a thermoplastic resin such as polyethylene resin or the like or PET resin sheet having its surface coated with about 5 to 40 μm of a readily thermally decomposing material (for example a nitrocellulose compound) and thermally sealing three of the sides 6*a*, 6*b* and 6*c* in a substantial C-shape of a predetermined width (thermally fusing together the base sheet 8 and the cover sheet 9 by heating them while pressing them together).

The left and right side edges of the printing sheet jacket 6 are formed as a left/right parallel pair of belt-shaped roller press portions 10 of a predetermined width.

As shown in FIG. 6(A), the cover sheet 9 of the printing sheet jacket 6 has a horizontal ceiling portion 9*b* formed integrally atop a substantially C-shaped vertical portion 9*a* which projects vertically upward along the inside of the three edges 6*a*, 6*b* and 6*c* thermally sealed in a substantial C-shape, and a flat printing sheet accommodating space 11 of a height $H_1$ greater than the thickness $T_1$ of the printing sheet 1 is formed between the ceiling portion 9*b* of the cover sheet 9 and the base sheet 8.

The printing sheet 1 is accommodated in the printing sheet accommodating space 11 with its front surface 1*a* facing upward and can be removed from and reinserted into the printing sheet accommodating space 11 through the printing sheet removal/insertion opening 7 in the direction of the arrows (a), a'.

During removal and reinsertion of the printing sheet 1 from and into the printing sheet accommodating space 11, because the substantially C-shaped portion 9*a* of the cover sheet 9 makes it possible for the height $H_1$ of the printing sheet accommodating space 11 to be made greater than the thickness $T_1$ of the printing sheet 1, removal and reinsertion of the printing sheet 1 from and into the printing sheet accommodating space 11 in the direction of the arrows (a), a' can be carried out smoothly.

A cutaway 12 is formed from the central portion to the left and right side portions of the opening end 9*c*, which is the end portion of the cover sheet 9 at the printing sheet removal/insertion opening 7 end, and an opening/closing flap 13 is formed integrally with the cover sheet 9 in the central portion of the cutaway 12.

Figure 5A:
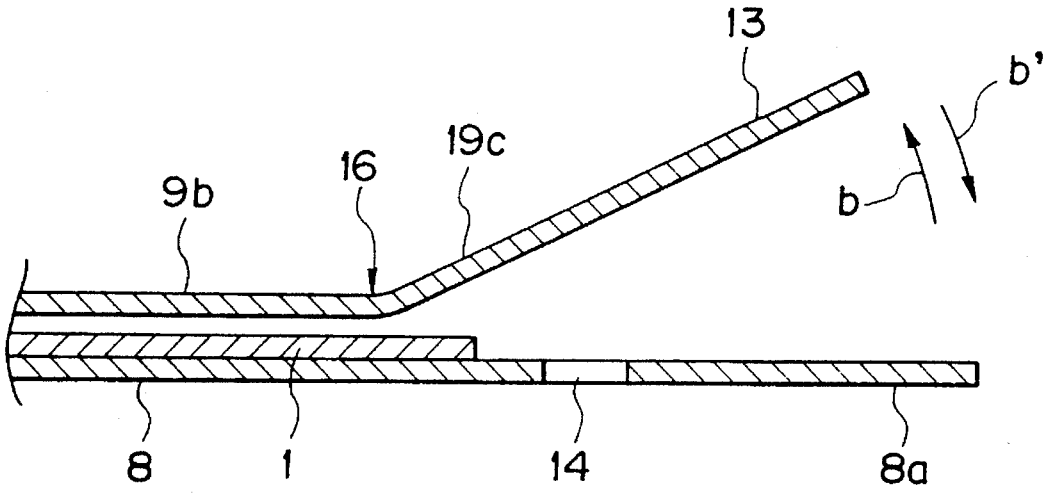
FIGS. 5(A) and 5(B) are enlarged sectional views taken along the line A—A in FIG. 3.
Figure 5B:
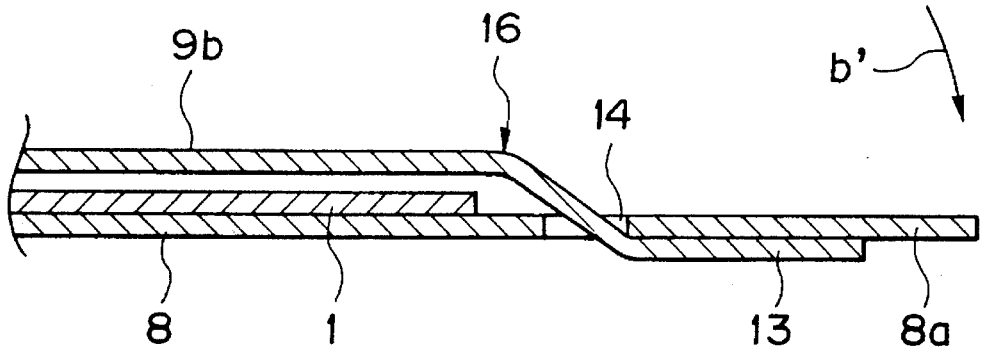

As shown in FIG. 4 and FIG. 5(B), this opening/closing flap 13 is passed through a slot-shaped opening/closing flap lock hole 14 formed in the central portion of the opening end 8*a* of the base sheet 8, and this blocks the printing sheet removal/insertion opening 7 of the printing sheet jacket 6 and locks in the printing sheet 1 (prevents the printing sheet 1 from coming out of the printing sheet jacket 6) sheathed inside the printing sheet jacket 6.

A left/right parallel pair of slits 15 cut out of the opening end 9*c* of the cover sheet 9 are formed in the cover sheet 9 at the left and right sides of the printing sheet removal/insertion opening 7, and the opening end 9*c* of the cover sheet 9 can open and close easily across its entire width in the direction of the arrows b, b' along a crease 16 connecting the deepest portions 15*a* of the left/right slits 15.

A left/right pair of taper portions 17 tapering off in the printing sheet insertion direction (the direction of the arrow a') for guiding printing sheet insertion are formed integrally at the left and right sides of the printing sheet removal/insertion opening 7 from the deepest portions 15*a* of the left/right slits 15 to the left/right sides of the vertical portion 9*a*.

Consequently, when the printing sheet 1 is inserted into the printing sheet accommodating space 11 through the printing sheet removal/insertion opening 7 of the printing sheet jacket 6 in the direction of the arrow a', because the left and right side portions of the printing sheet 1 are guided by the left/right pair of taper portions 17, the operation of inserting the printing sheet 1 into the printing sheet accommodating space 11 in the direction of the arrow a' can be carried out smoothly.

A left/right pair of jacket holding holes 18 passing vertically through the base sheet 8 and the cover sheet 9 are formed in the left/right pair of roller press portions 10 in locations in the vicinity of the printing sheet removal/insertion opening 7 of the printing sheet jacket 6.

Left/right pairs of slot-shaped sprocket access holes 19, 20 passing vertically through the ceiling portion 9*b* of the cover sheet 9 and the base sheet 8 respectively are formed in positions in the vicinity of the printing sheet removal/insertion opening 7 of the printing sheet jacket 6 directly above and below sprocket holes 3 in the left and right sides of the printing sheet 1 sheathed in the printing sheet jacket 6.

Misloading (mis-insertion) detection holes 21, 22 constituting objects of detection of misloading detecting means for detecting misloading (mis-insertion) of the printing sheet jacket 6 into a printing sheet making machine and a printing machine to be discussed hereinafter are formed in the vicinity of the printing sheet removal/insertion opening 7 of the printing sheet jacket 6 in left/right positions asymmetrical with respect to the left-right direction center of the printing sheet jacket 6. The misloading detection hole 21 is formed to one side of the opening/closing flap 13 and the misloading detection hole 22 is disposed above the centerline of one of the rows of sprocket holes 3 in the printing sheet 1.

A bar code label 23 for identifying the type of the printing sheet 1 sheathed inside the printing sheet jacket 6 (identifying its type in terms of whether or not it is a new printing sheet and what image data 2 is engraved on it in what colors, etc) is affixed to the upper side of the cover sheet 9 of the printing sheet jacket 6. As necessary, an observation hole 24 for identifying the above-mentioned type of the printing sheet 1 visually is provided in the cover sheet 9 of the printing sheet jacket 6.

Next, with reference to FIGS. 8 and 9, a printing sheet making and printing system will be described.

In this printing sheet making and printing system, first, in a printing sheet making machine 27, image data 2 such as a photograph or the like is engraved in the form of relief in the front surfaces 1*a* of 1 to 4 printing sheets 1.

These engraved 1 to 4 printing sheets 1 are then fed into a printing machine 37, overprinting 1 to 4 times onto cut paper 47 is carried out using the color by color image data 2 on the surfaces 1*a* of the 1 to 4 printing sheets 1, and printing of a photograph or the like is thereby performed.

In this printing sheet making and printing system, by the printing sheet 1 being sheathed in a printing sheet jacket 6 while being handled before engraving, after engraving, and before and after printing, from first to last, the adhesion of dust and the like and the occurrence of scratching on the surface 1*a* of the printing sheet 1 is prevented.

As shown in FIG. 8, the printing sheet making machine 27 is fitted with a jacket loading table 28 and a printing sheet feed and eject device 29 disposed thereon. Inside the printing sheet making machine 27 there are disposed a printing cylinder 30 and a laser block 34 which shines a laser beam CB emitted by a semiconductor laser 31 through a collimator lens 32 and an objective lens 33 onto the surface 1*a* of a printing sheet wound on the periphery of the cylinder 30. The laser block 34 is reciprocated in the axial direction of the cylinder 30 [perpendicular to the plane of the drawing of FIG. 8(B)].

As shown in FIG. 9, the printing machine 37 is provided with 1 to 4 jacket loading tables 38 and 1 to 4 printing sheet feed and eject devices 39 for loading, feeding and ejecting 1 to 4 printing sheet jackets 6, and inside the printing machine 37 there are disposed the same number of printing cylinders 40, pressure rollers 41 and ink units 45 comprising ink pans 42, ink rollers 43, and doctor blades 44, etc. Four colors of water-type ink 46 such as cyan, magenta, yellow and black are supplied color by color to the 4 ink pans 42. The printing machine 37 is provided with a cut paper tray 48 on which is stacked cut paper 47, the matter to be printed, and inside the printing machine 37 is mounted a cut paper circulating apparatus (not shown in the drawings) for circulating the cut paper 47 to the 1 to 4 pressure rollers 41 one after another. FIG. 9(A) shows a printing machine provided with two jacket loading tables 38, two printing sheet feed and eject devices 39, two cylinders 40, two pressure rollers 41 and two ink units 45.

As shown in FIG. 8(A), a printing sheet jacket 6 in which an unengraved printing sheet 1 is sheathed is loaded horizontally in the direction of the arrow (a) onto the jacket loading table 28 of the printing sheet making machine 27. When this is done, the printing sheet feed and eject device 29 automatically pulls the printing sheet 1 out from inside the printing sheet jacket 6 in the direction of the arrow (a) and winds the printing sheet 1 onto the periphery of the cylinder 30 inside the printing sheet making machine 27, as shown in FIG. 8(B).

In the printing sheet making machine, as shown in FIG. 8(B), so-called direct engraving, wherein the printing sheet 1 is rapidly rotated in the direction of the arrow c by the cylinder 30 while the semiconductor laser 31 shines a laser beam LB onto the surface 1*a* of the printing sheet 1 while the laser block 34 is reciprocated in the axial direction of the cylinder 30 and color by color image data 2 of a photograph or the like is thereby engraved directly with high precision in the form of relief of the order of submicrons in the surface 1*a* of the printing sheet 1, is carried out on 1 to 4 printing sheets 1 one after another.

For this, digital information representing an image such as a photograph is taken from a multimedia source such as a photograph scanner or a digital VTR and electronically edited in an image processing computer or the like, and digital information for each of four colors such as cyan, magenta, yellow and black is obtained. The 1 to 4 printing sheets 1 are then put through the printing sheet making machine one after another and based on this color by color four-color digital information color by color image data 2 for each of the four colors is then separately engraved on the 1 to 4 printing sheets 1.

Each engraved printing sheet 1 is automatically removed from the periphery of the cylinder 30 in the direction of the arrow a' and reinserted into its printing sheet jacket 6 by the printing sheet feed and eject device 29, whereby the engraving step is finished. The printing sheet jacket 6 is then removed from the jacket loading table 28 in the direction of the arrow a' and loaded into the printing machine 37.

As shown in FIG. 9(A), the 1 to 4 printing sheet jackets 6 containing the engraved printing sheets 1 of the different colors engraved color by color in the engraving step are severally loaded horizontally in the direction of the arrow (a) onto the 1 to 4 jacket loading tables 38 of the printing machine 37. When this is done, the printing sheet feed and eject devices 39 automatically pull the printing sheets 1 out of their printing sheet jackets 6 in the direction of the arrow (a) and automatically wind them onto the peripheries of the 1 to 4 cylinders 40 inside the printing machine 37, as shown in FIG. 9(B).

Cut paper 47 from the cut paper tray 48 shown in FIG. 9(A) is circulated around the 1 to 4 pressure rollers 41 and printing of the kind illustrated in FIG. 9(B) is carried out.

That is, while the cylinders 40 are rotated at high speed in the direction d, the ink rollers 43 in contact with the surfaces of the printing sheets 1 are rotated at high speed in synchrony with the cylinders 40, water-type inks 46 of the different colors from the ink pans 42 are coated onto the relief that is the image data 2 of the respective colors on the printing sheets 1, and unnecessary ink 46 is scraped off by the doctor blades 44. The pressure rollers 41, which rotate at high speed in the direction of the arrow f in synchrony with the cylinders 40, feed the cut paper 47 past the cylinders 40 at high speed while pressing it against the surfaces 1*a* of the printing sheets 1, and the color by color image data 2 of a photograph or the like on the printing sheets 1 prints a sequentially colored image 4 on the cut paper 47 at high speed.

By this sequential overprinting of the color by color image data 2 of a photograph or the like of the printing sheets 1 by the cut paper 47 being sequentially circulated around the 1 to 4 pressure rollers 41 it is possible to print a sheet of color-printed matter on which the four colors cyan, magenta, yellow and black are compounded. However, one-color printing, two-color printing, three-color printing and five or more color printing are also possible and are achieved by adjusting the number of engraving steps and printing steps according to the number of colors to be printed.

The above-mentioned jacket loading tables 28 and 38, the printing sheet feed and eject devices 29 and 39, and the cylinders 30 and 40 of the printing sheet making machine 27 and the printing machine 37 are of identical construction. The jacket loading table 28, the printing sheet feed and eject device 29 and the cylinder 30 of the printing sheet making machine 27 will now be described with reference to FIGS. 10 to 29.

First of all, with reference to FIGS. 10 to 13, the main features of the printing sheet feed and eject device will be described.

A table cover 51 is horizontally mounted on a horizontal jacket loading table 28 and a printing sheet jacket 6 is horizontally loaded into a horizontal jacket loading space 52 formed between these two onto the jacket loading table 28 in the direction of the arrow (a) with its printing sheet removal/insertion opening 7 end at the front. Left/right side guides 53 for horizontally guiding the left and right sides of the printing sheet jacket 6 are formed integrally with the table cover 51 at the left and right sides thereof.

The printing sheet feed and eject device 29 is mounted above the table cover 51 of the jacket loading table 28; this printing sheet feed and eject device 29 comprises left/right symmetrical pairs of jacket and printing sheet pulling in devices 55 and jacket holding devices 56, and is also provided with jacket central and side flap opening devices 57*a* and 57*b*.

A drive shaft 58, a camshaft 59 and a sprocket shaft 60 are disposed horizontally crossing over the table cover 51 in the left-right direction and are mounted on a left/right pair of brackets 61. A motor 62 and a gear train 63 for reversibly rotationally driving the drive shaft 58 and a motor 64 and a gear train 65 for reversibly rotationally driving the camshaft 59 are mounted above the table cover 51. Three left/right pairs of cam mechanisms 66, 67 and 68, six cam mechanisms in total, are mounted at the left and right ends of the camshaft 59, and a cam mechanism 69 is mounted at the central portion of the camshaft 59.

The left/right pairs of jacket and printing sheet pulling in devices 55 and jacket holding devices 56 and the jacket central and side flap opening devices 57*a* and 57*b* are driven by the motors 62 and 64, the gear trains 63 and 65, the drive shaft 58, the camshaft 59 and the cam mechanisms 66, 67, 68 and 69 in the manner described hereinafter.

A number of sensors $S_1$ to $S_8$ constituting a controller for controlling the jacket and printing sheet pulling in devices 55, the jacket holding devices 56 and the jacket central and side flap opening devices 57*a* and 57*b* so that they operate sequentially based on predetermined sequences are provided. As shown in FIG. 12, the sensors $S_1$ to $S_6$ each consist of a light emitting device LD and a light receiving device PD disposed so as to perform light detection vertically through the jacket loading table 28 and the table cover 51. The sensors $S_7$ and $S_8$ comprise photocouplers which perform detection on a pair of slit discs 70 mounted on the left and right ends of the camshaft 59. A left/right pair of jacket stoppers 71 are mounted on the left and right sides of the arrow (a) direction end of the jacket loading table 28.

Next, with reference to FIGS. 14 to 17, the jacket and printing sheet pulling in devices will be described.

The left/right jacket and printing sheet pulling in devices 55 are constructed left/right symmetrically and are provided with a left/right pair of seesaw-style pivoting arms 76 each made up of first and second arms 73 and 74 mounted pivotally in the direction of the arrows h, h' on the left and right end portions of the drive shaft 58, which doubles as a supporting shaft for them, and limiter springs 75 consisting of tension springs or the like which pull the first and second arms 73 and 74 toward each other.

A left/right pair of drive rollers 77, which are jacket pulling in means, are rotatably mounted via a left/right pair of horizontal roller shafts 78 on the left/right pair of second arms 74 on the arrow a' direction side of the drive shaft 58. The left/right pair of drive rollers 77 comprise high friction rollers such as rubber rollers and a left/right pair of torque limiters 77*a* are incorporated therein.

A left/right pair of pinch rollers 79 are rotatably mounted via a horizontal roller shaft 80 on the underside of the jacket loading table 28 directly below and facing the pair of drive rollers 77. A left/right pair of long holes 81 are formed in the table cover 51 and in the jacket loading table 28 to allow the left/right pairs of drive rollers 77 and pinch rollers 79 to project therethrough.

The left and right ends of the sprocket shaft 60 are rotatably attached to the left/right pair of first arms 73 on the direction (a) side of the drive shaft 58. A left/right pair of sprockets 82, which are printing sheet pulling in means, are mounted on the left and right ends of the sprocket shaft 60. A left/right pair of long holes 83 are formed in the table cover 81 and the jacket loading table 28 to allow the left/right pair of sprockets 82 to project therethrough.

Left/right pairs of driven gears 85 and 86 respectively mounted on the left/right pair of roller shafts 78 and the left and right end portions of the sprocket shaft 60 mesh with the front and rear sides of drive gears 84 mounted on the left/right end portions of the drive shaft 58, and these gears 84, 85 and 86 constitute a drive mechanism. Torque limiters 82*a* are provided between the left/right pair of driven gears 86 and the left/right end portions of the sprocket shaft 60.

A left/right pair of cam mechanisms 66, which are control mechanisms, mounted on the left/right end portions of the camshaft 59, each comprise a cam 66*a* mounted on the camshaft 59, a driven roller 66*b*, which is a cam follower, rotatably mounted on the first arm 73, and a cam spring 66*c*, consisting of a tension spring or the like, which rotationally urges the first arm 73 in the direction of the arrow h and presses the driven roller 66*b* onto the upper portion of the periphery of the cam 66*a*.

The first and second arms 73 and 74 are urged toward each other in the direction of the arrows h, h' by the limiter spring 75 and have their positions with respect to each other restricted by a stopper 87 disposed between them. The first arm 73, rotationally urged by the cam spring 66*c* in the direction of the arrow h about the camshaft 58, has its position restricted by being caused by a rubber cushion 88 to abut with the top of a stopper 89 mounted on the table cover 51.

When the drive shaft 58 is forward/reverse rotationally driven by the motor 62, shown in FIG. 10, via the gear train 63, the left/right pairs of rollers 77 and sprockets 82 of the left/right pair of jacket and printing sheet pulling in devices 55 are forward/reverse rotationally driven simultaneously.

That is, as shown in FIGS. 14 to 17, the rotational drive of the drive shaft 58 is transmitted to the roller shaft 78 and the sprockets 82 via the drive mechanism made up of the drive gears 84 and the driven gears 85 and 86, and the left right pairs of drive rollers 77 and sprockets 82 are thereby forward/reverse rotationally driven simultaneously.

When the camshaft 59 is forward/reverse rotationally driven by the motor 64, shown in FIG. 10, via the gear train 67, the left/right pairs of drive rollers 77 and sprockets 82 of the left/right pair of jacket and printing sheet pulling in devices 55 are reversibly raised in the direction of the arrows h, h' by the left/right pair of cam mechanisms 66.

That is, as shown in FIGS. 14 and 16, when the left/right pair of cams 66*a* of the cam mechanisms 66 are at the cam angle 0°, the pivoting arms 76 are rotationally urged about the drive shaft 58 in the arrow h direction by the cam springs 66*c*, and while the left/right pair of drive rollers 77 are raised in the arrow h direction to above the table cover 51, the left/right pair of sprockets 82 are lowered in the arrow h direction to below the table cover 51.

Next, as shown in FIG. 15, when the cams 66*a* of the cam mechanisms 66 are at a the cam angle 180°, these cams 66*a* push the cam driven rollers 66*b* upward, the pivoting arms 76 are pivoted about the drive shaft 58 against the resistance of the cam springs 66*c*, and while the left/right pair of drive rollers 77 are lowered in the arrow h' direction to below the table cover 51 the left/right pair of sprockets 82 are raised in the arrow h' direction to above the table cover 51.

The cam angle 0° and 180° positions of the cam 66*a* are detected by the sensor $S_7$.

As shown in FIG. 15, when the left/right pair of drive rollers 77 are lowered in the arrow h' direction, as will be further discussed hereinafter, these left/right drive rollers press elastically on the left/right pair of pinch rollers 79, against the resistance of the limiter springs 75, through the left/right pair of roller press portions 10 of the printing sheet jacket 6 loaded onto the jacket loading table 28. In this state, the rotational force of the left/right pair of drive rollers 77 is transmitted to the printing sheet jacket 6, and any forward/reverse rotation of the left/right pair of drive rollers 77 causes the printing sheet jacket 6 to move on the jacket loading table 28 in the direction of the arrows (a), a'.

As shown in FIG. 16, when the left/right pair of sprockets 82 are lowered in the arrow h direction, as will be further discussed hereinafter, these left/right sprockets 82 enter the left/right pair of sprocket access holes 19, 20 in the printing sheet jacket 6 loaded onto the jacket loading table 28, and these left/right sprockets 82 engage with the sprocket holes 3 in the left and right sides of the printing sheet 1. In this state, the rotational force of the left/right pair of sprockets 82 is transmitted to the printing sheet 1 and any forward/reverse rotation of the left/right pair of sprockets 82 causes the printing sheet 1 to move in the printing sheet jacket 6 in the direction of the arrows (a), a'.

With these jacket and printing sheet pulling in devices 55, because the drive rollers 77 and the sprockets 82 are reversibly raised and lowered by the cam mechanisms 66 driving the seesaw-style pivoting arms 76 to pivot one way (the arrow h direction) or the other (the arrow h' direction), it is possible to raise and lower the two types of actuator that are the drive rollers 77 and the sprockets 82 with the one motor 64. Also, because the drive rollers 77 and the sprockets 82 are simultaneously forward/reverse rotationally driven by the single drive shaft 58 via the drive mechanism made up of the drive gears 84 and the driven gears 85 and 86, the two types of actuator that are the drive rollers 77 and the sprockets 82 can be simultaneously forward/reverse rotationally driven by the single motor 62.

Consequently, the construction of these jacket and printing sheet pulling in devices 55 is simple, spacesaving and low cost.

Next, with reference to FIGS. 18 to 20, the jacket holding devices will be described.

A left/right pair of jacket holding devices 56 are of left/right symmetrical construction and comprise a left/right pair of vertical slider mounting plates 92 mounted on the table cover 51 and a left/right pair of sliders 95 mounted on side surfaces of these slider mounting plates 92 by way of a plurality of guide holes 93 and guide pins 94 in such a way that they can move vertically in the direction of the arrows i, i'.

A left/right pair of holding pins 96, which are jacket holding means, are fixed to the undersides of the left/right pair of sliders 95 and project perpendicularly downward therefrom.

A left/right pair of cam mechanisms 67, which are drive mechanisms for raising and lowering the left/right pair of holding pins 96 in the direction of the arrows i, i', are each made up of a cam 67*a* mounted on the camshaft 59, a cam driven roller 67*b*, which is a cam follower, rotatably mounted on the slider 95, and a cam spring 67*c*, consisting of a tension spring or the like, which urges the slider 95 upward in the arrow i direction and presses the cam driven roller 67*b* against the underside of the periphery of the cam 67*a*. A taper 96*a* is formed on the lower end of each of the left/right pair of holding pins 96. Holes 97 are formed in the table cover 51 and the jacket loading table 28 to allow the left/right pair of holding pins 96 to pass therethrough.

When the camshaft 59 is forward/reverse rotationally driven one way by the motor 64, shown in FIG. 10, via the gear train 67, the left/right cam mechanisms 67 cause the left/right pairs 96 of the left/right jacket holding devices 56 to ascend or descend in the direction of the arrows i, i'.

That is, when the cams 67*a* of the cam mechanisms 67 are at the cam angle 180°, as shown in FIG. 18, the left/right pair of sliders 95 have been simultaneously lifted up by the cam springs 67*c* and the left/right pair of holding pins 96 have been simultaneously raised in the arrow i direction to above the table cover 51.

Next, when the cams 67*a* of the cam mechanisms 67 are at the cam angle 0°, as shown in FIG. 19, the cam driven rollers 67b have been pushed down by these cams 67a against the resistance of the cam springs 67c and the left/right pair of sliders 95 have been simultaneously lowered in the arrow i' direction. When the left/right pair of holding pins 96 are simultaneously lowered in the arrow i' direction to below the table cover 51, as will be further described hereinafter, these left/right holding pins 96 enter vertically from above into the left/right pair of jacket holding holes 18 in the printing sheet jacket 6 loaded onto the jacket loading table 28 and hold the printing sheet jacket 6 in a fixed position on the jacket loading table 28.

At this time, because the tapers 96a are provided on the lower ends of the left/right pair of holding pins 96, even if the printing sheet jacket 6 is slightly out of the above-mentioned fixed position, the guiding action of the tapers 96a serves to automatically bring the printing sheet jacket 6 into the fixed position as the holding pins 96 descend.

Next, with reference to FIGS. 21 to 25, the jacket central flap opening device 57a will be described.

This jacket central flap opening device 57a is a device for opening the flap of the central part of the opening end 9c of the cover sheet 9 of the printing sheet jacket 6.

This jacket central flap opening device 57a has a vertical flap opening arm mounting plate 100 mounted on the central portion of the table cover 51, a flap opening arm 102 and a cam driven arm 103 mounted pivotally in the direction of the arrows j, j' on a side surface of the flap opening arm mounting plate 100 via a horizontal supporting shaft 101, and a central flap opening suction pad 104, which is central flap opening means, and a central pushing pin 105, which is central pushing means, mounted on the underside of the end portion of the flap opening arm 102 and projecting perpendicularly therefrom.

The central cam mechanism 69, which is a control mechanism, mounted at the center of the camshaft 59, is made up of a cam 69a mounted on the camshaft 59, a cam driven roller 69b, which is a cam follower, rotatably mounted on the cam driven arm 103, and a cam spring 69c, consisting of a tension spring or the like, which at all times pushes the cam driven roller 69b against the periphery of the cam 69a.

The flap opening arm 102 is mounted on the support shaft 101 in such a way that it can pivot in the direction of the arrows j, j', and the cam driven arm 103 is mounted on this flap opening arm 102 via a plurality of adjustment screws 106 in such a way that its length in the direction of the arrows k, k' is adjustable. By adjusting the length in the direction of the arrows k, k' of the cam driven arm 103 with respect to the flap opening arm 102, it is possible to adjust the opening stroke in the directions of the arrows j, j' through which the central flap opening suction pad 104 is moved by the cam mechanism 69.

Two holding suction pads 107 and 108, which are central holding means, are vertically mounted under the jacket loading table 28 in positions directly below the central flap opening suction pad 104 and the central pushing pin 105 respectively. The central flap opening suction pad 104 and the central holding suction pads 107 and 108 are constructed as vacuum suction-gripping means connected to a vacuum pump (not shown in the drawings).

When the camshaft 59 is forward/reverse driven in one direction by the motor 64, shown in FIG. 10, via the gear train 67, the jacket central flap opening device 57a is driven by the central cam mechanism 69.

That is, when the camshaft 59 rotates the cam 69a of the central cam mechanism 69 in the direction of the arrow from the cam angle 180° shown in FIG. 21 toward the cam angle 0° shown in FIG. 24, the flap opening arm 102 is caused to pivot up and down in the direction of the arrows b, b' by the cam driven roller 69b which is at all times pushed against the periphery of the cam 69c by the cam spring 69c and rolls along the periphery of the cam 69a.

When this happens, when the cam 69a is at the cam angle 180°, as shown in FIG. 21, as will be further described hereinafter the central flap opening suction pad 104 and the central pushing pin 105 are being held up in the arrow b direction and are clear of the printing sheet jacket 6.

Next, when the cam 69b has been rotated to the position in which it is shown in FIG. 22, as will be further described hereinafter, the central flap opening suction pad 104 is pushed by the flap opening arm 102 from the arrow b' direction down onto the opening end 9c of the cover sheet 9 of the printing sheet jacket 6 loaded into the above-mentioned fixed position on the jacket loading table 28 and the opening end 8a of the base sheet 8 of the printing sheet jacket 6 is pushed by the central flap opening suction pad 104 and the central pushing pin 105 in the arrow b' direction down onto the pair of central holding suction pads 107 and 108.

At this time, the central flap opening suction pad 104 and the central holding suction pads 107 and 108 are caused by suction from the vacuum pump to suction-grip the central portions of the upper side of the cover sheet 9 and the underside of the base sheet 8 respectively.

Figure 1:
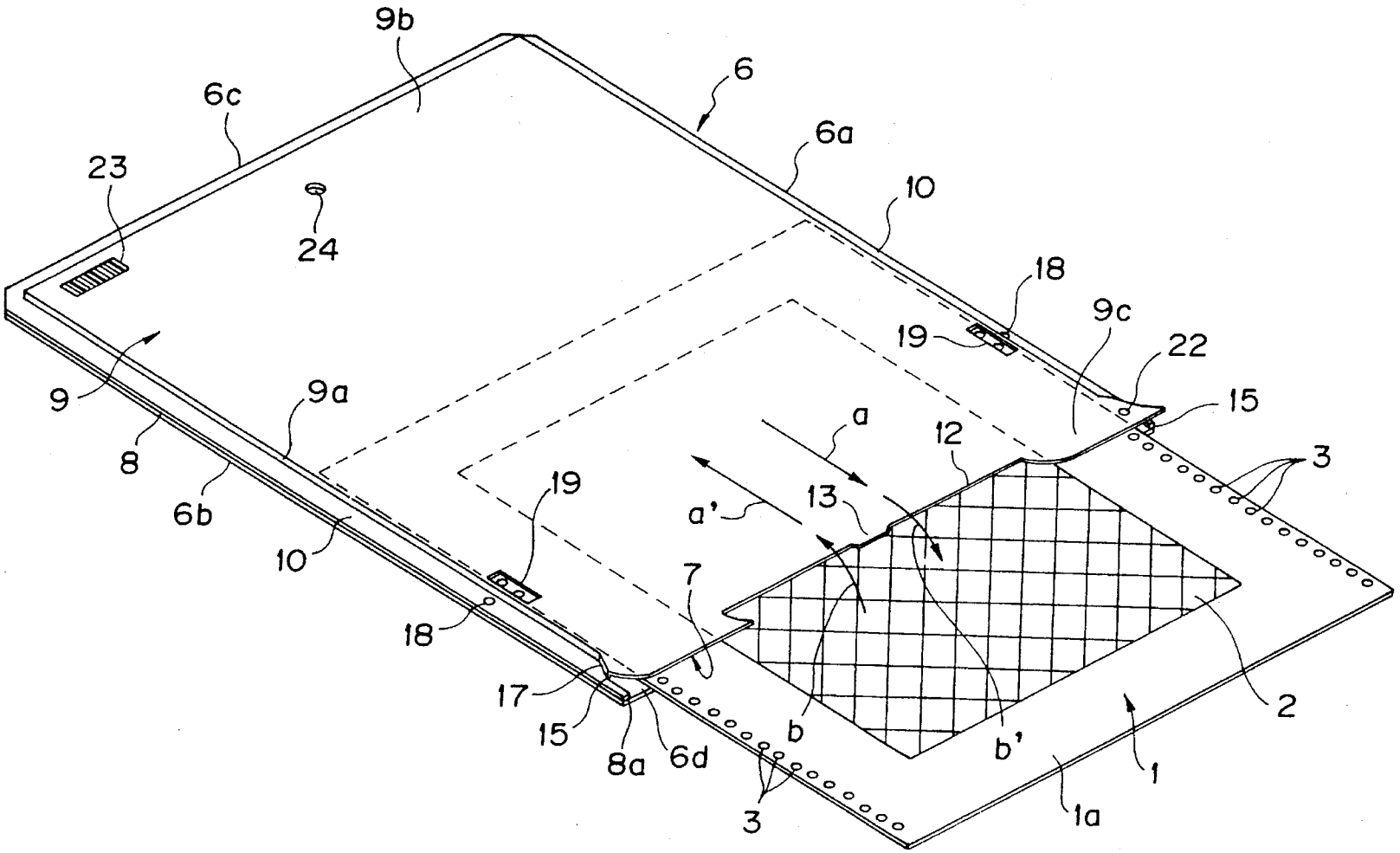
FIG. 1 is a perspective view showing a printing sheet and a printing sheet jacket for sheathing same used in an electronic gravure printing system of a preferred embodiment of the invention.
Figure 2:
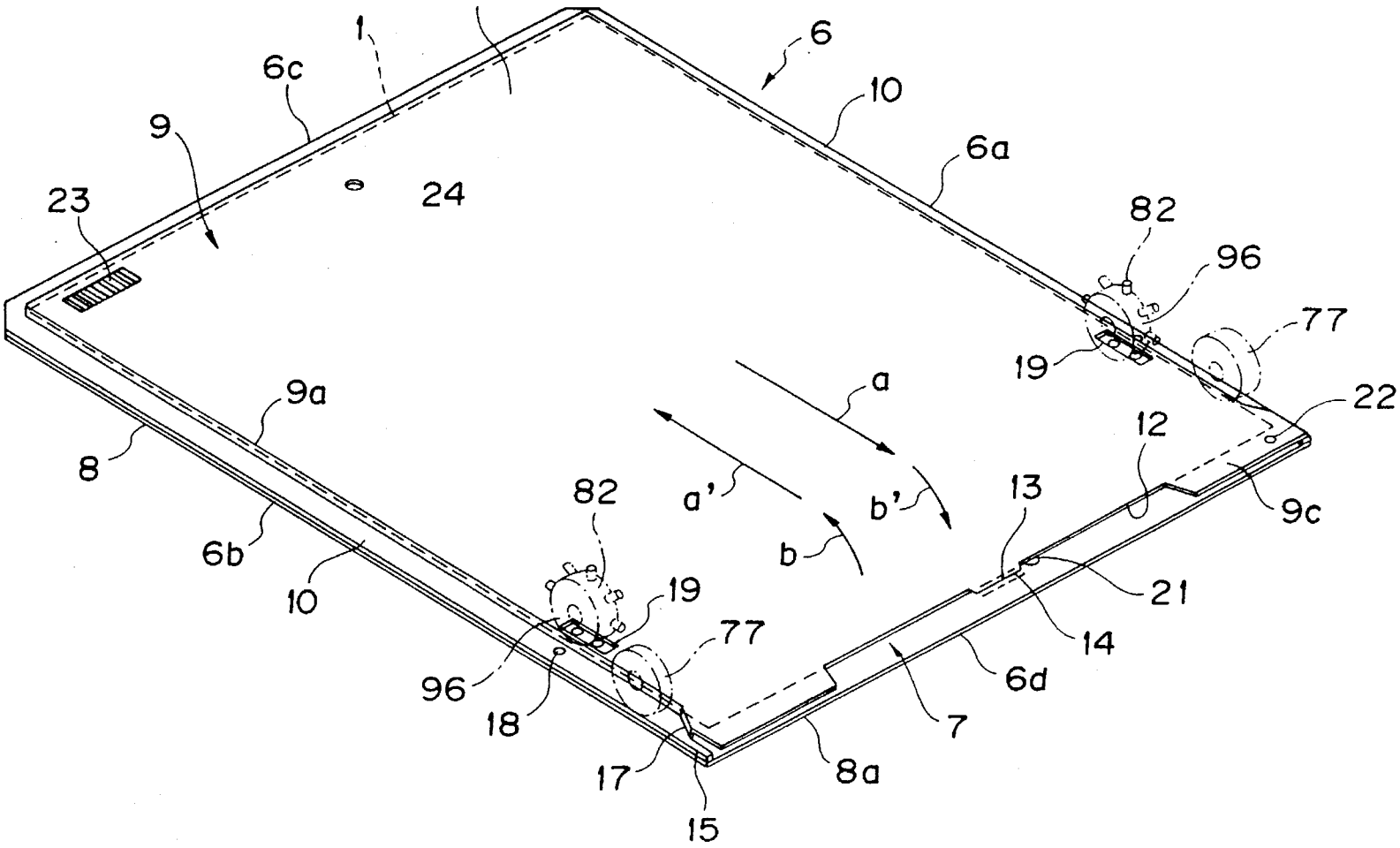
FIG. 2 is a perspective view showing a printing sheet jacket containing a printing sheet.
Figure 3:
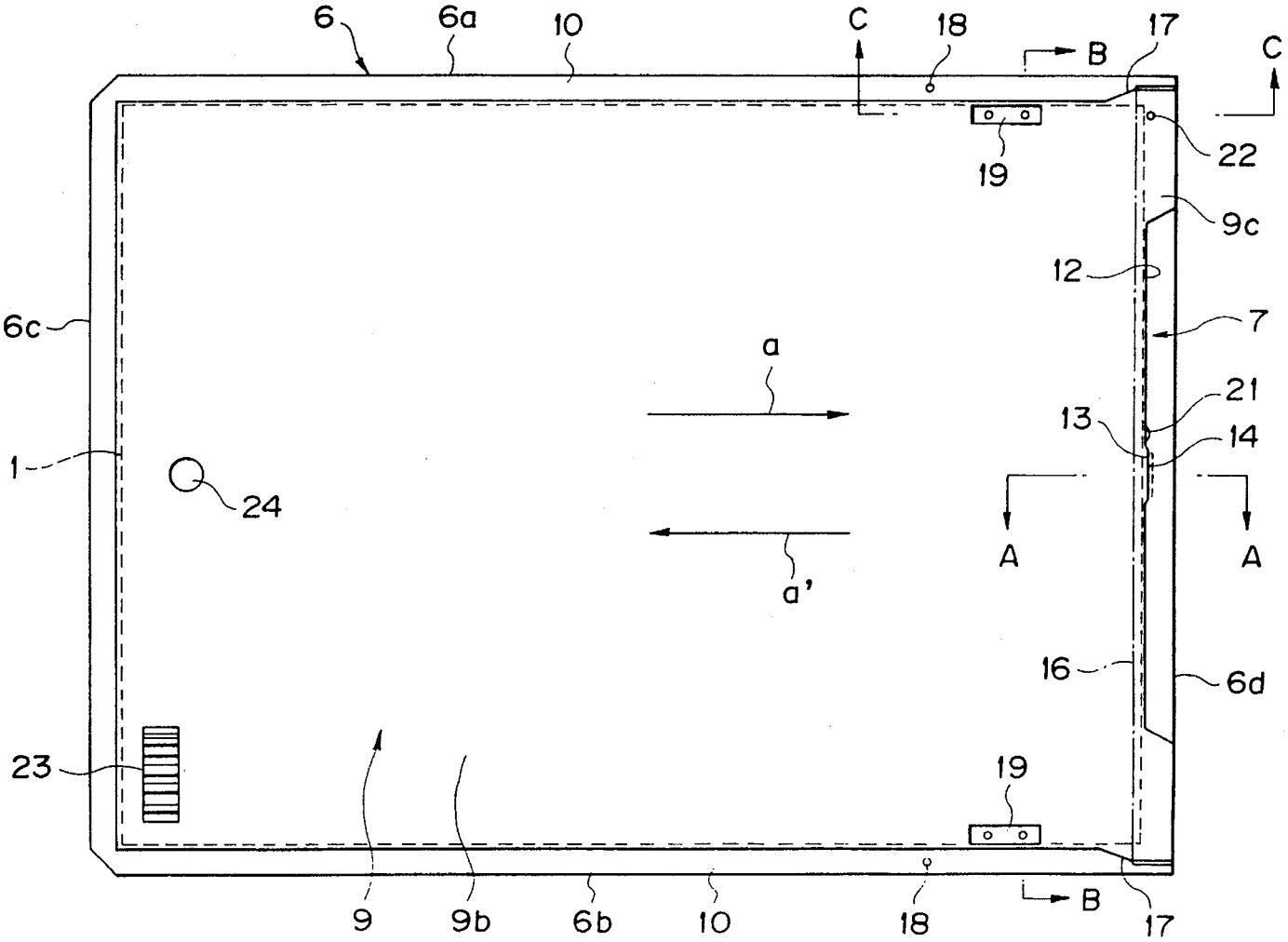
FIG. 3 is a plan view of a printing sheet jacket.

Then, as the cam 69a is rotated to the position in which it is shown in FIG. 23, the central flap opening suction pad 104 is lifted by the flap opening arm 102 through a large opening stroke $\theta_1$ in the arrow b direction and the opening end 9c of the cover sheet 9 suction-gripped by the central flap opening suction pad 104 is opened in the arrow b direction through the large opening stroke $\theta_1$. At this time, as shown in FIGS. 1, 2 and 7, because the left/right pair of slits 15 are formed at the left and right sides of the opening end 9c of the cover sheet 9, the opening end 9c of the cover sheet 9 can be easily opened in the arrow b direction through the large opening stroke $\theta_1$. The opening end 8a of the base sheet 8 is suction-gripped and kept held in its horizontal position by the central holding suction pads 107 and 108.

At this time, with the opening end 8a of the base sheet 8 firmly held by the strong suction force of the two central holding suction pads 107 and 108, because the opening end 9c of the cover sheet 9 is opened by the central flap opening suction pad 104 in the arrow b direction through the large stroke $\theta_1$, the opening/closing flap 13 is reliably and easily pulled in the arrow b direction out of the opening/closing flap lock hole 14. By the opening/closing flap 13 being pulled out of the opening/closing flap lock hole 14, the printing sheet removal/insertion opening 7 is opened.

Next, as the cam 69a is rotated to the cam angle 0° position shown in FIG. 24, as will be further discussed hereinafter, the flap opening arm 102 returns a little in the arrow b' direction and returns the opening end 9c of the cover sheet 9 suction-gripped by the central flap opening suction pad 104 in the arrow b' direction a little to a predetermined opening stroke $\theta_2$ wherein the cover sheet 9 is unstressed, and the printing sheet removal/insertion opening 7 is held open to a predetermined extent.

Next, with reference to FIGS. 26 to 29, the jacket side flap opening device will be described.

This jacket side flap opening device 57b is a device for opening the left and right side portions of the opening end 9c of the cover sheet 9 of the printing sheet jacket 6 and is of left/right symmetrical construction.

The jacket side flap opening device 57b comprises a left/right pair of vertical flap opening arm mounting plates 111, a left/right pair of circular arcuate holes 112 formed in the left/right pair of flap opening arm mounting plates 111, a left/right pair of flap opening arms 114 mounted via left/right pairs of rollers 113 on side surfaces of the left/right pair of flap opening arm mounting plates 111 in such a way that they can move circularly along the left/right pair of circular arcuate holes 112 in the direction of the arrows n, n', a left/right pair of drive arms 116 mounted on the opposite side surfaces of the left/right pair of flap opening arm mounting plates 111 from the left/right pair of flap opening arms 114 at their upper ends via a left/right pair of support shafts 115 in such a way that they can pivot in the direction of the arrows o, o', and a left/right pair of side flap opening suction pads 117, which are side flap opening means, mounted perpendicularly on the undersides of the ends of the left/right pair of flap opening arms 114.

Here, the left/right pair of circular arcuate holes 112 are formed in circular arcs of radius of curvature R with the crease line 16 of the opening end 9c of the cover sheet 9 as a virtual center. Therefore, the left/right pair of flap opening arms 114, engaged with these circular arcuate holes 112 via the pairs of rollers 113, move circularly along these circular arcuate holes 112 in the direction of the arrows n, n' with the crease line of the opening end 9c of the cover sheet 9 of the printing sheet jacket 6 as a virtual center.

A left/right pair of side cam mechanisms 68, which are control mechanisms, mounted at the left and right end portions of the camshaft 59, each comprise a cam 68a mounted on the camshaft 59, a cam driven roller 68b, which is a cam follower, rotatably mounted on the drive arm 116, and a cam spring 68c, consisting of a tension spring or the like, which at all times pushes the cam driven roller 68b against the periphery of the cam 68a. The lower ends of the left/right pair of drive arms 116 are linked to the left/right pair of flap opening arms 114 via link pins 119 mounted on the drive arms 116 and passing through openings 118 in the left/right pair of opening arm mounting plates 111 into linking holes 120 formed in the flap opening arms 114.

A left/right pair of side holding suction pads 121, which are side holding means, are perpendicularly mounted underneath the jacket loading table 28 and directly below the left/right pair of side flap opening suction pads 117. The left/right pairs of side flap opening suction pads 117 and side holding suction pads 121 are constructed as vacuum suction-gripping means connected to a vacuum pump.

When the camshaft 59 is forward/reverse rotationally driven in one way by the motor 64, shown in FIG. 10, via the gear train 67, the jacket side flap opening mechanism 57b is driven by the left/right pair of side cam mechanisms 96.

That is, when the cam 68a of each cam mechanism 68 is rotated in the direction of the arrow by the camshaft 59 from the cam angle 180° shown in FIG. 26 toward the cam angle 0°, the flap opening arm 114 is caused to reciprocate in the direction of the arrows n, n' via the drive arm 116 by the cam driven roller 68b which is at all times pressed against the periphery of the cam 68a by the cam spring 68c and rolls around the periphery of the cam 68a.

However, at this time, the pair of rollers 113 of the opening arm 114 move circularly in the circular arcuate holes 112 in the direction of the arrows n, n' and the side flap opening suction pads 117 consequently move circularly in the direction of the arrows n, n' with the hereinafter discussed crease 16 of the cover sheet 9 of the printing sheet jacket 6 as a virtual center.

As shown in FIG. 26, when the cam 68a is at cam angle 180°, the left/right pair of side flap opening suction pads 117 are lifted in the arrow b direction above the table cover 51.

Next, when the cam 68a has been rotated to the position in which it is shown in FIG. 27, as will be further discussed hereinafter, the left/right pair of side flap opening suction pads 117 are pressed down in the arrow b' direction by the flap opening arms 114 onto the left and right side portions of the opening end 9c of the cover sheet 9 of the printing sheet jacket 6 loaded in the above-mentioned fixed position on the jacket loading table 28, and also the left/right side portions of the opening end 8a of the base sheet 8 of the printing sheet jacket 6 are pushed by the left/right pair of side flap opening suction pads 117 down onto the left/right pair of side holding suction pads 121.

At this time, the left/right pair of side flap opening suction pads 117 and the left/right pair of side holding suction pads 121 are caused by the suction force of the vacuum pump to suction-grip the left and right side portions of the cover sheet 9 and the base sheet 8.

Next, when the cam 68a is rotated to the position in which it is shown in FIG. 28, the left/right pair of side flap opening suction pads 117 are lifted upward by the opening arms 114 by the same amount as the opening stroke $\theta_2$ shown in FIG. 24, and the opening end 9c of the cover sheet 9 suction-gripped by the left/right pair of side flap opening suction pads 117 is opened upward through just the opening stroke $\theta_2$. The left and right side portions of the opening end 8a of the base sheet 8 are suction-gripped and kept held horizontal by the left/right pair of side holding suction pads 121.

At this time, as shown in FIGS. 1, 2 and 7, because the left/right pair of slits 15 are formed in the left and right sides of the opening end 9c of the cover sheet 9, and because the left/right pair of side flap opening suction pads 117 move circularly about the crease 16 in the opening end 9c of the cover sheet 9 as a virtual center, the cover sheet is smoothly opened across its entire width about the crease 16. By the side flap opening suction pads 117 being made to move circularly about the crease 16 in the cover sheet 9 as a virtual center, it is possible to prevent slippage of the printing sheet jacket 6 during opening of the cover sheet 9; as a result, the opening end 9c of the cover sheet 9 can be opened unforcedly and reliably. The printing sheet removal/insertion opening 7 is opened uniformly across its entire width by this opening action.

The positions of the central cam mechanism 69 and the side cam mechanisms 68 when the cams 69a, 68a are at the cam angles 180° and 0° are detected by the sensor $S_8$.

The cams 66a to 69a of the cam mechanisms 66 to 69 are set to be at cam angle 0° before the start of printing sheet feeding.

Then, as shown in FIGS. 10 to 12, an operator manually loads a printing sheet jacket 6 from its printing sheet removal/insertion opening 7 end in the arrow g direction into the jacket loading space 52 between the jacket loading table 28 and the table cover 51, and the insertion of the printing sheet jacket 6 is detected by the sensors $S_1$ and $S_2$.

Then, as shown in FIG. 14, when the printing sheet jacket 6 has passed between the drive rollers 77 and the pinch rollers 79, based on detection by the sensor $S_2$, the motor 64 is driven to rotate forward and the cams 66a to 69a of the cam mechanisms 66 to 69 are rotated from the cam angle 0° to the cam angle 180°.

When this happens, as shown in FIGS. 6 to 15, the left/right pair of drive rollers 77 are pushed down onto the left/right pair of roller press portions 10 of the printing sheet jacket 6 and, as shown in FIGS. 15 and 18, the left/right pair of sprockets 82 and the holding pins 96 which would otherwise obstruct the insertion of the printing sheet jacket 6 are withdrawn to above the jacket loading space 52.

Next, the motor 62 is driven to rotate forward and, a shown in FIG. 15, the rotation of the left/right pair of drive rollers 77 in the direction of the arrow automatically pulls the printing sheet jacket 6 into the jacket loading space 52 in the arrow (a) direction.

When the printing sheet jacket 6 has been pulled in the arrow (a) direction as far as the above-mentioned fixed position, the left and right side portions of the opening end 8*a* of the base sheet 8 abut with the left/right pair of jacket stoppers 71 and the printing sheet jacket 6 is stopped; at this time, the slip torque of the left/right pair of torque limiters built into the left/right pair of drive rollers 77 ensures that the printing sheet jacket 6 abuts with the left/right pair of jacket stoppers 71 from the arrow (a) direction and thereby correctly positions the printing sheet jacket 6.

When the sensors $S_3$ and $S_4$ detect the completion of the automatic pulling in of the printing sheet jacket 6 to the above-mentioned fixed position and that the printing sheet jacket 6 is parallel with respect to the left/right pair of jacket stoppers 71, the motor 62 is automatically stopped.

While the printing sheet jacket 6 is being automatically pulled in, the sensor $S_5$ detects the presence or otherwise of the misloading detection hole 21 formed in a left/right asymmetrical position in the printing sheet jacket 6, and top/bottom and front/rear misloading (mis-insertion) of the printing sheet jacket 6 can thereby be detected. When the printing sheet jacket 6 has been misloaded, the left/right pair of drive rollers 77 are immediately driven to rotate in reverse and automatically eject the printing sheet 6 in the arrow a' direction, or the fact that the printing sheet jacket 6 has been incorrectly loaded is made known to the operator by some kind of display or the like.

When the printing sheet jacket 6 has been automatically pulled in as far as the above-mentioned fixed position, as shown in FIG. 28, the crease 16 in the cover sheet 9 is correctly positioned at the center of the radius of curvature of the left/right pair of circular arcuate holes 112.

After the completion of the automatic pulling in of the printing sheet jacket 6 to the above-mentioned fixed position, the vacuum pump is activated and the motor 64 is driven to rotate in reverse to change the cam angle of the cams 66*a* to 69*a* of the cam mechanisms 66 to 69 from 180° to 0°.

By this action, as shown in FIGS. 24 and 28, the opening end 9*c* of the cover sheet 9 is unforcedly and smoothly opened across its entire width about the crease 16, and the printing sheet removal/insertion opening 7 is opened across its entire width. Then, as shown in FIG. 16, the left/right pair of drive rollers 77 are withdrawn to above the printing sheet jacket 6. Then, as shown in FIG. 19, the left/right pair of holding pins 96 are inserted into the left/right pair of jacket holding holes 18 in the printing sheet jacket 6 and the printing sheet jacket 6 is thereby held in the above-mentioned fixed position. As shown in FIGS. 2, 6 and 16, the left/right pair of sprockets 82 engage with the sprocket holes 3 in the left and right sides of the printing sheet 1 inside the printing sheet jacket 6.

Next, the motor 62 is again driven to rotate and, as shown in FIG. 16, the rotational force of the left/right pair of sprockets 82 in the direction of the arrow drives the sprocket holes 3 in the direction of the arrow and the printing sheet 1 is automatically pulled out from inside the printing sheet jacket 6 in the direction of the arrow (a).

At this time, the sensor $S_6$ counts the number of sprocket holes 3 and the extent to which the printing sheet 1 has been pulled out in the arrow (a) direction is thereby detected. This sensor $S_6$ can also detect the misloading detection hole 22 in the printing sheet jacket 6.

When the printing sheet 1 has been pulled out of the printing sheet jacket 6 in the arrow (a) direction as far as a predetermined position, as shown in FIGS. 11 and 12, the cylinder 30 is driven to rotate in the direction of the arrow and sprocket pins 30*a* provided around the peripheries of both ends of the cylinder 30 engage with the sprocket holes 3 in the left and right sides of the printing sheet 1 and, as shown by dotted lines in FIGS. 11 and 12, the printing sheet 1 is automatically wound onto the periphery of the cylinder 30. The printing sheet 1 ends up completely out from inside the printing sheet jacket 6 and wound around the cylinder 30, as shown in FIGS. 8(B) and 9(B).

During opening of the printing sheet removal/insertion opening 7 of the printing sheet jacket 6, the cover sheet 9 is opened using the suction force of a vacuum pump connected to the central and side flap opening suction pads 104 and 117; by detecting the degree of vacuum created by the vacuum pump in the central and side flap opening suction pad 104 and 117 system with a pressure sensor, indirect detection of whether or not the cover sheet 9 has opened is carried out.

When the printing sheet 1 is to be ejected, the vacuum pump is operating, the cams 66*a* to 69*a* are set to cam angle 66*a* to 69*a*, the cover sheet 9 of the printing sheet jacket 6 held in the jacket loading space 52 is open, and the printing sheet removal/insertion opening 7 is standing by still open across its entire width.

The printing sheet 1 is then automatically returned from the cylinder 30 into the printing sheet jacket 6 through the printing sheet removal/insertion opening 7 in the arrow a' direction. At this time, because the motor 62 is driven to rotate in reverse and the left/right pair of sprockets 82 are thereby driven to rotate in reverse, the left/right pair of sprockets 82 drive the sprocket holes 3 in the left and right sides of the printing sheet 1, and the printing sheet 1 is automatically returned in the arrow a' direction into the printing sheet jacket 6.

At this time, the speed of rotation of the left/right pair of sprockets 82 is made slightly higher than the speed at which the cylinder 30 reels out the printing sheet 1; this difference in speed is absorbed by the torque limiters 82*a* of the sprocket shaft 60, and thereby the printing sheet 1 can be returned in the arrow a' direction into the printing sheet jacket 6 without any slackness.

At this time, the left/right pair of taper portions 17 in the printing sheet jacket 6, shown in FIGS. 1, 2, 3 and 7, guide the left and right side portions of the printing sheet 1 and consequently the printing sheet 1 can be inserted into the printing sheet jacket 6 in the arrow a' direction smoothly.

When the printing sheet 1 has been returned to inside the printing sheet jacket 6, the sensor $S_5$ detects this and the motor 62 is automatically stopped. The motor 64 is then driven to rotate forward and the cams 66*a* and 69*a* are set to the cam angle 180° whereby the left/right pair of drive rollers 77 are pushed down onto the printing sheet jacket 6 and the left/right pair of holding pins 96 and the sprockets 82 are withdrawn to above the printing sheet jacket 6.

The motor 62 is then driven to rotate in reverse, and the printing sheet jacket 6 is automatically ejected from inside the jacket loading space 52 by a certain fixed amount in the arrow a' direction. The completion of the ejection of the printing sheet jacket 6 in the direction a' is detected by the sensor $S_2$, and the motor 62 is automatically stopped.

After that, when an operator manually pulls the printing sheet jacket 6 out of the jacket loading space 52 in the arrow a' direction and this is detected by the sensor $S_1$, the motor 64 again sets the cams 66*a* to 69*a* to the cam angle 0° and thereby returns the apparatus to the initial printing sheet feeding state. At this time, until the sensor $S_1$ detects that the printing sheet jacket 6 has been removed manually, the apparatus goes into a standby state, and even if the printing sheet jacket 6 is manually inserted in the arrow (a) direction again automatic printing sheet feeding will not be carried out.

As described above, in this electronic gravure printing system, because the system can be operated without the operator touching the printing sheet 1 at all, the adhesion of dust and the like and the occurrence of scratching on the surface 1*a* of the printing sheet 1 on which the image data 2 is formed can be completely prevented and stable printed matter can be obtained. Also, by developing this system, an electronic gravure printing system which can be run unmanned can easily be realized.

The devices for winding the printing sheet 1 onto the cylinders 30 and 40 of the printing sheet making machine 27 and the printing machine 37 discussed above are of identical construction. The printing sheet winding device 251 of the printing sheet making machine 27 will now be described, with reference to FIGS. 30 to 68.

First, with reference to FIGS. 49, 67 and 68, the drive mechanism 229 of the cylinder 30 will be described.

A left/right pair of cylinder support frames 253 are perpendicularly mounted apart from each other on a chassis 252, and a cylinder 30 is disposed horizontally between these cylinder support frames 253. The axial direction (the left-right direction) ends of a horizontal shaft 30*b* fixed at the center of the cylinder 30 are rotatably mounted on the left/right pair of cylinder support frames 253 via a left/right pair of bearings (not shown in the drawings). The above-mentioned jacket loading table 28 is mounted horizontally between the left/right pair of cylinder support frames 253, and the forward end of the jacket loading table 28 in the arrow (a) direction is in the vicinity of the upper part of the cylinder 30.

The cylinder drive mechanism 229 consists of a drive motor 230, which is cylinder rotational drive means, mounted on the chassis 252 and linked by a belt transmission mechanism 231 to one end of the shaft 30*b*. A rotary encoder 232, which is cylinder position detecting means, is directly coupled to the other end of the shaft 30*b* and is mounted on a side surface of one of the cylinder support frames 253.

Accordingly, the arrangement is such that the cylinder 30 is freely forward/reverse rotationally driven in the direction of the arrows c, c' by the drive motor 230, detection of the position of the cylinder 30 in the direction of the arrows c, c' is performed by the rotary encoder 232, and the cylinder 30 can be stopped at designated positions.

A row of sprocket pins 30*a* is provided at each end of the periphery of the cylinder 30; the sprocket pins 30*a* of both rows are spaced at the same pitch and are located in identical positions around the periphery of the cylinder 30.

A printing sheet winding device 251 which will be further discussed hereinafter is mounted between the left/right pair of cylinder support frames 253. During printing sheet feeding, as shown in FIG. 67, a printing sheet 1 automatically pulled out of a printing sheet jacket 6 loaded onto the jacket loading table 28 in the arrow (a) direction by the printing sheet feed and eject device 29 discussed above is automatically wound in the arrow c direction onto the periphery of the cylinder 30 by the two rows of sprocket pins 30*a* on the cylinder 30, as shown in FIG. 68, in a manner discussed hereinafter.

After this printing sheet winding, as shown in FIG. 68, while the cylinder is rotated at high speed in the arrow c direction, as discussed above, a laser beam is shone on the surface of the printing sheet 1 by a laser block 34, and the laser block 34 is reciprocated horizontally in the direction of the arrows s, s' along the axis of the cylinder 30, and the engraving step is thereby carried out.

A laser block transport mechanism 223 moves a laser block transport plate 224 on which the laser block 34 is mounted in the direction of the arrows s, s' by means of a feed screw 227 forward/reverse rotationally driven by a drive motor 226 mounted at one end of the feed screw 227 while guiding the laser block transport plate 224 between a pair of slide guides 225 parallel with the axis of the cylinder 30. A rotary encoder 228 which detects the position in the direction of the arrows s, s' of the laser block 34 is directly coupled to the other end of the feed screw.

During printing sheet ejection after engraving, as will be further discussed hereinafter, the printing sheet 1 is automatically unwound from the periphery of the cylinder 30 in the arrow c' direction and is automatically conveyed in the arrow a' direction into the printing sheet jacket 6.

The printing sheet winding device 251 will now be described in detail.

First, as shown in FIGS. 30 to 34, the two rows of sprocket pins 30*a* provided at a fixed pitch around the ends of the periphery of the cylinder 30 each consist of for example 12 sprocket pins 30*a* spaced at 30°. As shown by the solid black circles in FIG. 34(A), the arrangement is such that sprockets 30*a* of the two rows of sprockets 30*a* enter every third sprocket hole 3 of the two rows of sprocket holes 3 formed along the left and right sides of the printing sheet 1, and the printing sheet 1 is wound around the periphery of the cylinder 30 through an angle of 360° plus α.

As shown in FIG. 34, the pitch $P_1$ in the circumferential direction of the cylinder and the span $P_2$ in the axial direction of the cylinder of the two rows of sprocket pins 30*a* on the periphery of the cylinder 30 are made slightly larger (about 0.01 to 0.03 mm) than the distance between every third sprocket hole 3 and the span between the two rows of sprocket holes 3, i.e. than the engaging pitch $P_3$ and the engaging span $P_4$.

Next, as shown in FIG. 36, each of the sprocket pins 30*a* has a cylindrical surface $30a_1$ formed at its base portion, a tapered surface $30a_2$ formed above the cylindrical surface 30*a*, and an R surface $30a_3$ formed atop the cylindrical surface $30a_2$. The sprocket holes 3 are press fitted over the cylindrical surfaces $30a_1$ of the sprocket pins 30*a*.

As shown in FIGS. 34 and 35, the width through which the sprocket holes 3 along the side of the printing sheet 1 corresponding to the sprockets 30*a* disposed along a reference position $P_5$ at one end of the cylinder 30 are press fitted over those sprockets 30*a* is made large, and the width through which the sprocket holes 3 along the other side of the printing sheet 1 corresponding to the sprockets 30*a* disposed along a non-reference position $P_6$ at the other end of the cylinder 30 is made small.

That is, the tolerance of the diameter $D_1$ of the cylindrical surface $30a_1$ shown in FIG. 36 at the base of each sprocket pin 30*a* is set at upper limit=0 mm, lower limit= 0.009 mm with respect to 4 mm for all the sprocket pins 30*a* of the two rows, but the tolerance of the diameter $D_2$ of the two rows of sprocket holes 3 is set at upper limit=0.03 mm, lower limit=0.07 mm with respect to 4 mm on the reference position $P_5$ side and is set at upper limit=0 mm, lower limit=0.02 mm with respect to 4 mm on the non-reference position $P_6$ side.

As shown in FIGS. 30 to 33, the jacket loading table 28 is disposed on a horizontal tangent of the top of the periphery of the cylinder 30, and the vertical position line connecting the axis of rotation of the cylinder 30 and the intersection of this tangent and the top of the cylinder 30 is set to be the press fitting position $P_{11}$ of the sprocket holes 3 with respect to the sprocket pins 30*a*. A position approximately 15° behind this press fitting position $P_{11}$ in the arrow c' direction is set to be a reference position $P_{12}$ of the circumferential direction of the cylinder 30, and a position about 30° in front of the press fitting position $P_{11}$ in the arrow c' direction is set to be a printing sheet clamping position $P_{13}$.

Used in the printing sheet winding device 251 are a left/right pair of printing sheet pressing plates 256 which serve as both printing sheet lifting-off means and printing sheet pressing means, a left/right pair of printing sheet press fitting rollers 257 constituting printing sheet press fitting means, a printing sheet clamper 258, a left/right pair of locking pins 259 which constitute clamper control means, a magnet 260 for attracting the printing sheet clamper 258, and a printing sheet guide 261.

Next, with reference to FIGS. 40 to 45, the drive device 264 of the printing sheet pressing plates 256 will be described.

First, as shown in FIG. 40, the left/right pair of printing sheet pressing plates 256 are disposed left/right symmetrically at the inner sides of the left/right pair of cylinder support frames 253 in positions at the reference position $P_{12}$ over the two rows of sprocket pins 30*a* of the cylinder 30. A left/right pair of printing sheet pressing plate drive devices 264 which drive this left/right pair of printing sheet pressing plates 256 are mounted left/right symmetrically on the outer sides of the left/right pair of cylinder support frames 253.

The printing sheet pressing plates 256 are made of plastic and each have an elastic twin-pronged arm 256*a* and a slot 256*b* open in the arrow (a) direction formed in their central portion. Base portions of the printing sheet pressing plates 256 pass through long holes 265 formed diagonally in the cylinder support frames 253 and project to the outer sides of the cylinder support frames 253 and are fixed to support plates 266 disposed on the outer sides of the cylinder support frames 253.

The support plates 266 are each guided by a total of four guide rollers 267 mounted on the outer side of the respective cylinder support frame 253 so that the printing sheet pressing plates 256 move in the direction of the arrows c, c', which is diagonally up and down with respect to the position $P_{12}$.

The printing sheet pressing plate drive devices 264 each comprise a worm 270 linked by a coupling 269 to a drive motor 268 mounted on a bracket 268*a*, a worm wheel 271 meshing with the worm 270, a pinion 273 linked via an intermediate gear 272 to the worm wheel 271, a rack 274 fixed to the supporting plate 266 and meshing with the pinion 273, a shutter plate 275 fixed to the side surface of the rack 274, and a pair of sensors $S_9$, $S_{10}$, comprising photocouplers, which are switched ON and OFF by the shutter plate 275.

When the drive motor 268 is forward rotationally driven, the printing sheet pressing plates 256 are moved integrally with the supporting plates 266 by the drive motor 268 via the worms 270, the worm wheels 271, the intermediate gears, the pinions 273 and the racks 274 to the operating positions shown by solid lines in FIGS. 30 and 44; the sensors $S_9$ detect the movement of the shutter plate 275, and the drive motor 268 is automatically stopped.

When the drive motor 268 is reverse rotationally driven, in the reverse of the above, the printing sheet pressing plates 256 are moved to the non-operating positions shown by broken lines in FIGS. 30 and 44; the other sensors $S_{10}$ detect the movement of the shutter plate 275, and the drive motor 68 is automatically stopped.

Next, with reference to FIGS. 40, 42, and 46 to 48, the drive devices 278 of the printing sheet press fitting rollers 257 will be described.

First, the left/right pair of printing sheet press fitting rollers 257 are made of plastic, and each has a central circular groove 257*a* formed around the central portion of its periphery. These left/right pair of printing sheet press fitting rollers 257 are disposed left/right symmetrically inside the left/right pair of cylinder support frames 253 in positions at the press fitting position $P_{11}$ over the two rows of sprocket pins 30*a* of the cylinder 30. The left/right pair of printing sheet press fitting roller drive devices 278 which drive these left/right pair of printing sheet press fitting rollers 257 are mounted left/right symmetrically on the inner sides of the left/right pair of cylinder support frames 253.

Each printing sheet press fitting roller drive device 278 comprises a supporting shaft 279 horizontally mounted on the respective cylinder support frame 253; a supporting arm 280 rotatably mounted on the supporting shaft 279 and having the printing sheet press fitting roller 257 rotatably mounted on its end; a drive arm 281 pivotally mounted on the same supporting shaft 279; a limiter spring 282, consisting of a tension spring, fitted between the supporting arm 280 and the drive arm 281; a plunger solenoid 283, which is means for driving the drive cam 281 by means of a plunger 283*a*, mounted on the cylinder support frame 253; a stopper 285 of the drive arm 281; a return spring 284 of the plunger 283*a*, consisting of a tension spring; and a microswitch $S_{11}$ turned ON and OFF by the drive arm 281. The plunger 283*a* and the drive arm 281 are linked by a pin 283*a*, and the stopper 285 is formed integrally with the bracket 283*c* of the plunger solenoid 283.

When the plunger solenoid 283 is OFF, as shown by broken lines in FIG. 47, the drive arm 281 is pivoted by the return spring 284 in the arrow $c_2'$ direction and abuts with the stopper 285, and mutually abutting parts 281*a* and 280*a* formed between the drive arm 281 and the support arm 280 cause the support arm 280 to rotate in the arrow $c_3'$ direction and the printing sheet press fitting roller 257 is lifted as far as the press fitting release position shown by broken lines in FIGS. 30 and 37 and the microswitch $S_{11}$ is switched OFF.

When the plunger solenoid 283 is switched ON, as shown by solid lines in FIG. 47, the drive arm 281 is rotated in the arrow $c_2$ direction by the plunger 283*a* against the resistance of the return spring 284 and the support arm 280 is pivoted in the arrow $c_3$ direction by the limiter spring 282. The printing sheet press fitting roller 257 is lowered in the arrow $c_3$ direction to the press fitting position shown by solid lines in FIGS. 30 and 47, is pushed in the arrow $c_3$ direction against the periphery of the cylinder by the elastic force of the limiter spring 282, and the microswitch $S_{11}$ is switched ON by the drive arm 281.

Referring now to FIGS. 30 to 33 and 49 to 62, the support mechanism 288 of the printing sheet clamper 258 will be described.

As shown in FIGS. 49 to 51, the printing sheet clamper 258 is a belt-shaped plate made of a strongly magnetic material such as steel plate, and the overall length of this printing sheet clamper 258 is slightly greater than the overall length of the cylinder. Also, this printing sheet clamper 258 is curved in a circular arc along the periphery of the cylinder in a direction normal to its length direction. This printing sheet clamper 258 is pressed against and separated from the periphery of the cylinder while being held parallel with the axis of the cylinder by a left/right pair of printing sheet clamper support mechanisms 288.

As shown in FIGS. 30 to 33 and 50 to 62, the left/right pair of printing sheet clamper support mechanisms 288 are left/right symmetrically mounted on the ends of the cylinder. The printing sheet clamper support mechanisms 288 each comprise a rotary support table 290 rotatably mounted via a bearing 289 on the left/right ends of the shaft **30*b* of the cylinder and a clamper support plate 293 mounted on the side of the rotary support table 290 slidably with respect to the rotary support table 290 in the direction of the arrows $c_4$, $c_4'$, which is a direction orthogonal to the axial direction of the cylinder, via a pair of screws/guide pins 291 and a pair of long holes 292**.

A left/right pair of bent pieces **258*a* are each bent into a right angle toward the center of the cylinder at the ends of the printing sheet clamper 258. A left/right pair of support pin mating holes 294 are formed in the ends of the left/right pair of bent pieces 258*a* in positions biased to one side in the circumferential direction of the cylinder from the center $P_{14}$ of the printing sheet clamper 258 in the circumferential direction of the cylinder. A left/right pair of support pin mating holes 295 formed in positions slightly biased in one direction from the above-mentioned center $P_{14}$ in the ends of the left/right symmetrical left/right pair of clamper support plates 293 and the left/right pair of support pin mating holes 294 in the printing sheet clamper 258 are pivotally linked to each other by a left/right pair of support pins 296**.

As a result, the ends of the printing sheet clamper 258 are supported by the left/right pair of clamper support plates 293 and this printing sheet clamper 258 is movable in the direction of the arrows $c_4$, $c_4'$, which is a direction orthogonal to the axial direction of the cylinder, while being held parallel to the cylinder, and this printing sheet clamper 258 can pivot with respect to the left/right pair of clamper support plates 293 about the left/right pair of support pins 296 in the direction of the arrows $c_5$, $c_5'$ shown in FIGS. 57 and 58.

A left/right pair of spring attachment plates 297 are left/right symmetrically fixed by fixing screws 298 to the side surfaces of the left/right pair of rotary support plates 290 in positions peripheral to the bearings 289 so as to lie across the left/right pair of clamper support plates 293. Left/right pairs of pressure springs 301 and 302, consisting of tension springs, four springs in total, are fitted between spring anchorages **299*a* and 299*b* formed on the left/right pair of spring attachment plates 297 and spring anchorages 300*a* and 300*b* formed respectively on the opposite end portions of the bent pieces 258 from the support pin mating holes 294 and side portions of the left/right pair of clamper support plates 293**.

As a result, the printing sheet clamper 258 is pivotally urged in the arrow $c_5$ direction with respect to the left/right pair of clamper support plates 293 about the left/right pair of support pins 296 by the left/right pair of pressure springs 301, and the printing sheet clamper 258 and the left/right pair of clamper support plates 293 are together strongly urged in the direction $c_4$ with respect to the left/right pair of rotary support plates 290 by the left/right pairs, four springs in total, of pressure springs 301 and 302.

Next, with reference to FIGS. 30 to 33, 50, 51, and 53 to 60, a cam mechanism 305 constituting part of a clamper control mechanism for effecting clamping and unclamping of the printing sheet clamper 258 will be described.

This cam mechanism 305 is made up of a left/right pair of concentric circular cams 306 fixed with screws to the ends of the cylinder around the vicinity of the periphery thereof, and left/right pairs of cam follower rollers 307, 308, consisting of bearings, rotatably mounted on the inner sides of the left/right pair of bent pieces 258 of the printing sheet clamper 258 in positions on opposite sides of the center $P_{14}$ in the circumferential direction of the cylinder.

The left/right pairs of cam follower rollers 307 and 308 are pressed in the arrow $c_4$ direction against circular peripheral surfaces **306*a*, concentric with the cylinder, of the left/right pair of cams 306 by the left/right pairs of springs 301 and 302. A left/right pair of concave portions 306*b* into which the left/right pairs of cam follower rollers 307, 308 can descend simultaneously are formed in parts of the peripheral surfaces 306*a* of the left/right pair of cams 306**.

Next, with reference to FIGS. 30 to 33 and 52 to 56, a fixed position lock mechanism 311, constituting another part of the printing sheet clamper control mechanism, for locking and unlocking the left/right pair of printing sheet clamper support mechanisms 288 in the printing sheet clamping position $P_{13}$ shown in FIGS. 30 to 33, will be described.

This fixed position lock mechanism 311 is made up of a left/right pair of slots 312 formed in the opposite ends of the left/right pair of rotary support plates 290 from the printing sheet clamper 258 and a left/right pair of locking pins 259 free to enter and exit this left/right pair of slots 312 in the direction of the arrows $c_6$, $c_6'$, parallel to the axis of the cylinder.

Next, with reference to FIGS. 63 to 66, a left/right pair of lock pin drive mechanisms 315, which drive the locking pins 259 in the direction of the arrows $c_6$, $c_6'$, will be described.

These lock pin drive mechanisms 315 are mounted left/right symmetrically on the printing sheet clamping position $P_{13}$ on the outer sides of the left/right pair of cylinder support frames 253. Each lock pin drive mechanism 315 is made up of a locking pin guide 317 which guides the respective locking pin 259 in and out through a through hole 316 formed in the respective cylinder support frame 253 in the direction of the arrows $c_6$, $c_6'$; a feed screw 318 disposed coaxially with the lock pin 259 at the opposite end of the lock pin 259 from the cylinder; a drive motor 320, mounted on a bracket 319, which moves the feed screw 318 in the direction of the arrows $c_6$, $c_6'$; a return spring 321, consisting of a compression spring, which at all times pushes the lock pin 259 against the end of the feed screw 318 in the arrow $c_6'$ direction; a shutter plate 323, fitted on the feed screw 318 side end portion of the lock pin 259 and guided by a guide shaft 322 parallel to the lock pin 259, which moves in the direction of the arrows $c_6$, $c_6'$ integrally with the lock pin 259; and a pair of sensors $S_{12}$, $S_{13}$, which consist of photocouplers and are ON/OFF actuated by the shutter plate 323.

When the drive motor 320 is driven to rotate forward, as shown by solid lines in FIGS. 64 and 65, the feed screw 318 is moved in the arrow $c_6$ direction against the resistance of the return spring 321, and the end of this lock pin 259 is inserted into the slot 312 in the rotary support plate 290. This lock pin 259 thereby locks the rotary support plate 290 in the printing sheet clamping position $P_{13}$. The sensor $S_{12}$ detects the movement of the shutter plate 323, and the locking of the rotary support plate 290 is thereby confirmed.

When the drive motor 320 is driven in reverse, as shown by broken lines in FIGS. 64 and 65, the feed screw 318 is moved in the arrow $c_6'$ direction by the return spring 321, the lock pin 259 exits the slot 312 in the rotary support plate 290 and the rotary support plate 290 is unlocked from the printing sheet clamping position $P_{13}$. The other sensor $S_{13}$ detects the movement of the shutter plate 323, and the unlocking of the rotary support plate 290 is thereby confirmed.

As shown in FIGS. 49 and 59 to 62, a magnet 260 is recessed in the periphery of the cylinder in a roughly central position $P_{15}$ in the axial direction of the cylinder, whereby the roughly central portion in the length direction of the printing sheet clamper 258 pressed against the periphery of the cylinder in the printing sheet clamping position $P_{13}$ is pulled against the periphery of the cylinder by magnetic attraction.

As shown in FIGS. 30 to 33, the printing sheet guide 261 is mounted on the chassis 252 in parallel with the cylinder and is below the arrow c' direction side vicinity of the printing sheet clamper 258 when the printing sheet clamper 258 is in position in the printing sheet clamping position $P_{13}$.

Before the start of printing sheet winding device operation, first, as shown in FIG. 85, the left/right pairs of cam follower rollers 307, 308 of the left/right pair of cam mechanisms 305 are down in the concave portions **306*b* of the left/right pair of cams 306, and the printing sheet clamper 258 is being pressed by the left/right pair of pressure springs 301, 302 in the direction of the arrow $c_4$ against the periphery of the cylinder. Therefore, in this state, when the cylinder is driven to rotate, the printing sheet clamper support mechanisms 288** rotate integrally with the cylinder.

Next, a printing sheet jacket 6 is loaded onto the jacket loading table 28 of the printing sheet feed and eject device 29 shown in FIGS. 10 to 12, and when the sensor $S_2$ detects the printing sheet jacket 6 the automatic winding of the printing sheet 1 onto the periphery of the cylinder begins.

That is, first, as shown in FIG. 30, the cylinder is driven in the direction of the arrow c by the cylinder drive mechanism 229, and, based on detection of the position of the cylinder by the rotary encoder 232, the left/right pair of printing sheet clamper support mechanisms 288 are stopped in the printing sheet clamping position $P_{13}$.

Then, the left/right pair of lock pins 259 are driven in the direction of the arrow $c_6$ by the left/right pair of lock pin drive mechanisms 315 shown in FIGS. 63 to 66, and, as shown in FIGS. 55 and 56, the left/right pair of lock pins 259 are inserted in the arrow $c_6$ direction into the left/right pair of slots 312 in the left/right pair of rotary support plates 290.

When this happens, as shown in FIG. 30, the left/right pair of printing sheet clamper support mechanisms 288 and the printing sheet clamper 258 are brought into position in the printing sheet clamping position $P_{13}$ integrally with the left/right pair of rotary support plates 290.

When the sensor $S_{12}$ of the lock pin drive mechanism 315 confirms the above locked state, the cylinder is rotated further in the arrow c direction.

Then, as shown in FIG. 59, the left/right pairs of cam follower rollers 307, 308 of the left/right pair of cam mechanisms 305 are pushed up from the concave portions **306*b* of the left/right pair of cams 306 onto the outer peripheral surfaces 306*a*, and, as shown in FIGS. 30 and 59 with broken lines, the printing sheet clamper 258 is separated from the periphery of the cylinder in the arrow $c_4'$ direction against the resistance of the left/right pairs of pressure springs 301, 302 while remaining parallel to the cylinder, and the printing sheet clamper 258** is thereby unclamped.

The cylinder continues to rotate in the direction of the arrow c, and first pins 30A, which are a left/right pair of reference pins among the two rows of sprocket pins **30*a* on the periphery of the cylinder 30, are brought into the reference position $P_{12}$, as shown in FIG. 37** with broken lines, and the cylinder is stopped.

After this, the automatic pulling in of the printing sheet jacket 6 in the direction of the arrow (a) to the above-mentioned fixed position and the automatic pulling out of the printing sheet 1 in the direction of the arrow (a) from inside the printing sheet jacket 6 are started by the printing sheet feed and eject device 29, shown in FIGS. 10 to 12, and, as shown in FIGS. 30 and 37, the leading end of the printing sheet 1 is fed roughly tangentially to the cylinder in the direction of the arrow (a) to the press fitting position $P_{11}$ of the cylinder.

At this time, the sensor $S_6$ of the printing sheet feed and eject device 29 counts the sprocket holes 3 of the printing sheet 1 being fed in the direction of the arrow (a) and thereby detects the extent to which the printing sheet 1 has been pulled out in the direction of the arrow (a).

When the sensor $S_6$ detects that the printing sheet 1 has been pulled out as far as the above-mentioned fixed position, the left/right pair of first pins 30A of the cylinder start to move from the reference position $P_{12}$ toward the press fitting position $P_{11}$.

At the same time, the left/right pair of printing sheet pressing plate drive devices 264 and the left/right pair of printing sheet press fitting roller drive devices 278 shown in FIGS. 43 to 45 and 46 to 48 lower the left/right pair of printing sheet pressing plates 256 and the left/right pair of printing sheet press fitting rollers 257 respectively from the non-operating positions and non-pressing positions shown with broken lines in FIG. 37 into the operating positions and pressing positions shown with solid lines in FIG. 37 in the direction of the arrow $c_1$ and the direction of the arrow $c_3$.

At this time, as shown in FIGS. 37, 41 and 42(A), the twin-pronged arms **256*a* of the left/right pair of printing sheet pressing plates 256, having the slots 256*b* in their central portions, press the leading end of the printing sheet 1 down elastically in the direction of the arrow $c_1$ onto the periphery of the cylinder 30 on both sides of each of the left/right pair of first pins 30**A.

By this action, as shown in FIGS. 34 and 35, the left/right pair of first pins 30A of the cylinder are firmly engaged with the first holes 3A at the leading ends of the two rows of sprocket holes 3 in the printing sheet 1.

Also, at this time, as shown in FIGS. 37, 41 and 42(B), the left/right pair of printing sheet press fitting rollers 257, having the circular grooves **257*a* around their central portions, elastically press the leading end of the printing sheet 1 in the direction of the arrow $c_3$ onto the periphery of the cylinder 30 on both sides of the locuses of movement of the two rows of sprocket pins 30*a*** on the cylinder.

When low speed rotation of the cylinder in the direction of the arrow c has brought the left/right pair of first pins 30A of the cylinder to the press fitting position $P_{11}$, as shown in FIGS. 35(B), 38 and 41, the left/right pair of printing sheet press fitting rollers 257 press the printing sheet 1 in the direction of the arrow $c_3$ on the left and right sides of the left/right pair of first pins 30A, and the left/right pair of first sprocket pins 3A are firmly press fitted onto the left/right pair of first pins 30A down to the cylindrical surfaces 30$a_1$, shown in FIG. 36(A), at the bases of the first pins 30A.

A fixed period of time after the left/right pair of printing sheet press fitting rollers 257 are lowered in the direction of the arrow c to the press fitting positions shown by solid lines in FIG. 38, the left/right pair of printing sheet pressing plates 256 are raised in the arrow $c_1'$ direction to their non-operating positions.

Then, as shown in FIG. 31, the cylinder continues to rotate at low speed, and by being pulled in the direction of the arrow c by the left/right pair of first pins 30A the printing sheet 1 is automatically pulled out of the printing sheet jacket 6, the sprocket pins 30*a* disposed in two rows on the cylinder are inserted two by two into the sprocket holes 3 formed in two rows in the printing sheet 1, the two rows of sprocket holes 3 are firmly press fitted by the left/right pair of printing sheet press fitting rollers 257 onto the two rows of sprocket pins 30*a* down to the cylindrical surfaces 30$a_1$ at the bases thereof shown in FIG. 36(A), and the printing sheet 1 is thereby automatically wound onto the periphery of the cylinder 30.

At this time, the end 1*b* of the printing sheet 1 is guided by the printing sheet guide 261 so that it smoothly passes through the gap between the printing sheet clamper 258 and the periphery of the cylinder 30.

Then, as shown in FIG. 31, when the cylinder has rotated through 375° from the reference position $P_{12}$, the printing sheet 1 is wound around the periphery of the cylinder 30 through 360°+α, and the trailing end 1*c* of the printing sheet 1 overlaps the leading end of the printing sheet 1.

When the cylinder has rotated through 405° from the press fitting position $P_{11}$, as shown in FIGS. 55, 56, 60 and 62, the left/right pairs of cam follower rollers 307, 308 descend from the outer peripheral surfaces 306*a* of the left/right pair of cams 306 into the concave portions 306*b*, the printing sheet clamper 258 is strongly pressed in the direction of the arrow $c_4$ onto the periphery of the cylinder 30 by the left/right pairs of pressure springs 301 and 302, four springs in total, as shown with solid lines in FIG. 49, and, as shown in FIG. 62, the printing sheet clamper 258 strongly presses the trailing end 1*c* of the printing sheet 1 onto the leading end 1*b* and onto the periphery of the cylinder 30 in the direction of the arrow $c_4$, and the leading end 1*b* and the trailing end 1*c* of the printing sheet 1 are thereby simultaneously clamped strongly onto the periphery of the cylinder 30.

At this time, while the cylinder is rotating in the direction of the arrow c, after the left/right pairs of cam follower rollers 307, 308 have descended into the concave portions 306*b* of the cams 306 once and the printing sheet clamper 258 has been pressed against the periphery of the cylinder 30 in the direction of the arrow $c_4$, the left/right pair of cam follower rollers 307, 308 are pushed up again by the outer peripheral surfaces 306*a* of the cams 306 and the printing sheet clamper 258 is separated in the direction of the arrow $c_4'$ from the periphery of the cylinder 30. However, the positions of the concave portions 306*b* of the cams 306 are set so that this action occurs before the leading end of the printing sheet 1 wound in the direction of the arrow c on the periphery of the cylinder 30 reaches the printing sheet clamper 258.

When the printing sheet clamper 258 has simultaneously clamped the leading end 1*b* and the trailing end 1*c* of the printing sheet 1, as shown in FIGS. 49 and 62, the magnet 260 recessed in the periphery of the cylinder 30 attracts and strongly holds the roughly central portion, in the length direction, of the printing sheet clamper 258.

After the clamping of the leading end 1*b* and the trailing end 1*c* of the printing sheet 1 by the printing sheet clamper 258 is confirmed by the rotary encoder 232 and the cylinder is stopped, as shown in FIG. 32 the left/right pair of printing sheet press fitting rollers 257 are raised in the direction of the arrow $c_3'$ to their non-operating positions and, as shown in FIG. 56 by broken lines, the left/right pair of lock pins 259 are withdrawn in the direction of the arrow $c_5'$ from the left/right pair of slots 312 in the left/right pair of rotary support plates 290 and the rotary support plates 290 are thereby unlocked from their fixed positions.

After that, the engraving step described hereinbefore is begun: the cylinder is rotated at high speed in the direction of the arrow c, and engraving of image data 2 of a photograph or the like onto the surface 1*a* of the printing sheet 1 is carried out.

During this engraving step the printing sheet clamper 258 is rotated at high speed integrally with the cylinder while still clamping the printing sheet 1, and a phenomenon occurs wherein centrifugal force created by the high speed rotation causes the roughly central portion in the length direction of the printing sheet clamper 258 to float up from the periphery of the cylinder 30 in the direction of the arrow $c_4'$ into a circular arc shape and the clamping force on the printing sheet 1 decreases.

However, because the magnet 260 recessed in the periphery of the cylinder 30 strongly attracts the roughly central portion in the length direction of the printing sheet clamper 258, this phenomenon is prevented from being a problem.

When the printing sheet 1 is to be unwound from the periphery of the cylinder 30, as shown in FIG. 32, after the left/right pair of rotary support plates 290 are unlocked from the printing sheet clamping position by the left/right pair of lock pins 259, the cylinder is rotated through a predetermined angle in the direction of the arrow c and, as shown in FIG. 59, the left/right pairs of cam follower rollers 307, 308 are pushed from the concave portions 306*b* of the left/right pair of cams 306 up onto the outer peripheral surfaces 306*a*, and the printing sheet clamper 258 is thereby unclamped in the direction of the arrow $c_4'$.

Next, as shown in FIGS. 33 and 39, the left/right pair of printing sheet pressing plates 256 are lowered in the direction of the arrow $c_1$ to their operating positions, and these printing sheet pressing plates 256 push the printing sheet 1 elastically onto the periphery of the cylinder 30 from above.

After that, the cylinder is rotated reversely in the direction of the arrow c' and the printing sheet 1 is automatically unwound from the cylinder starting from its trailing end 1*c* by the left/right pair of printing sheet pressing plates 256. At this time, the printing sheet 1 is lifted up from the bases of the sprocket pins 30*a* on the cylinder by the twin-pronged arms 256*a* of the left/right pair of printing sheet pressing plates 256, and the sprocket holes 3 of the printing sheet 1 are sequentially automatically wound off the two rows of sprocket pins 30*a* on the cylinder. The printing sheet 1 is guided by the left/right pair of printing sheet pressing plates 256 and automatically inserted in the direction of the arrow a' into the printing sheet jacket 6 on the jacket loading table 28.

As shown in FIG. 59, when while the printing sheet clamper 258 is unclamped the cam follower rollers 307, 308 are pushed up in the direction of the arrow $c_4'$ from the concave portions 306*b* of the cams 306 rotating in the direction of the arrow c, first the printing sheet clamper 258 is pivoted in the direction of the arrow $c_5'$ about the support pins 296, as shown in FIG. 59 with broken lines, and then the printing sheet clamper 258 is pivoted in the direction of the arrow $c_5$ about the pair of cam follower rollers 307, as shown in FIG. 59 with solid lines.

Consequently, while the printing sheet clamper 258 is unclamped, the ends of the printing sheet clamper 258 in the circumferential direction of the cylinder are alternately pulled away from the periphery of the cylinder 30 in the direction of the arrow $c_5'$ and the direction of the arrow $c_5$, and a pivoting movement of the printing sheet clamper 258 in the direction of the arrow $c_5$ and the direction of the arrow $c_5'$ occurs.

Because the levering action of this printing movement of the printing sheet clamper 258 in the direction of the arrow $c_5$ and the direction of the arrow $c_5'$ enables the printing sheet clamper 258 to readily separate from the magnet 260, unclamping of the printing sheet clamper 258 can be effected easily.

At the start of winding of the printing sheet 1 onto the periphery of the cylinder 30, as shown in FIG. 37, the left/right sides of the leading end 1*b* of the printing sheet 1 are pushed elastically against the periphery of the cylinder 30 by the left/right pair of printing sheet pressing plates 256 and the first pins 30A of the two rows of sprocket pins 30*a* are reliably inserted into the first sprocket pins 3A of the two rows of sprocket holes 3; during the winding operation, as shown in FIGS. 38 and 36(A), because the two rows of sprocket holes 3 are sequentially press fitted securely onto the two rows of sprocket pins 30*a* by the left/right pair of printing sheet press fitting rollers 257, the automatic winding of the printing sheet 1 onto the periphery of the cylinder 30 can be performed correctly and smoothly.

Next, during automatic winding of the printing sheet 1 onto the periphery of the cylinder 30, because the first pins 30A of the two rows of sprocket pins 30*a* can be always reliably inserted into the first sprocket pins 3A of the two rows of sprocket holes 3, as shown in FIGS. 30 and 35, positioning of the printing sheet 1 with respect to the reference position $P_{12}$ in the circumferential direction of the cylinder can be performed with high accuracy.

Because as shown in FIG. 34 the pitch $P_1$ and the span $P_2$ of the two rows of sprocket pins 30*a* on the periphery of the cylinder 30 are approximately 0.01 to 0.03 mm larger than the engaging pitch $P_3$ and the engaging span $P_4$ of the two rows of sprocket holes 3 in the printing sheet 1, when the two rows of sprocket holes 3 in the printing sheet 1 are press fitted onto the two rows of sprocket pins 30*a* on the cylinder and the printing sheet 1 is wound on the periphery of the cylinder 30, as shown in FIG. 35, between the two rows of sprocket pins 30*a* in the axial direction of the cylinder and between adjacent sprocket pins 30*a* in the circumferential direction of the cylinder it is possible to produce a tension in the printing sheet 1 in the X direction, which is the cylinder axial direction, and in the Y direction, which is the cylinder circumferential direction.

Furthermore, at this time, because as shown in FIGS. 34 and 35 the width through which the sprocket holes 3 on the side of the printing sheet 1 corresponding to the sprocket pins 30*a* along the reference position $P_5$ at one end of the cylinder are press fitted onto those sprocket pins 30*a* is large and the width through which the sprocket holes 3 on the other side of the printing sheet 1 corresponding to the sprocket pins 30*a* along the non-reference position $P_6$ at the other end of the cylinder are press fitted onto those sprocket pins 30*a* is small, as shown in FIG. 35 by the arrow X direction, the whole printing sheet 1 is pulled toward the reference position $P_5$ side and the printing sheet 1 is positioned with high accuracy with respect to the reference position $P_5$.

Consequently, the printing sheet 1 automatically wound onto the periphery of the cylinder 30 can be positioned with high accuracy in both the circumferential direction of the cylinder referenced by the reference position $P_{12}$ and the axial direction of the cylinder referenced by the reference position $P_{12}$.

Furthermore, because the printing sheet 1 automatically wound onto the periphery of the cylinder 30 is given tensions between the sprocket pins 30*a* in the X and Y directions that are the axial and circumferential directions of the cylinder, absolutely no slippage or wrinkling of the printing sheet 1 occurs.

Because as shown in FIG. 36(A) each sprocket pin 3*a* is formed with a cylindrical surface $30a_1$ at the base, a taper surface $30a_2$ above that and an R surface $30a_3$ above that, as shown in FIG. 36(A) the press fitted sprocket holes 3 of the printing sheet 1 can be positioned stably and with high accuracy and yet as shown in FIG. 36(B) during the insertion and withdrawal of the sprocket pins 30*a* with respect to the sprocket holes 3 in the printing sheet 1 which accompanies the rotation of the cylinder in the direction of the arrows c, c' the guiding action of the R surface $30a_3$ and the taper surface $30a_2$ of each sprocket pin 30*a* enables the sprocket pins 30*a* to enter and exit the sprocket holes 3 unforcedly and smoothly.

The printing sheet feed and eject device of the printing sheet making and printing system of the present invention described above provides the following kinds of benefits:

Just by loading a printing sheet jacket onto a jacket loading table, the complete automation of the feeding and ejection of a printing sheet to and from a cylinder can be achieved, and an operator can carry out feeding and ejection of a printing sheet with respect to a cylinder extremely easily and without directly touching the printing sheet. Therefore, the adhesion of dust and the occurrence of scratching on the surface of the printing sheet can be completely avoided and stable printed matter with no color blurring or scumming can be obtained. Also, because a printing sheet ejected from the cylinder of a printing machine has ink on it, if an operator were to touch the printing sheet directly the operator would get ink on his hands, but the present apparatus eliminates such problems and is extremely sanitary.

Because it is possible to completely automate the feeding and ejection of a printing sheet to and from a cylinder, the invention facilitates development toward a completely automatic electronic gravure printing system which can be run unmanned.

Because there are provided a number of sensors which detect the position of the printing sheet jacket loaded on the jacket loading table and activate the jacket pulling in means and detect that the printing sheet jacket has been pulled in as far as a fixed position and sequentially activate the flap opening means and the printing sheet pulling out means, the chain of operations following the loading of the printing sheet jacket onto the jacket loading table, consisting of the automatic pulling in of the printing sheet jacket, the automatic opening of the printing sheet jacket and the automatic pulling out of the printing sheet from inside the printing sheet jacket, can be systematically carried out in correct sequence.

Because the jacket pulling in means is provided with a left/right pair of roller press portions formed at the left and right sides of the printing sheet jacket and a left/right pair of drive rollers which are pressed onto these roller press portions, by forward and reverse rotation of the left/right pair of drive rollers pressed onto the left/right pair of roller press portions the automatic pulling in and automatic ejection of the printing sheet jacket on the jacket loading table can be carried out accurately and easily.

Because the flap opening means is provided with suction-gripping means for suction-gripping and opening the printing sheet removal/insertion opening end of the printing sheet jacket, the printing sheet removal/insertion opening end of the printing sheet jacket can be suction-gripped and accurately and easily opened by this suction-gripping means.

Because the printing sheet pulling out means is provided with sprocket holes spaced at a fixed pitch along the left and right sides of the printing sheet and a left/right pair of sprockets which are engaged with the sprocket holes through a left/right pair of sprocket access holes formed in the printing sheet jacket, by forward and reverse rotation of the left/right pair of sprockets engaged with the sprocket holes in the left and right sides of the printing sheet through the left/right pair of sprocket access holes in the printing sheet jacket automatic pulling out of the printing sheet from the printing sheet jacket and automatic reinsertion of the printing sheet into the printing sheet jacket can be carried out accurately and easily.

Because the printing sheet is pulled out of the printing sheet jacket and fed to the cylinder by the left/right pair of sprockets engaged with the two rows of sprocket holes formed along the left and right sides of the printing sheet, and the thus fed printing sheet is wound onto the periphery of the cylinder by the two rows of sprocket pins disposed around the ends of the cylinder being inserted into the two rows of sprocket holes in the printing sheet, the structure is simple and the operation is reliable, and the operations of winding and unwinding the printing sheet onto and off the cylinder can be carried out stably.

Because after the two rows of sprocket pins on the cylinder have entered the two rows of sprocket holes in the printing sheet and the printing sheet is thereby wound onto the periphery of the cylinder at least the trailing end of the wound printing sheet is clamped by a printing sheet clamper onto the periphery of the cylinder, slippage and wrinkling of the printing sheet wound on the cylinder do not readily occur. Consequently the interchangeability of the printing sheet with respect to the cylinder is good, and when image data such as a photograph is engraved color by color in colors such as cyan, magenta, yellow and black and multicolor overprinting is carried out, color non-alignment, color blurring, image distortion and scumming and the like do not readily occur and high image quality, fine gravure printing can be performed.

Because there are provided detecting means for detecting the extent to which the printing sheet has been pulled out of the printing sheet jacket by counting the sprocket holes in the printing sheet and cylinder rotational drive means and cylinder position detecting means for setting the sprocket pins of the sprocket printing sheet on the cylinder to a reference position and based on a signal from the detecting means rotating the cylinder and thereby inserting the sprocket pins into the first sprocket holes of the sprocket holes and on completion of the winding of the printing sheet which accompanies the rotation of the cylinder through a predetermined angle stopping the cylinder in a printing sheet clamping position, the chain of operations comprising the automatic winding and clamping of the printing sheet onto the cylinder can at all times by performed accurately and reliably.

Because there is provided another detecting means for detecting the loading of the printing sheet jacket as far as a fixed position on the jacket loading table and sequentially forwardly rotating the left/right pair of sprockets and the cylinder, just by loading the printing sheet jacket onto the jacket loading table the printing sheet can be automatically pulled out from inside the printing sheet jacket and automatically wound onto the periphery of the cylinder, and the operatability is further improved.

By forward rotation of the cylinder the two rows of sprocket pins at the ends of the periphery of the cylinder are made to enter the two rows of sprocket holes formed in the printing sheet inside the printing sheet jacket two by two and the printing sheet is thereby automatically pulled out of the printing sheet jacket and wound onto the periphery of the cylinder. During this printing sheet winding operation the two rows of sprocket holes are press fitted onto the two rows of sprocket pins as far as the base portions thereof; at this time, because the pitch in the circumferential direction of the cylinder and the span in the axial direction of the cylinder of the two rows of sprocket pins are made slightly greater than the engaging pitch and the engaging span of the two rows of sprocket holes with respect to the sprocket pins, positioning of the printing sheet on the cylinder can be performed with high accuracy so that no slippage or wrinkling of the printing sheet occurs whatsoever. As a result the interchangeability of the printing sheet with respect to the cylinder is extremely good, and when image data such as a photograph is engraved color by color in colors such as cyan, magenta, yellow and black and multicolor overprinting is carried out, color non-alignment, color blurring, image distortion and scumming and the like do not readily occur and high image quality, fine gravure printing can be performed.

Because the width through which the sprocket holes along the side of the printing sheet corresponding to the sprocket pins disposed along an axial reference position at one end of the cylinder are press fitted onto those sprocket pins is made large and the width through which the sprocket holes on the other side of the printing sheet corresponding to the sprocket pins disposed along a non-reference position at the other end of the cylinder are press fitted onto those sprocket pins is made small, the printing sheet wound on the cylinder can be positioned with high accuracy with respect to the axial direction reference position on the cylinder and the interchangeability of the printing sheet with respect to the cylinder is further raised.

Because each of the sprocket pins on the cylinder has a cylindrical surface formed at its base, a tapered surface formed above that and an R surface formed atop the tapered surface, notwithstanding that the printing sheet can be positioned with high accuracy with respect to the cylinder, the insertion and removal of the sprocket pins on the cylinder into and out of the sprocket holes in the printing sheet can be performed smoothly.

Because the left/right pair of printing sheet pressing means consist of printing sheet press fitting rollers, having central circular grooves, which push the printing sheet onto the periphery of the cylinder on the left and right sides of the sprocket pins, the two rows of sprocket holes of the printing sheet can be smoothly press fitted onto the two rows of sprocket pins on the cylinder as far as the bases thereof.

By forward rotation of the cylinder, the two rows of sprocket pins on the ends of the periphery of the cylinder are made to enter the two rows of sprocket holes formed in the printing sheet two by two and the printing sheet is thereby automatically pulled out of the printing sheet jacket and wound onto the periphery of the cylinder. At least the trailing end of the printing sheet wound on the cylinder is clamped onto a portion of the periphery of the cylinder by a printing sheet clamper mounted parallel with the axial direction of the cylinder. At this time, because clamping and unclamping of the printing sheet clamper is performed by the axial direction ends of the printing sheet clamper being pivotally supported at the ends of the cylinder by a left/right pair of printing sheet clamper support mechanisms and by the cylinder being rotated with the left/right pair of printing sheet clamper support mechanisms locked in a fixed position by a left/right pair of printing sheet clamper control mechanisms, the operations of automatically clamping and automatically unclamping the printing sheet automatically wound on the periphery of the cylinder can be carried out smoothly.

When the printing sheet is automatically wound onto the periphery of the cylinder, because after the printing sheet is wound onto the periphery of the cylinder by the two rows of sprocket pins on the cylinder being sequentially inserted into the two rows of sprocket holes in the printing sheet at least the trailing end of the printing sheet is clamped by the printing sheet clamper, the printing sheet can be wound onto the cylinder while being positioned thereon with high accuracy, and slippage and wrinkling of the printing sheet does not occur. Consequently, the interchangeability of the printing sheet with respect to the cylinder is extremely good, and when image data such as a photograph is engraved color by color in colors such as cyan, magenta, yellow and black and multicolor overprinting is carried out, color non-alignment, color blurring, image distortion and scumming and the like do not readily occur and high image quality, fine gravure printing can be performed.

Because there are provided pressure springs mounted in the left/right pair of printing sheet clamper support mechanisms which urge the printing sheet clamper against the periphery of the cylinder, a cam mechanism disposed around the peripheries of the ends of the cylinder which separates the printing sheet clamper from the periphery of the cylinder against the resistance of the pressure springs, and a fixed position lock mechanism which locks and unlocks the left/right pair of printing sheet clamper support mechanisms in a fixed position, clamping and unclamping of the printing sheet can be carried out simply and reliably.

Because the left/right pair of printing sheet clamper support mechanisms are provided with a left/right pair of rotary support plates rotatably mounted on the periphery of the shaft of the cylinder at the ends of the cylinder which are locked and unlocked by the fixed position lock mechanism and a left/right pair of clamper support plates which support the ends of the printing sheet clamper and are supported slidably in a direction normal to the axial direction of the cylinder by the left/right pair of rotary support plates and are urged to slide in one direction by the pressure springs, when the printing sheet clamper is being clamped and unclamped the left/right pair of clamper support plates which slide with respect to the left/right pair of rotary support plates in a direction normal to the axial direction of the cylinder enable the printing sheet clamper to move in parallel with the cylinder. As a result, especially during clamping, the printing sheet clamper does not cause any slippage or wrinkling of the printing sheet.

Because there is provided a printing sheet guide which guides the leading end of the printing sheet between the cylinder and the printing sheet clamper during winding of the printing sheet onto the periphery of the cylinder, the leading end of the printing sheet can be reliably guided between the printing sheet clamper and the cylinder during winding of the printing sheet onto the periphery of the cylinder and winding of the printing sheet and clamping of the wound printing sheet can be carried out smoothly.

By forward rotation of the cylinder, the two rows of sprocket pins on the ends of the periphery of the cylinder are made to enter the two rows of sprocket holes formed in the printing sheet two by two and the printing sheet is thereby automatically pulled out of the printing sheet jacket and wound onto the periphery of the cylinder. At least the trailing end of the printing sheet wound on the cylinder is clamped onto a portion of the periphery of the cylinder by a printing sheet clamper mounted parallel with the axial direction of the cylinder; because the roughly central portion, in the length direction, of the printing sheet clamper is attracted and held by a magnet recessed in the periphery of the cylinder, the printing sheet wound on the periphery of the cylinder can be clamped onto the periphery of the cylinder with good stability.

Because the roughly central portion, in the length direction, of the printing sheet clamper is attracted and held by a magnet recessed in the periphery of the cylinder, the roughly central portion in the length direction of the printing sheet clamper floating off the periphery of the cylinder due to centrifugal force during high speed rotation of the cylinder during engraving or printing, and consequent reduction in the clamping force on the printing sheet, can be completely prevented from being a problem. As a result, high precision engraving and printing can be carried out stably.

Because there is provided a cam mechanism which during unclamping of the printing sheet clamper causes the printing sheet clamper to undergo a pivoting motion wherein the ends of the printing sheet clamper in the cylinder circumferential direction pull away from the periphery of the cylinder alternately, even though when clamped the printing sheet clamper has its roughly central portion held against the periphery of the cylinder by the magnet, during unclamping the levering action of the pivoting motion of the printing sheet clamper enables the printing sheet clamper to easily separate from the magnet and unclamping of the printing sheet clamper can consequently be performed easily.

Because the left/right pair of printing sheet clamper support mechanisms are provided with a left/right pair of rotary support plates rotatably mounted on the shaft of the cylinder at the ends of the cylinder, a left/right pair of clamper support plates mounted on these left/right pair of rotary support plates slidably in a direction normal to the axial direction of the cylinder, a left/right pair of support pins which at both ends of the printing sheet clamper pivotally support one side of the printing sheet clamper on the left/right pair of clamper support plates, pressure springs which pivotally urge the printing sheet clamper about the left/right pair of support pins and press the printing sheet clamper against the periphery of the cylinder, and pressure springs which urge and press the whole printing sheet clamper against the periphery of the cylinder by urging the left/right pair of clamper support plates to slide with respect to the left/right pair of rotary support plates, and because the cam mechanism is provided with cams formed on the ends of the cylinder and left/right pairs of cam follower rollers, four rollers in total, mounted on the ends of the printing sheet clamper, which are pressed by the pressure springs against the periphery of the cams, clamping and unclamping of the printing sheet clamper can be performed reliably and easily.

The printing sheet jacket of the invention constructed as described above provides the following kinds of benefits:

Because a printing sheet is removably sheathed in a substantially rectangular printing sheet jacket having three sides closed and a printing sheet removal/insertion opening provided at the fourth side and all the handling of the printing sheet involved in the feeding and ejection of the printing sheet to and from the cylinder of a printing sheet making machine and the feeding and ejection of the printing sheet to and from the cylinder of a printing machine, from start to finish, can be done with the printing sheet sheathed in the printing sheet jacket, the adhesion of dust and the like and the occurrence of scratching on the surface of the printing sheet can be completely prevented. As a result, the printing sheet can be handled safely and easily, and stable printed matter with no color blurring or scumming or the like can be obtained.

Because the printing sheet can be handled sheathed inside a printing sheet jacket, a completely automated electronic gravure printing system or the like which can be run unmanned can easily be developed.

Because a substantially rectangular base sheet and cover sheet made of a thermoplastic resin are superposed and three sides are heat sealed, the manufacture of the printing sheet is simple.

Because a printing sheet accommodating space having a height greater than the thickness of the printing sheet is formed between the base sheet and the cover sheet by the cover sheet being provided with a vertical portion formed along the inner sides of the three closed sides of the printing sheet jacket, removal and reinsertion of the printing sheet from and into the printing sheet accommodating space inside the printing sheet jacket can be carried out smoothly.

Because the printing sheet removal/insertion opening is provided with an opening/closing flap, the printing sheet will not readily accidentally fall out of the printing sheet jacket while the printing sheet jacket is being handled.

Because the opening/closing flap is formed integrally with the opening end of the cover sheet and an opening/closing flap lock hole through which the opening/closing flap is passed to lock it is formed in the base sheet, the opening/closing flap can be reliably locked and the printing sheet is completely prevented from accidentally flying out of the printing sheet jacket while the printing sheet jacket is being handled.

Because a left/right pair of slits cut in from the opening end of the cover sheet are formed in the cover sheet at the left and right sides of the printing sheet removal/insertion opening, the opening end of the cover sheet can be easily opened and closed across its entire width and the printing sheet can be easily removed and inserted through the printing sheet removal/insertion opening.

Because taper portions tapering off in the printing sheet insertion direction for guiding printing sheet insertion are formed in the vertical portion of the cover sheet at the left and right sides of the printing sheet removal/insertion opening, when the printing sheet is being inserted into the printing sheet jacket the taper portions guide the printing sheet and the printing sheet can be inserted smoothly.

Because a bar code/label for identifying the printing sheet sheathed in the printing sheet jacket is affixed to the printing sheet jacket, identification and management of the printing sheet can be carried out easily.

Because sprocket holes spaced at a fixed pitch are formed along the left and right sides of the printing sheet and a left/right pair of sprocket access holes which expose some of the sprocket holes are formed at the left and right sides of the printing sheet jacket, feeding and ejection of the printing sheet to and from a printing sheet making machine or a printing machine can be carried out automatically by sprockets.

Because there are provided left/right asymmetrical misloading detection portions, misloading of the printing sheet jacket into a printing sheet making machine or a printing machine can be prevented, and the printing sheet can be easily loaded to the cylinders of these machines.

What is claimed is:

1. A printing sheet jacket into which an engraved or unengraved resin printing sheet is inserted, substantially rectangular in shape and of baglike form having three sides closed and a printing sheet removal/insertion opening formed at the fourth side through which printing sheet removal/insertion opening the printing sheet is automatically transferred between a cylinder of an engraving apparatus or a printing apparatus and the inside of the jacket by a printing sheet transfer mechanism of the engraving apparatus or of the printing apparatus said jacket having at least one feed opening permitting the printing sheet transfer mechanism to feed the printing sheet through the removal/insertion opening.

2. The printing sheet jacket according to claim 1, wherein the printing sheet jacket is made by superposing a substantially rectangular base sheet and cover sheet made of thermoplastic resin and heat sealing three of their sides.

3. The printing sheet jacket according to claim 2, wherein a space of a height greater than the thickness of the printing sheet is formed between the base sheet and the cover sheet by the cover sheet being provided with a vertical portion along the inner sides of the three heat sealed sides.

4. The printing sheet jacket according to claim 1, wherein the removal/insertion opening is provided with an opening/closing flap.

5. The printing sheet jacket according to claim 4, wherein the opening/closing flap is formed integrally with an end portion of the cover sheet at the open end of the jacket and an opening/closing flap lock hole into which the opening/closing flap is passed to lock it is formed in the base sheet.

6. The printing sheet jacket according to claim 2, wherein a slit cut into the end portion of the cover sheet at the open end of the jacket is provided at side of the removal/insertion opening.

7. The printing sheet jacket according to claim 3, wherein at both sides of the removal/insertion opening the vertical portion of the cover sheet is provided with a taper portion tapering off with progress in the printing sheet insertion direction.

8. The printing sheet jacket according to claim 1, wherein said at least one feed opening of the jacket comprising sprocket access holes which expose sprocket holes formed in the printing sheet.

9. The printing sheet jacket according to claim 2, wherein a plurality of sprocket holes are formed along one side and another side of the printing sheet and the plurality of sprocket holes formed along one side are larger than the plurality of sprocket holes formed along the other side said plurality of sprocket holes along said one side and said another side of the printing sheet being exposed through respective feed openings in said jacket.

* * * * *